US006988775B2

(12) United States Patent
Okamoto

(10) Patent No.: US 6,988,775 B2
(45) Date of Patent: Jan. 24, 2006

(54) SCRAPPING METHOD OF BUILDING AND SCRAPPING MACHINE

(76) Inventor: Toshihito Okamoto, 2695 Kaneda, Chosei-son, Chosei-gun, Chiba (JP)

( * ) Notice: Subject to any disclaimer, the term of this patent is extended or adjusted under 35 U.S.C. 154(b) by 0 days.

(21) Appl. No.: 10/423,698

(22) Filed: Apr. 25, 2003

(65) Prior Publication Data

US 2004/0211093 A1 Oct. 28, 2004

(51) Int. Cl.

| | |
|---|---|
| ***E21C 35/02*** | (2006.01) |
| ***E21C 37/00*** | (2006.01) |
| ***E21C 41/00*** | (2006.01) |
| ***E21C 45/00*** | (2006.01) |
| ***E21C 47/04*** | (2006.01) |

(52) U.S. Cl. ..... 299/18; 299/64

(58) Field of Classification Search ..... 173/1; 37/195; 299/10, 18, 29, 64, 39.1, 39.2, 42, 299/43, 58

See application file for complete search history.

(56) References Cited

FOREIGN PATENT DOCUMENTS

| | | | |
|---|---|---|---|
| JP | 7-54503 | * | 2/1995 |
| WO | WO 02/100618 A1 | * | 12/2002 |

* cited by examiner

*Primary Examiner*—Christopher J. Novosad
(74) *Attorney, Agent, or Firm*—Jordan and Hamburg LLP

(57) ABSTRACT

The method of demolishing a building includes self-propelling a demolition machine into the building, operating the demolition machine so as to form a movement hole at a floor part of an upper story, moving the demolition machine to the upper floor via the movement hole; moving the demolition machine to the highest floor by repeating the aforementioned operation; discharging the demolition waste downwardly through the movement holes.

7 Claims, 63 Drawing Sheets

SCRAPPING METHOD OF BUILDING AND SCRAPPING MACHINE

BACKGROUND OF THE INVENTION

This invention relates to the scrapping method of constructions such as a building and a scrapping machine. When the constructions such as buildings are scrapped conventionally, the breaker and clasped crushing device are attached in the tip part of the drive arm of the backhoe, and the building is disassembled from the outside the building.

In the conventional scrapping method using the backhoe, the building can be disassembled only range that the tip part of the drive arm of the backhoe reaches, and the disassembled part is restricted.

Moreover, the breaker and clasped crushing device attached in the tip part of the drive arm can move only around the backhoe and to an outer direction.

Furthermore, installation of the backhoe and reservation of work space are needed for the outside of the building in order to disassemble a building from the outside of the building so that some troubles are happened and the operation troubles the neighbors.

SUMMARY OF THE INVENTION

Accordingly, it is an object of the invention to provide a scrapping method for constructions which can scrap using the scrapping machine on a building regardless of the height of the building.

It is another object of the invention to provide a scrapping method for constructions which can operate so as to place the demolition waste inside the building from a top of the building and to transport the scraping machine to an upper story easily, and the building is disassembled without securing, surrounding the building, installation space or work space for the machine.

It is a further object of the invention to provide a scrapping machine which can fully operate even if it has a small drive arm and body as a mini backhoe.

Novel features which are believed to be characteristic of the invention, both as to its organization and method of operation, together with further objects and advantages thereof, are described below with reference to the accompanying drawings in which preferred embodiments of the invention are illustrated as an example.

It is to be expressly understood, however, that the drawings are for the purpose of illustration and description only, and are not intended as a definition of the limits of the invention.

DETAILED DESCRIPTION OF THE PREFERRED EMBODIMENTS

Figure 1:
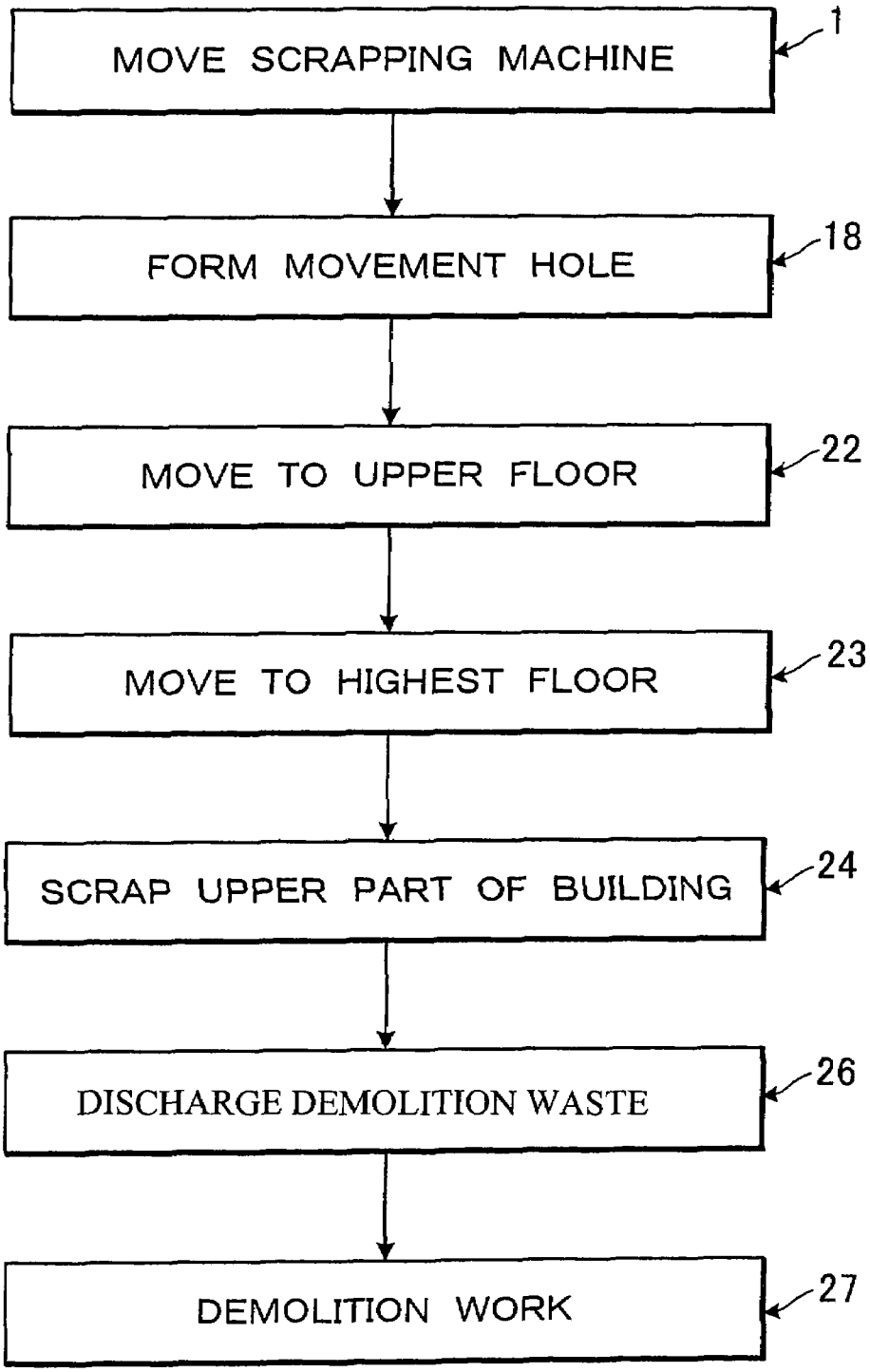
FIG. 1 is a flow showing a first embodiment of the present invention.
Figure 2:
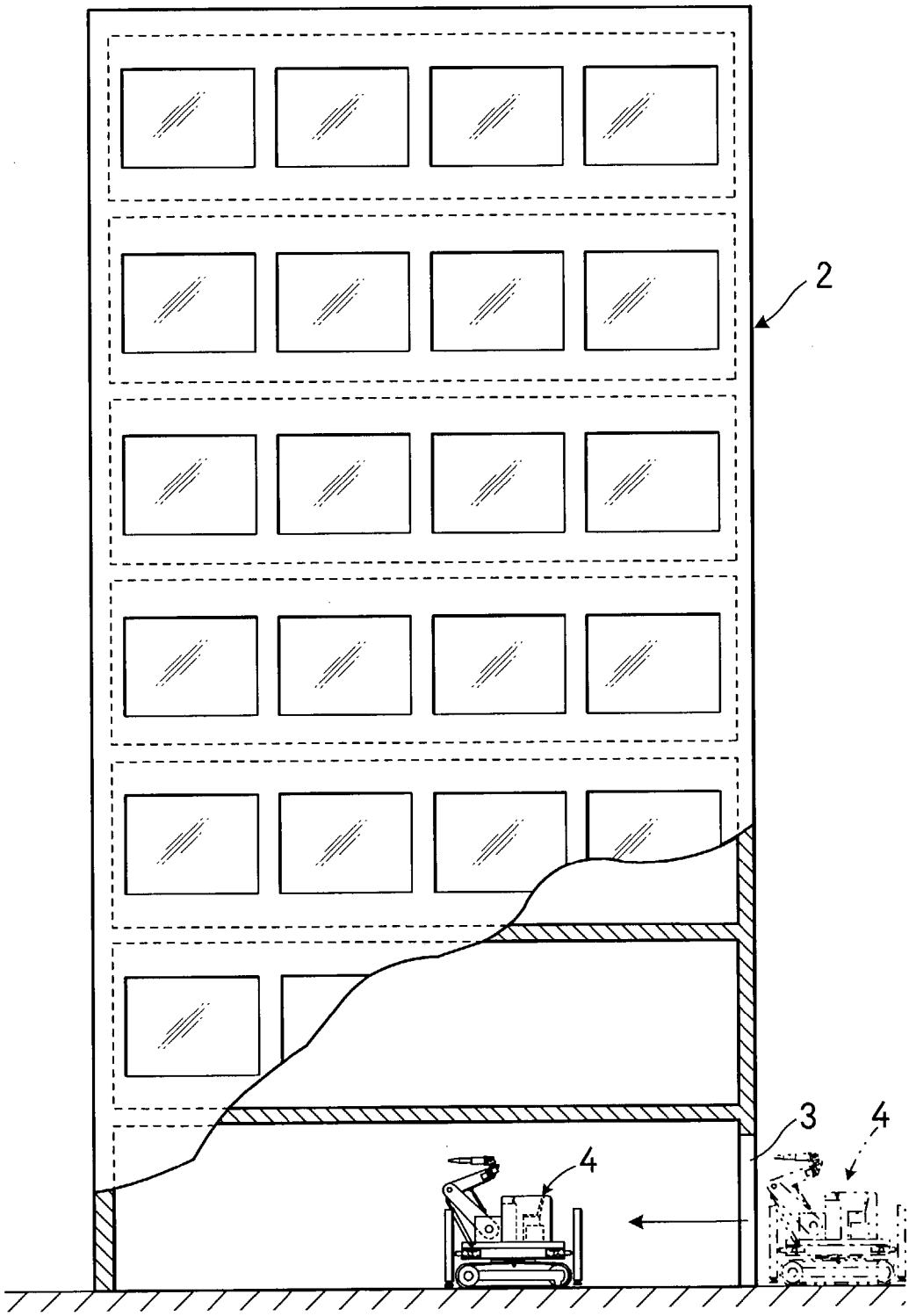
FIG. 2 is an explanatory view for moving a scrapping machine.
Figure 3:
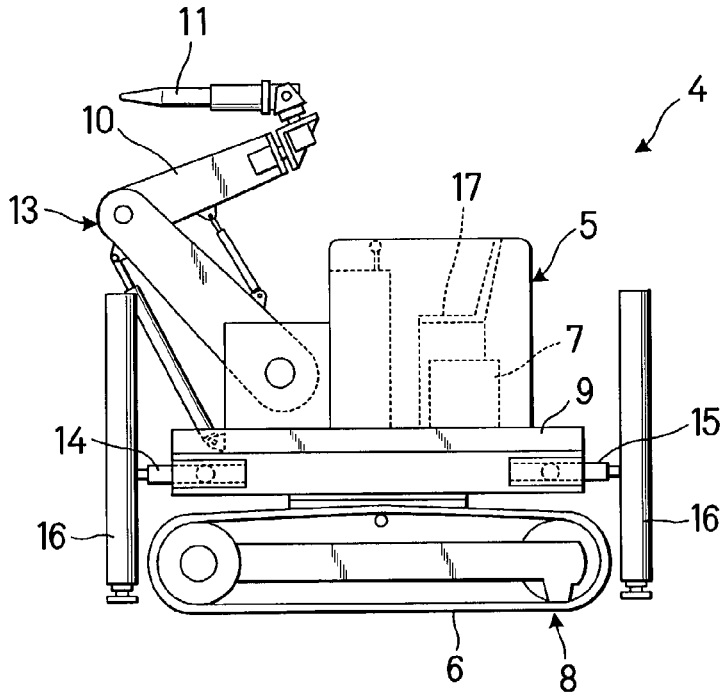
FIG. 3 is a side view of a scrapping machine.
Figure 4:
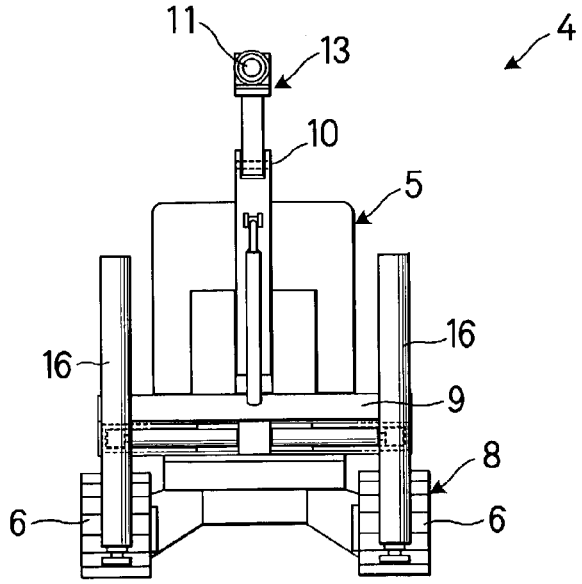
FIG. 4 is a front view of a scrapping machine.
Figure 5:
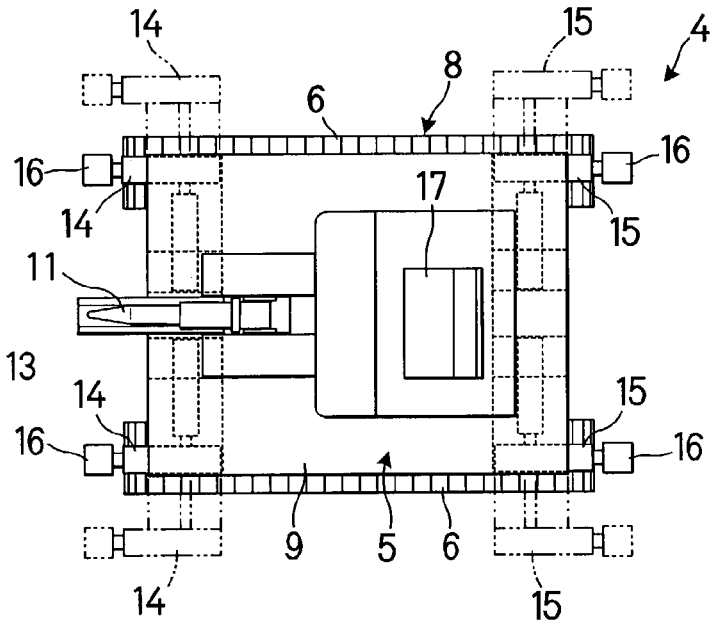
FIG. 5 is a top view of a scrapping machine.
Figure 6:
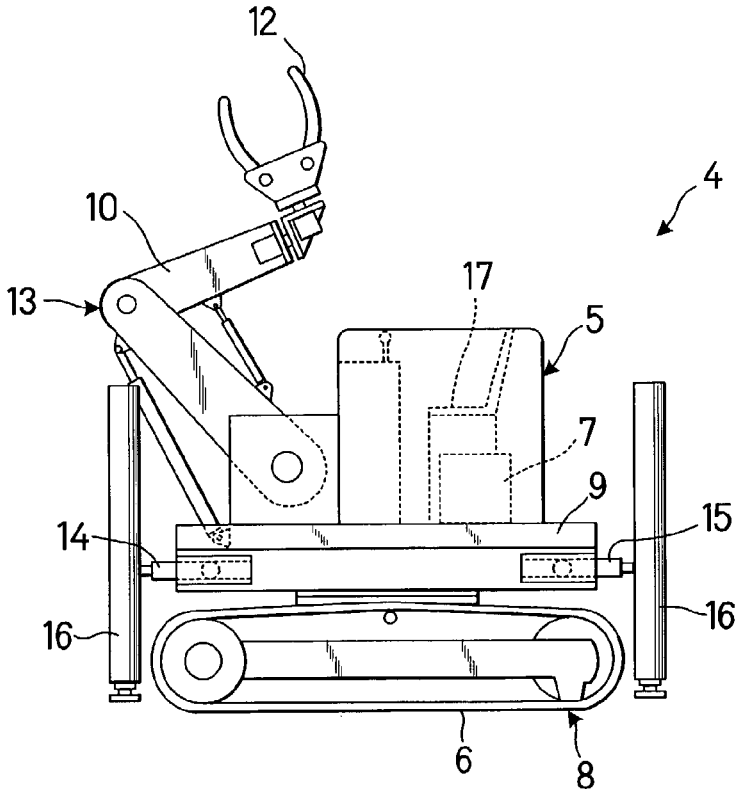
FIG. 6 is a side view showing the way in which the clasped crushing device is attached.

Preferred embodiments of the present invention are described in more detail below with reference to the accompanying drawings.

An understanding of the present invention may be best gained by reference to FIGS. 1–10. FIGS. 1–10 illustrate a scrapping method of constructions such as a building in accordance with a first embodiment of the present invention.

The numeral 1 shows a step for moving a scrapping machine 4 for a building 2, and the scrapping machine 4 self-propels inside through an opening 3 of the building 2, the opening 3 being disassembled from the outside. The scrapping machine 4 of the building used at the movement process 1 is formed in substantially the same size as a mini backhoe.

As shown in FIGS. 3–6, the scrapping machine 4 comprises a body; a running device 8; a scrapping machine body 13; and extensible legs 16.

The running device 8 is comprised of caterpillars 6 attached to both sides of the body 5, capable of running the body 5; and a hydraulic drive device 7, using in the hydraulic backhoe, driving the caterpillars 6.

The scrapping machine body 13 has the almost same mechanism of the mini backhoe, having a drive arm 10 that is attached, capable of rotating horizontal direction. A breaker 11 and a clasped crushing device 12 are attached to a tip portion of the drive arm 10 respectively.

The extensible legs 16 using at least four hydraulic cylinders are attached to forward-, backward-, right- and left portions at a base 9 of the body 5 via two hydraulic cylinders 14 and 15, capable of moving the base 9 up to an upper floor of the building 2.

The scrapping machine 4 can run by driving hydraulic drive device 7 as well as the conventional mini backhoe, and it can operate the breaker 11 and the clasped crushing device 12 or the drive arm 10 from a drivers seat 17 of the scrapping machine body 13.

Moreover, when the scrapping machine 4 moves to upper floor or works a higher place, the extensible legs 16 can expand and contract, and the hydraulic cylinders 14 and 15 can expand and contract.

Figure 7:
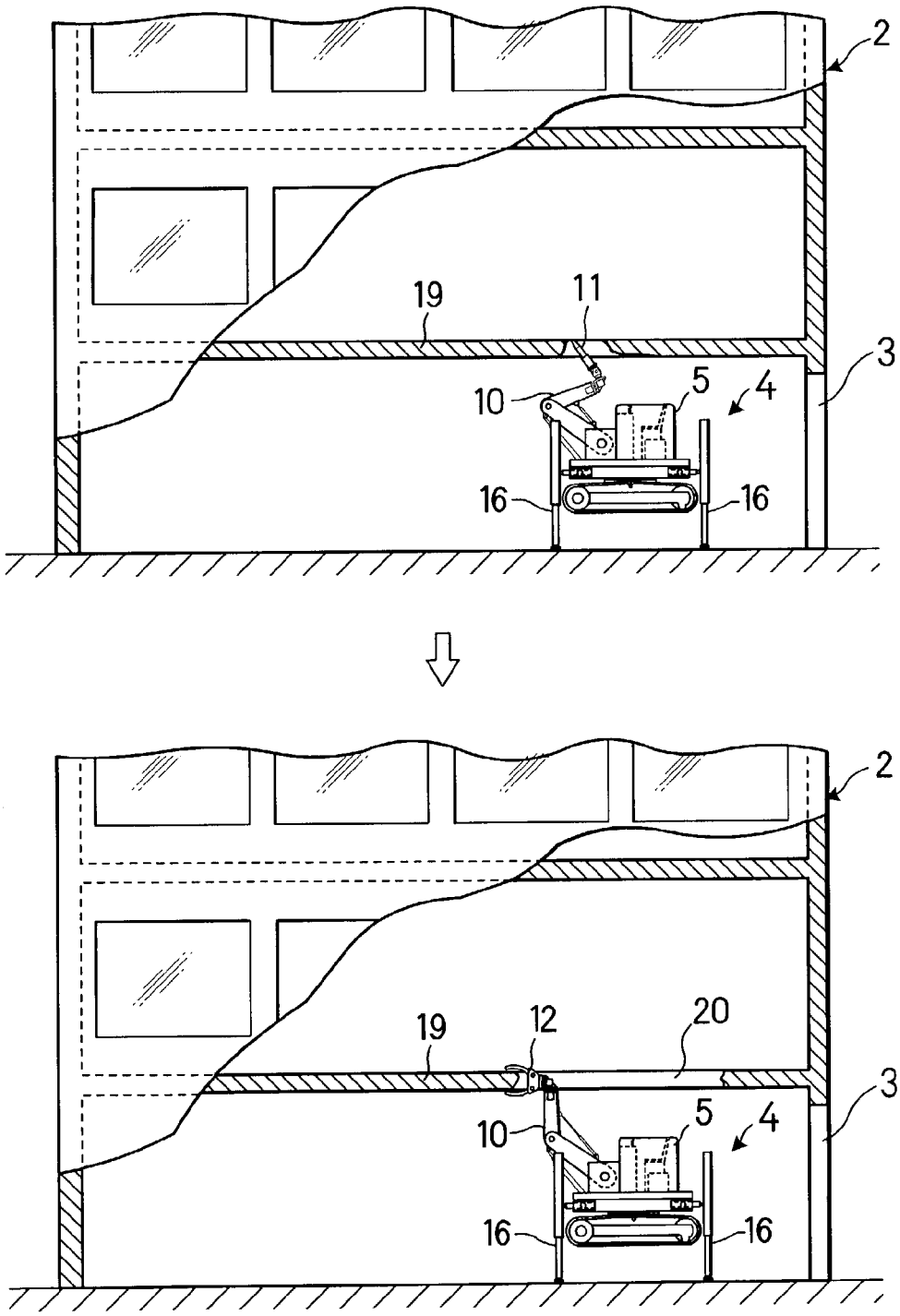
FIG. 7 is an explanatory view showing the way in which a hole for moving is formed.

The numeral 18 shows a step for forming a movement hole 20 which is formed at a floor part 19 of the upper floor by the scrapping machine 4 after the movement process 1, the scrapping machine 4 can pass through the movement hole 20 and move to the upper floor. The breaker 11 attached to the tip portion of the drive arm 10 forms a hole 21, as shown in FIG. 7, then the clasped crushing device 12 is attached to the tip portion of the drive arm 10, and the floor part 19 is clasped and broken by the clasped crushing device 12, and the movement hole 20 is formed.

Figure 8:
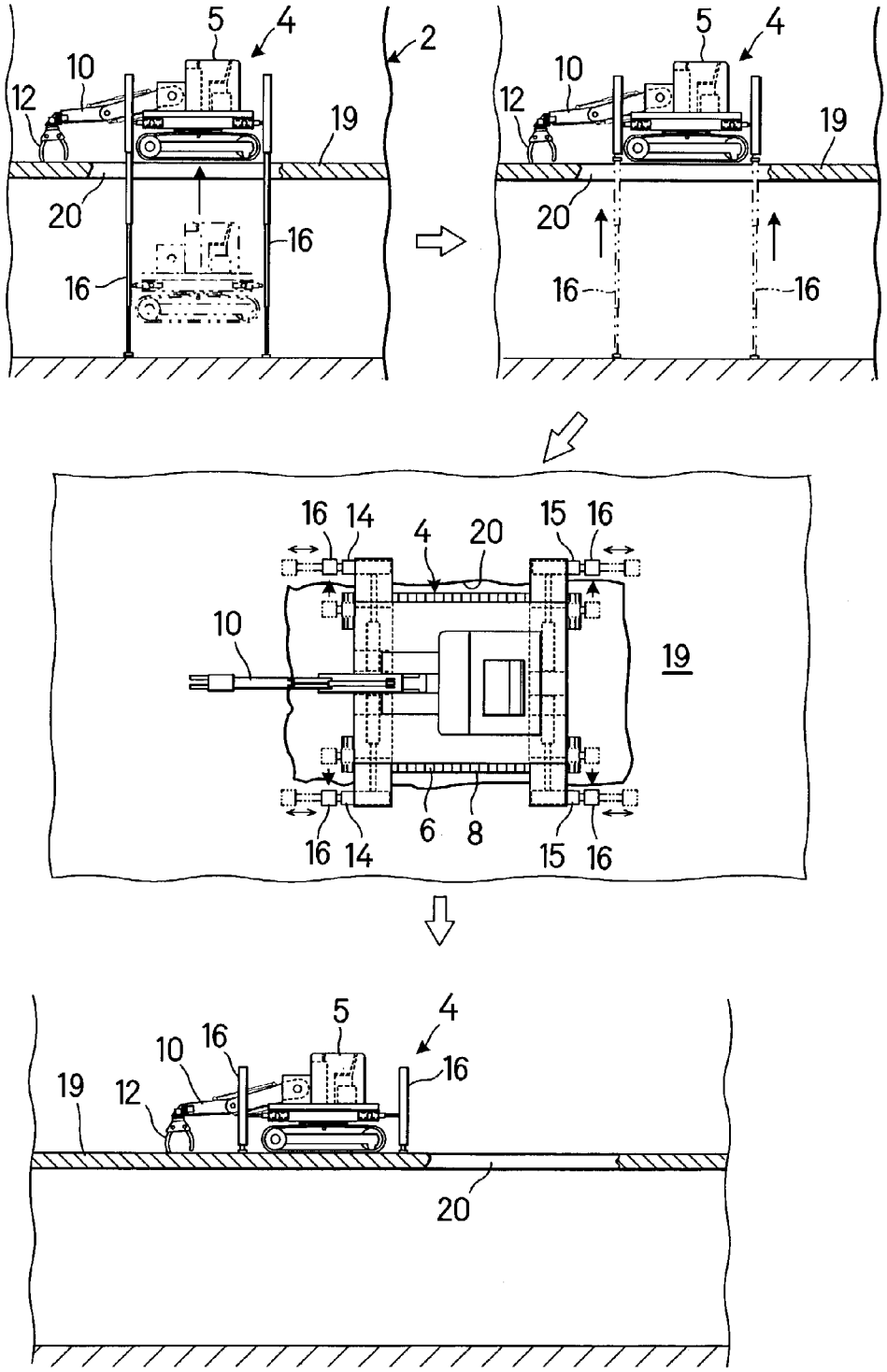
FIG. 8 is an explanatory view showing the way in which the scrapping machine moves to an upper floor.

The numeral 22 shows a step for moving the scrapping machine 4 to the upper floor via the movement hole 20. In the movement process 22, the scrapping machine 4 may move to the upper floor by four winches. As shown in FIG. 8, after the extensible legs 16 extend, the scrapping machine 4 passes the movement hole 20. Then the bottom portion of the caterpillars 6 is placed at an upper portion of the floor part 19 of the upper floor, and the tip portion of the drive arm 10 is contacted at the floor part 19.

After that, one of the extensible legs 16 is contracted and the hydraulic cylinders 14 and 15 are acted and moved to forward-, backward-, left- and right directions, the extensible leg 16 locates so as to be supported by the floor part 19. After doing such work one by one and the extensible legs 16 locates so as to be supported by the floor part 19, the caterpillars 6 is located on the floor part 19 via the operating of the hydraulic cylinders 14 and 15 and run on the floor part 19 of the upper floor.

Figure 9:
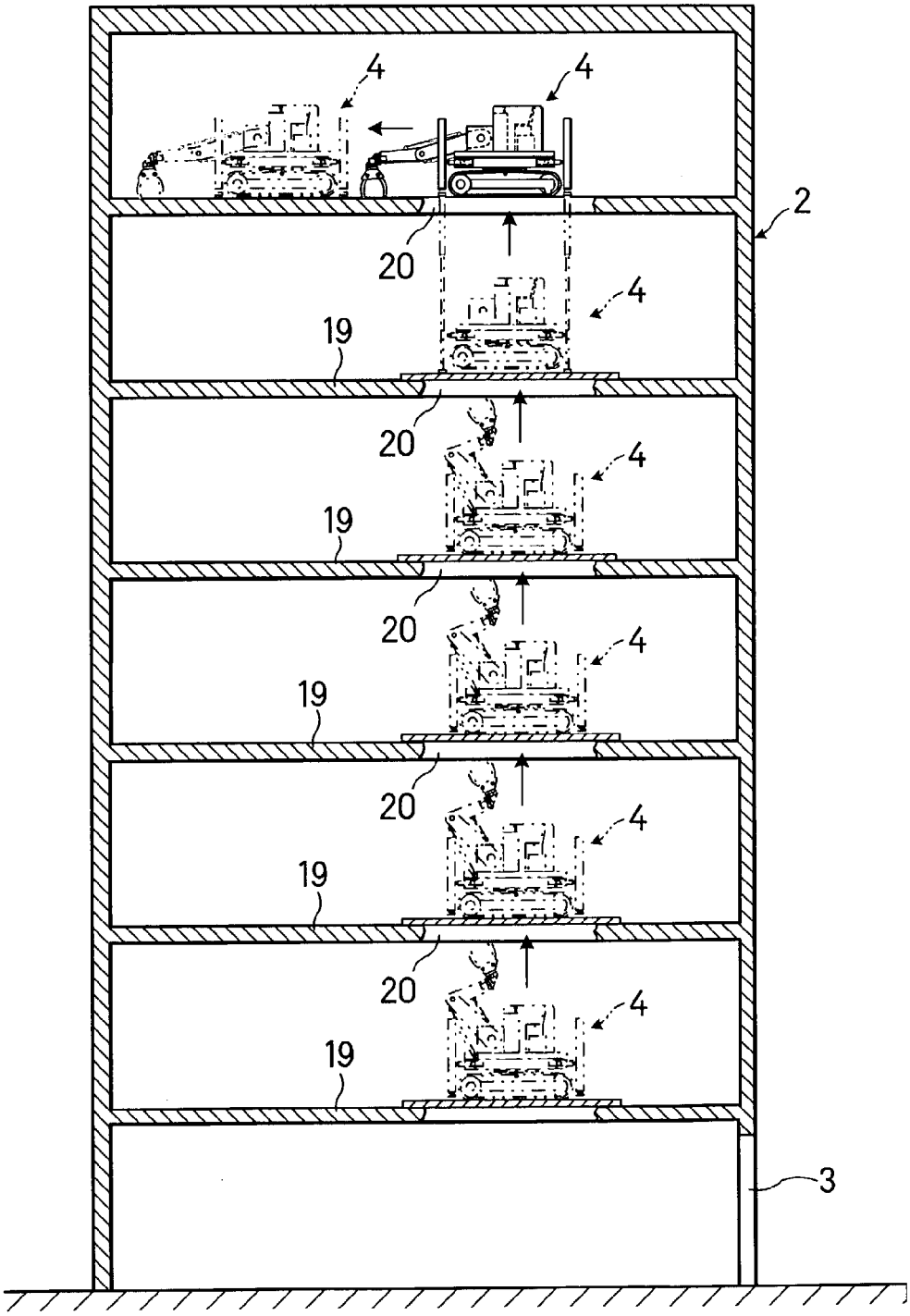
FIG. 9 is an explanatory view showing the way in which the scrapping machine moves to a top floor.

As shown in FIG. 9, the numeral 23 shows a step for moving the scrapping machine 4 to the highest floor after the hole formation process 18 and movement process 22 are performed one by one. In this step, the hole formation process 18 is operated such that a support plate and support bar are arranged so as to locate the scrapping machine 4 above the movement hole 20 which is formed below when the movement hole 20 is formed at the same place as the movement hole 20 in lower floors.

On the other hand, when the movement hole 20 is formed at the different place of the movement hole 20 of the down stair, the movement hole 20 of the down stair leaves as it is.

Figure 10:
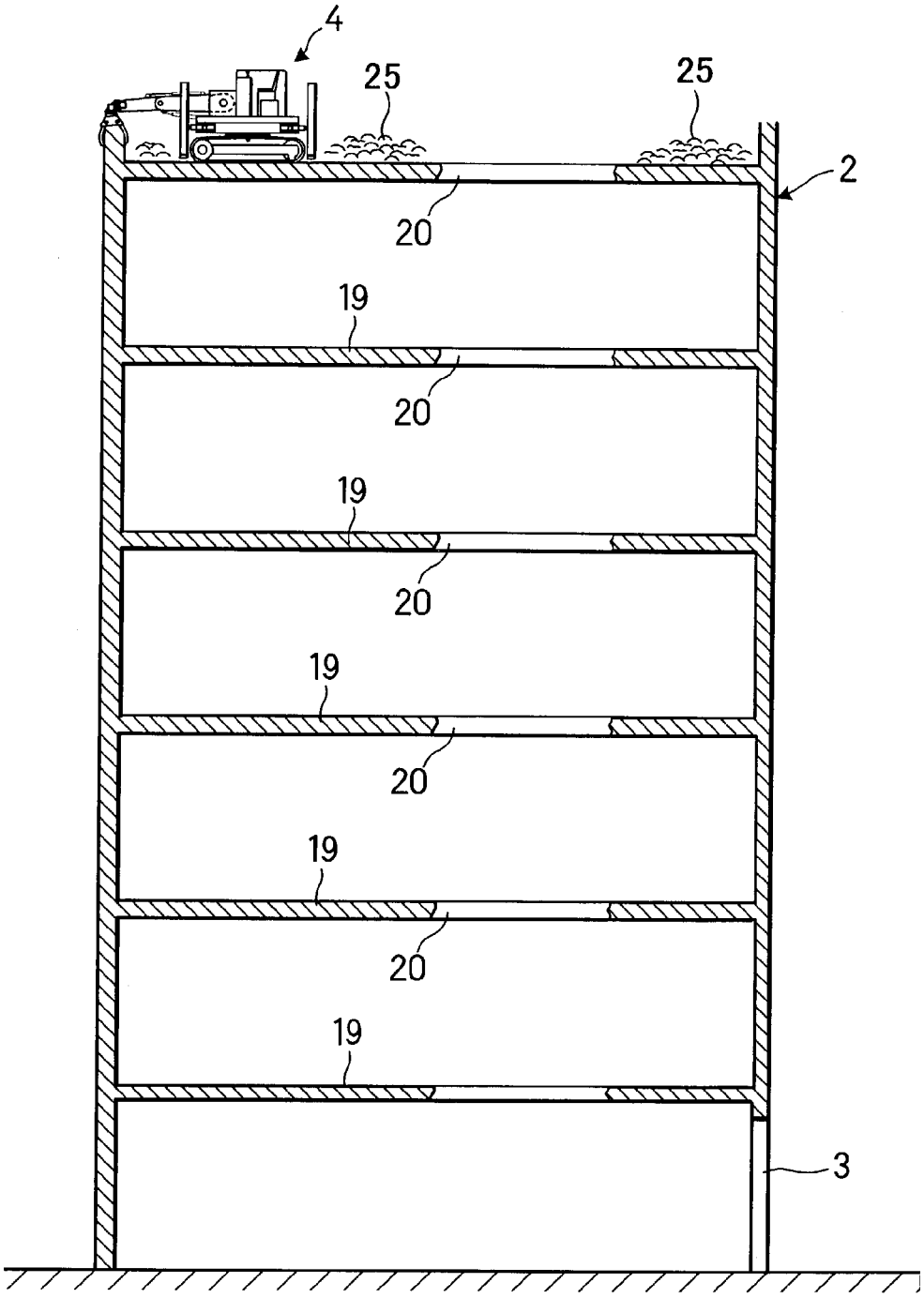
FIG. 10 is an explanatory view showing the way in which the upper part of the building is scraped.

As shown in FIG. 10, the numeral 24 shows a step for scrapping at the top part of the building 2 without scrapping the floor part located beneath the scrapping machine 4, and the building is scrapped so as to place the demolition waste inside the building 2. In this step 24, the breaker 11 and clasped crushing device 12 are attached to the tip portion of the drive arm 10, and the demolition work is carried out.

The numeral 26 shows a step for discharging the demolition waste 25 that produces at the scrapping process 24 through the movement hole 20 to the lower direction. In the discharging process 26, the scrapping machine 4 of a building performs, and it is performed by hand.

The numeral 27 shows a step of the demolition work to the lower floor. In this step 27, the scrapping machine 4 moves to the lower floor after the step 24 is performed, and the scrapping process 24 and discharging process 26 are performed one by one. The movement of the scrapping machine 4 is performed by extension and contraction of the extensible legs 16 and hydraulic cylinders 14 and 15.

Other embodiments of the present invention will now be described with reference to FIGS. 11–85. In FIGS. 11–85, the same components as in the first embodiment described above with reference to FIGS. 11–85 are designated by the same reference numerals and therefore will not be further explained in great detail.

Figure 11:
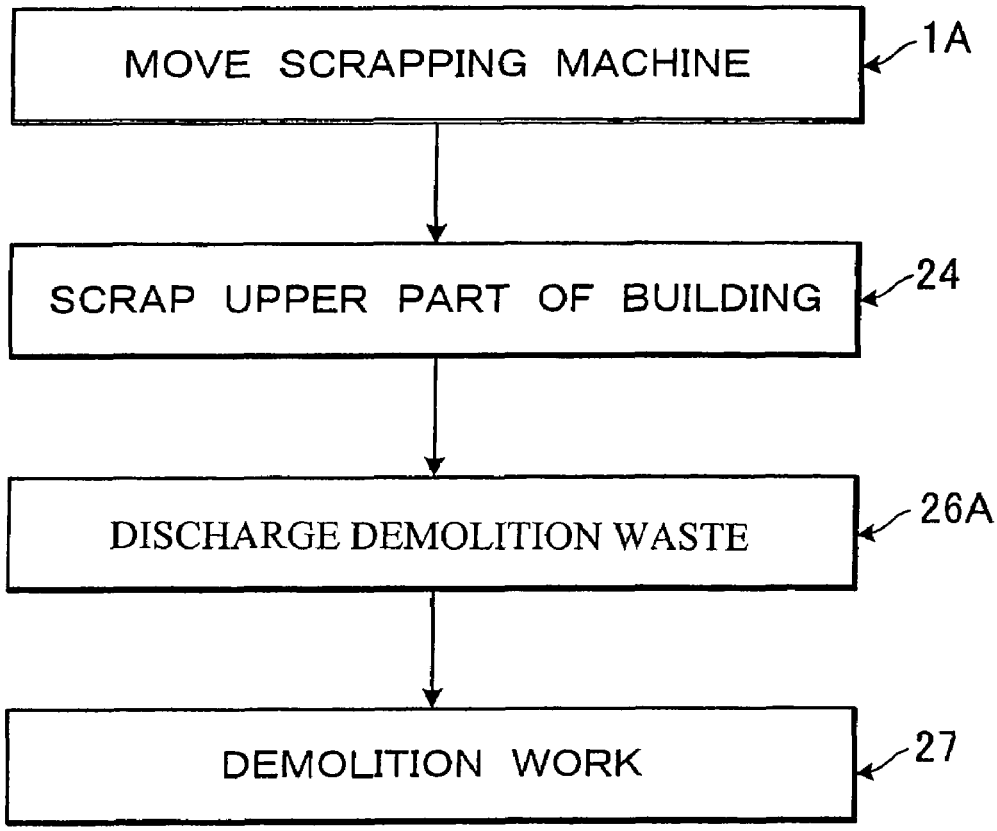
FIG. 11 is a flow showing a second embodiment of the present invention.
Figure 12:
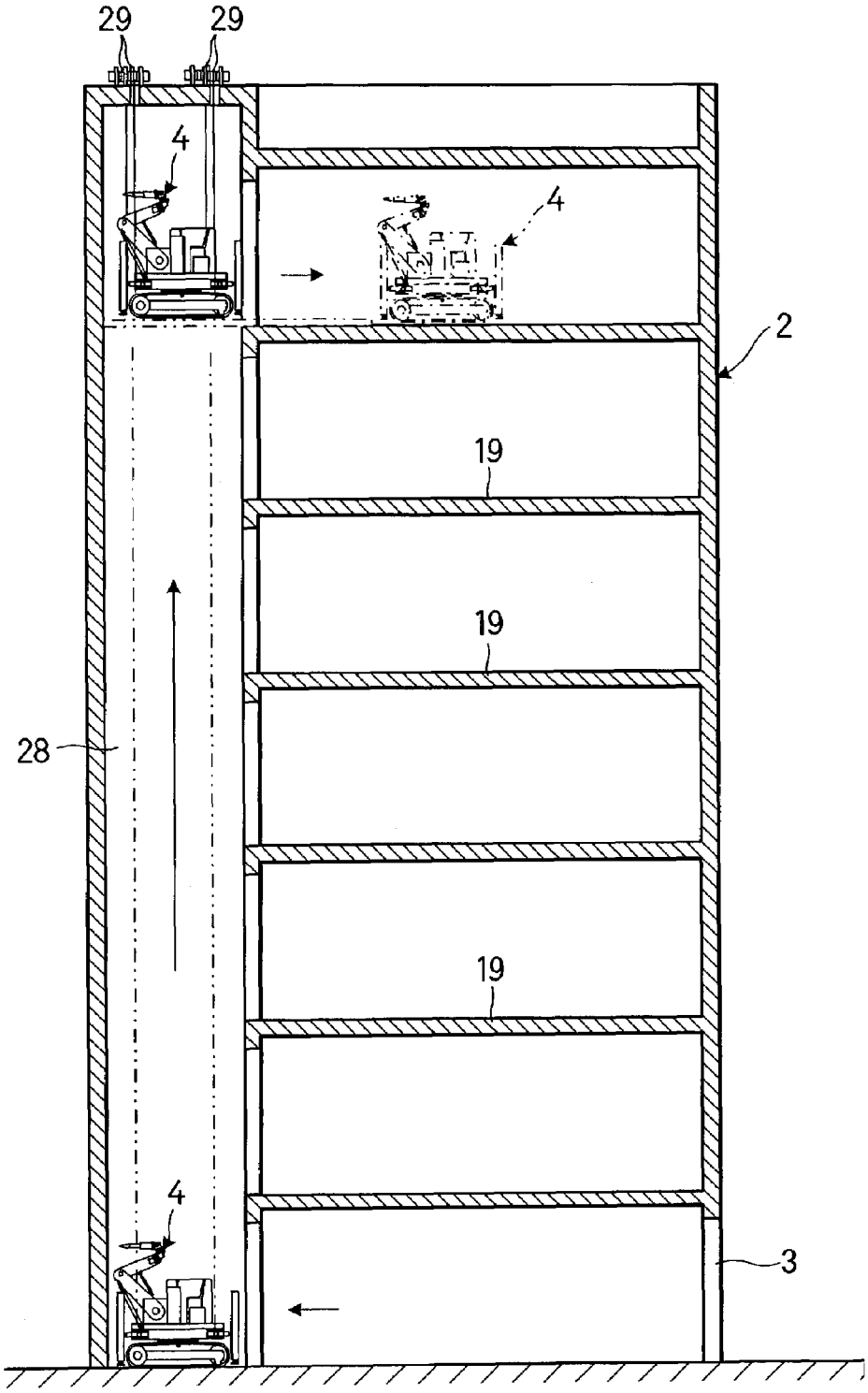
FIG. 12 is an explanatory view for moving a scrapping machine.
Figure 13:
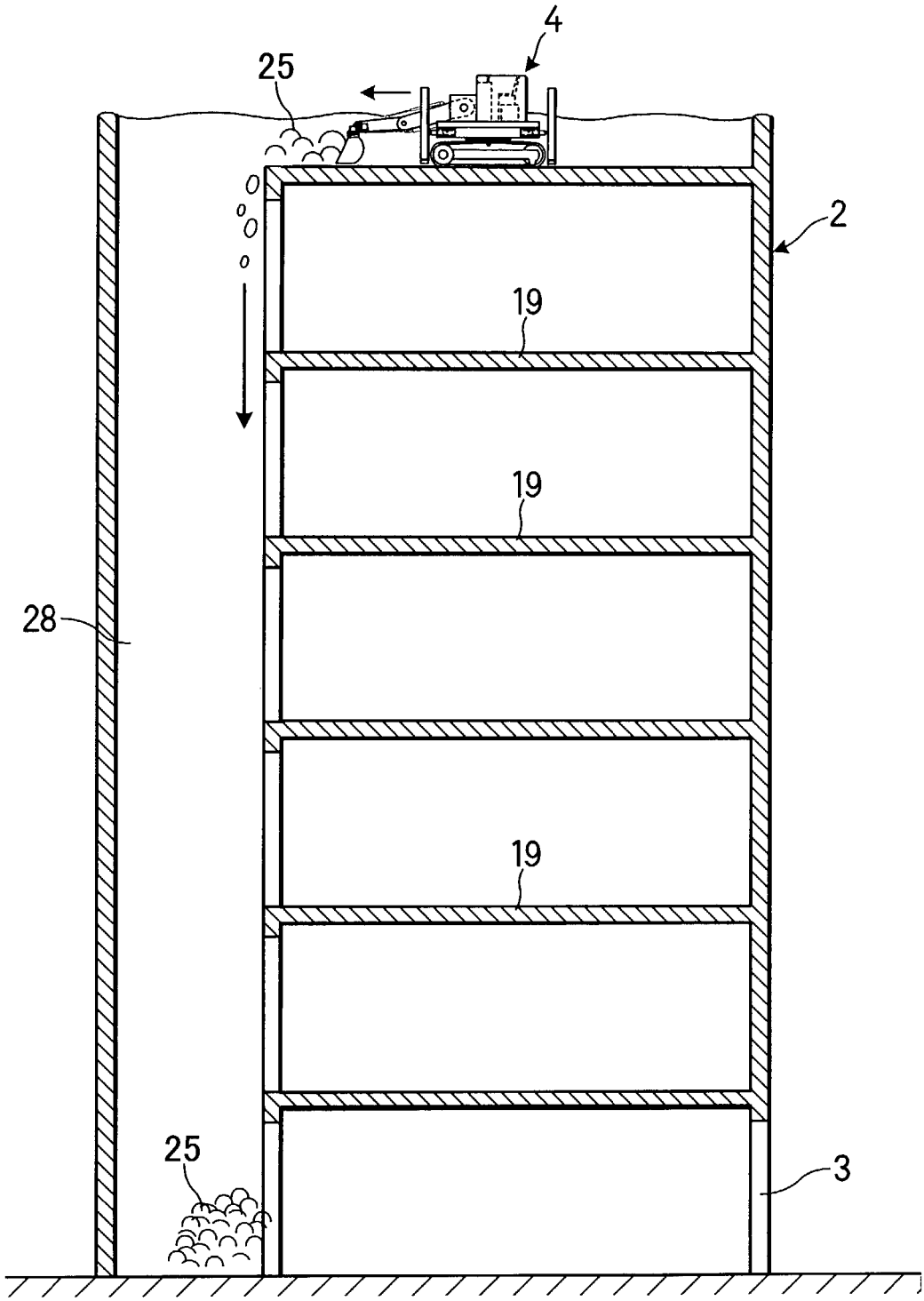
FIG. 13 is an explanatory view showing the way in which the demolition waste is discharged.

A second embodiment of the present invention is shown in FIGS. 11–13. It is distinguished from the first embodiment in that a movement process 1A that the scrapping machine 4 moves to the highest floor through an elevator hole 28 is performed, and a process 26A for discharging the demolition waste through the elevator hole 28. A scrapping method with the movement process 1A and discharging process 26A according to the second embodiment has similar advantages to that according to the first embodiment.

In addition, removal of an elevator and disassembling the entrance part of the elevator hole 28 are performed before the movement of the scrapping machine 4 through the elevator hole 28 is performed with four winches 29.

Figure 14:
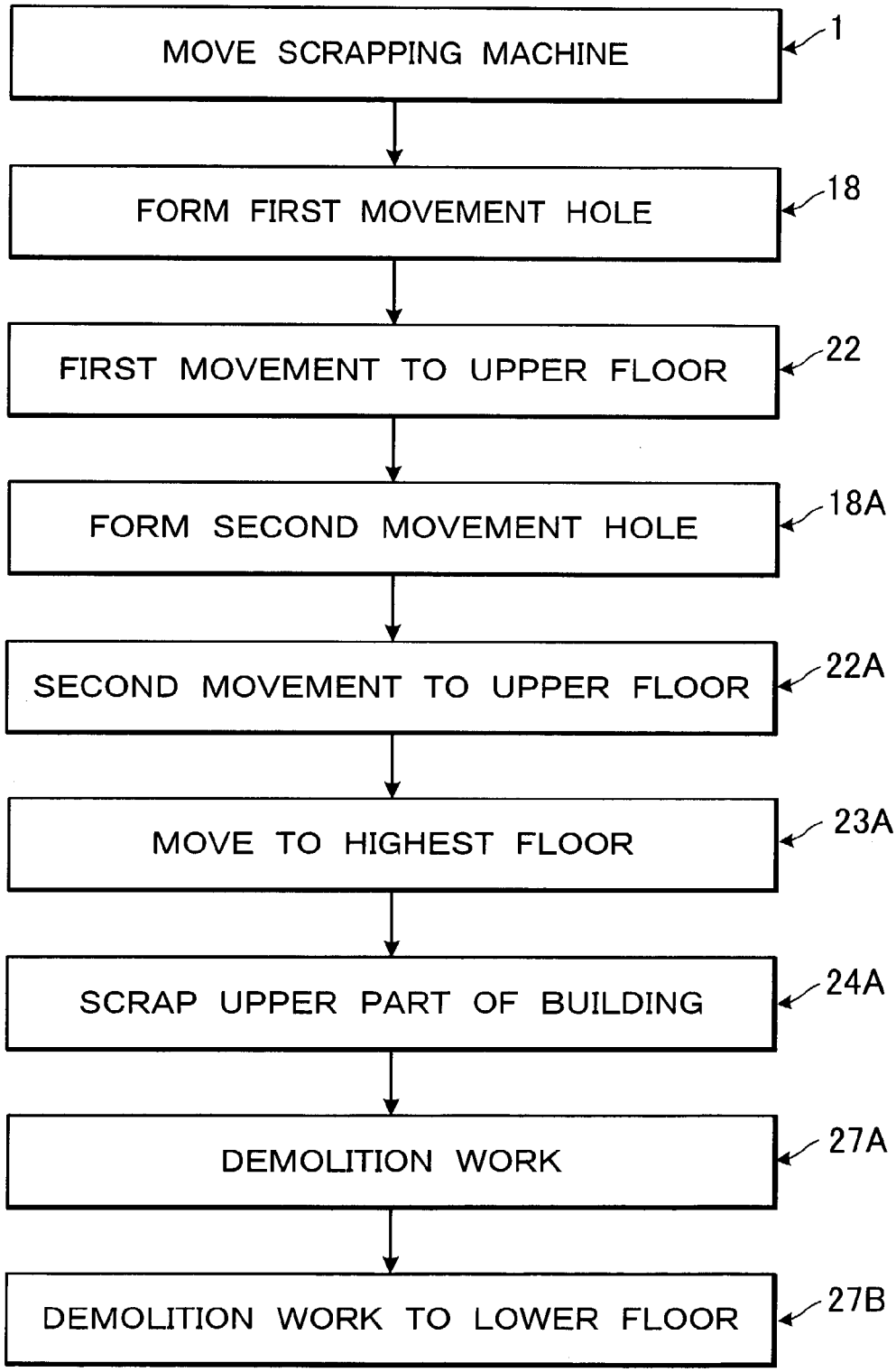
FIG. 14 is a flow showing a third embodiment of the present invention.
Figure 15:
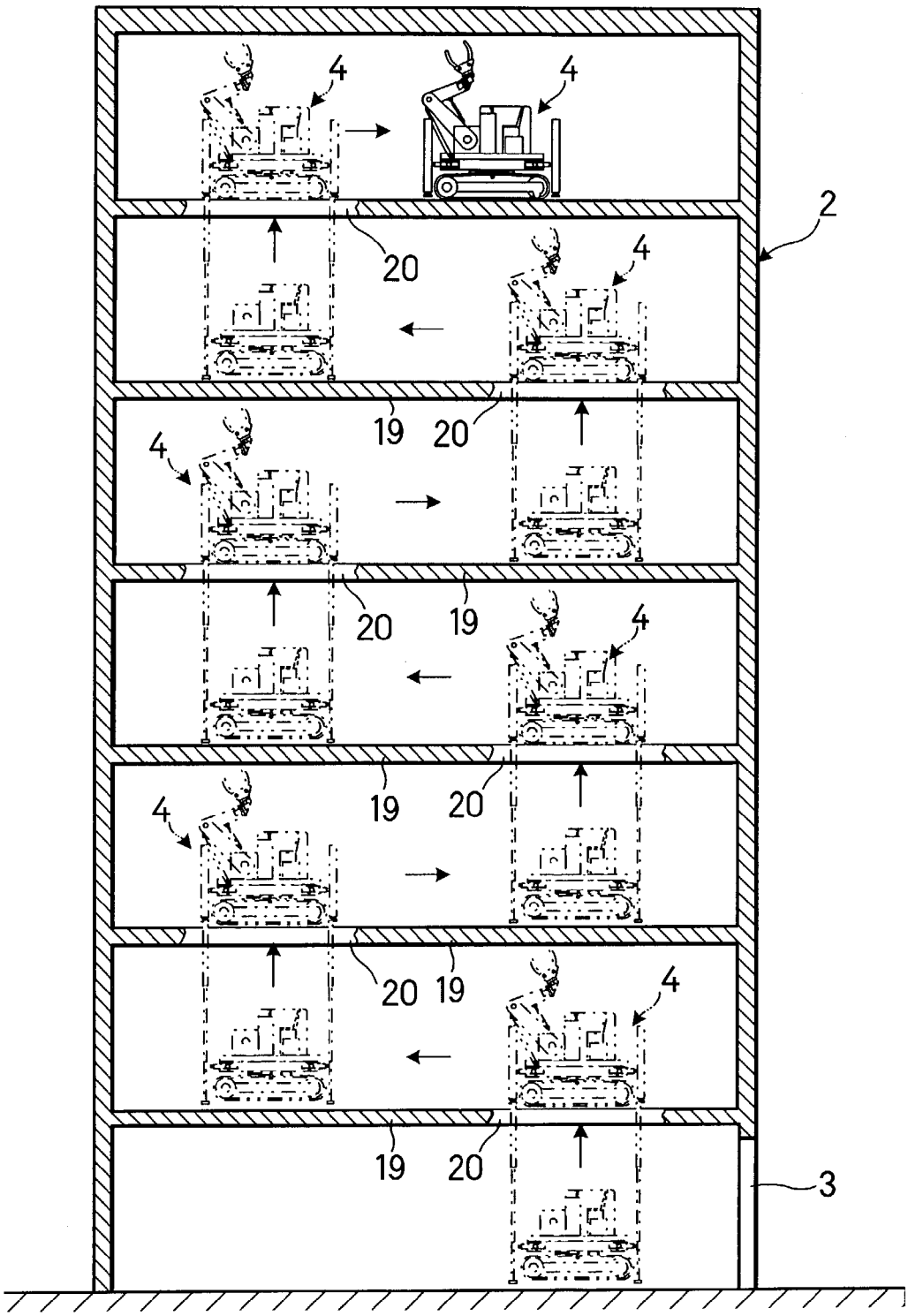
FIG. 15 is an explanatory view showing the way in which the scrapping machine moves to a top floor.
Figure 16:
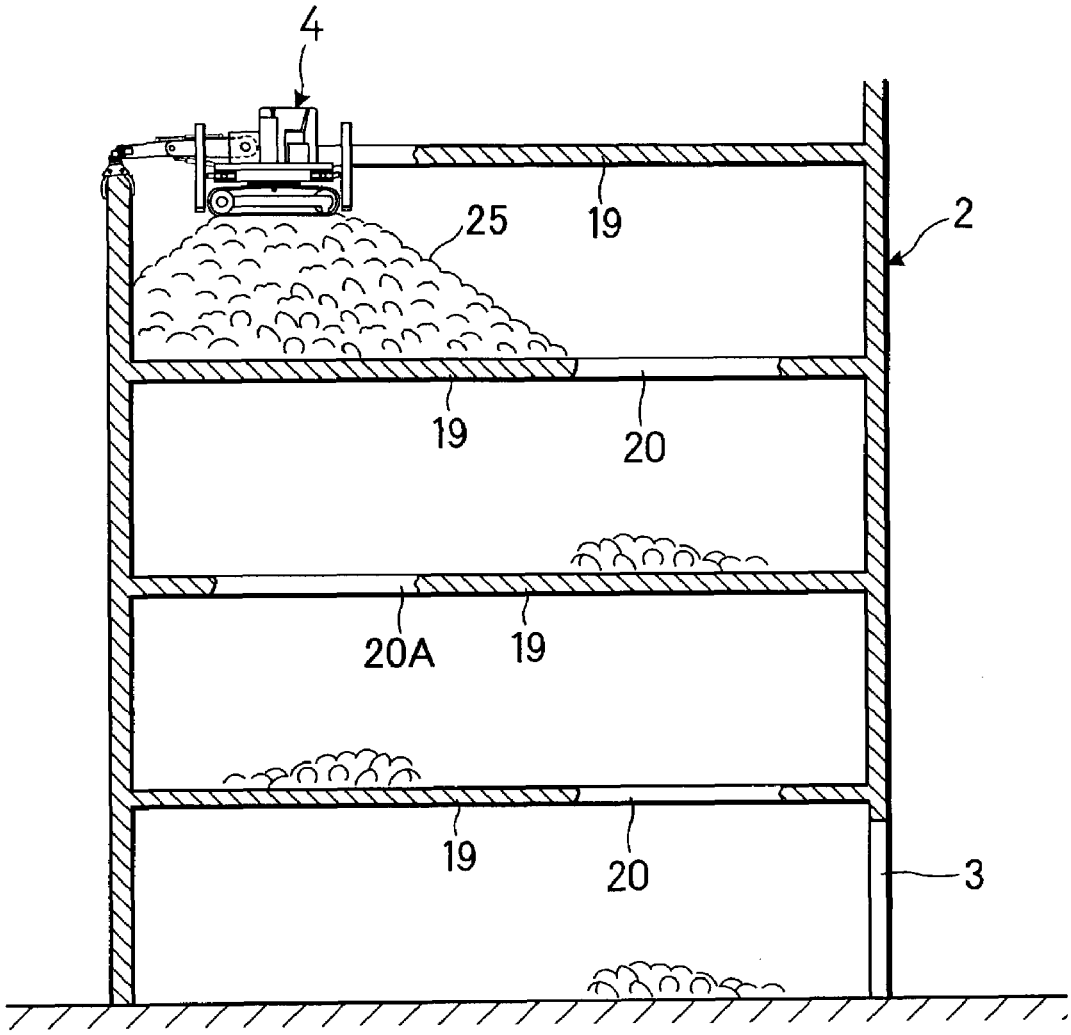
FIG. 16 is an explanatory view showing the way in which the demolition work is operated.

A third embodiment of the present invention is shown in FIGS. 14–16. It is distinguished from the first embodiment in that a scrapping method is composed of a movement process 1; a forming process 18 for the first movement hole 20; a first movement process 22 to the upper floor; a forming process 18A for the second movement hole 20A; a second movement process 22 to the upper floor; a process 23A for moving the scrapping machine 4 to the highest floor; a process 24A for scrapping at the top part of the building 2; a process 27A of the demolition work; and a process 27B of the demolition work to the lower floor.

In the forming process 18, the first movement hole 20 formed to move the scrapping machine 4 to the upper floor after the movement process 1 is performed.

Then the scrapping machine 4 moves through the first movement hole 20 in the first movement process 22.

In the forming process 18A, the second movement hole 20A to move the scrapping machine 4 to the upper floor is formed on the upper floor portion located at a different place from the first movement hole 20.

Then the scrapping machine 4 moves through the second movement hole 20A in the second movement process 22A.

Then the scrapping machine 4 moves to the highest floor of the building in the process 23A after the forming process 18, the first movement process 22, the forming process 18A and the second movement process 22A are performed one by one.

After that, the scrapping machine 4 scraps so that the demolition waste is located inside the building, and it is discharged to the lower floor, and the scrapping machine 4 located on the floor or the demolition waste also scraps the floor part of the upper portion of the building in the process 24A.

In the process 27A of the demolition work, the demolition waste is discharged through the movement holes 20 and 20A. The scrapping machine 4 scraps so that the demolition waste is located inside the building, and the demolition waste is discharged through the movement holes 20 and 20A. Then the scrapping machine 4 located on the floor or the demolition waste also scraps the floor part.

Then the process 27A is repeated, and the scrapping machine 4 scraps to the lower floor in the process 27B of the demolition work.

A scrapping method according to the third embodiment has similar advantages to that according to the first embodiment.

Figure 17:
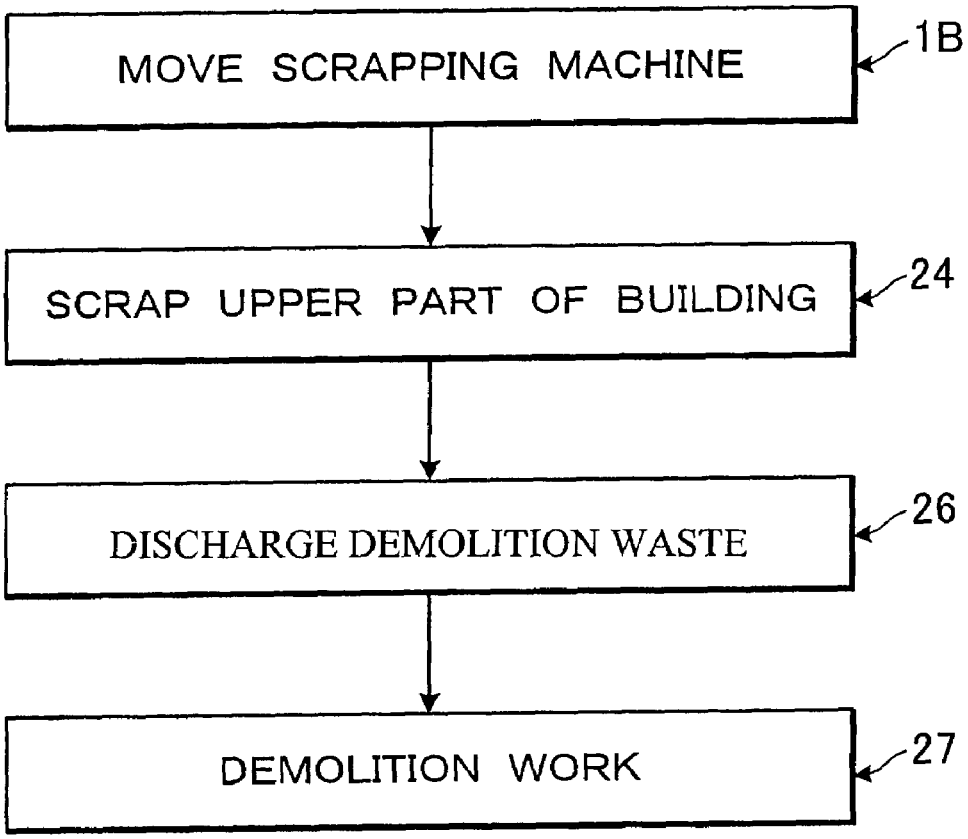
FIG. 17 is a flow showing a fourth embodiment of the present invention.
Figure 18:
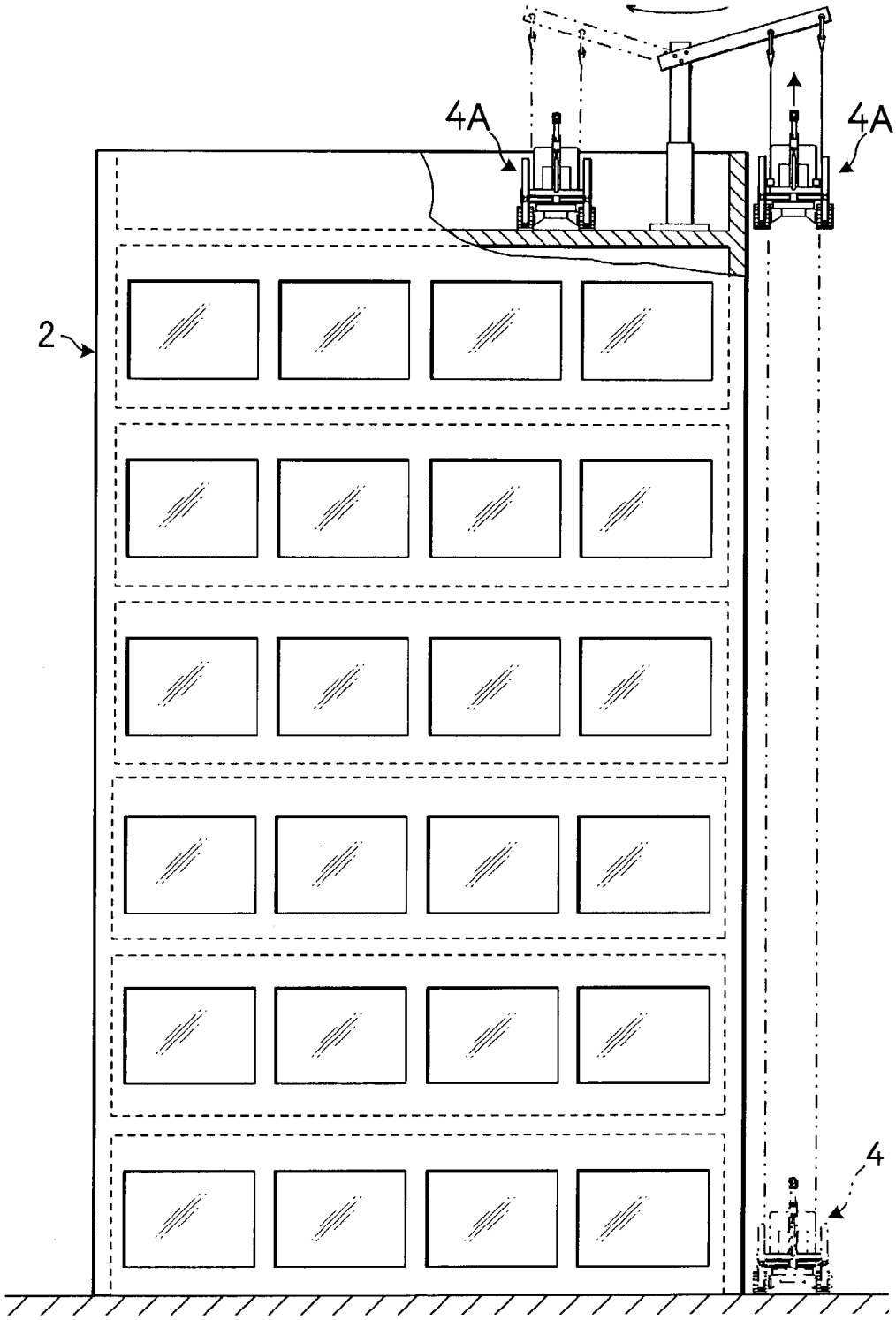
FIG. 18 is an explanatory view for moving a scrapping machine.
Figure 19:
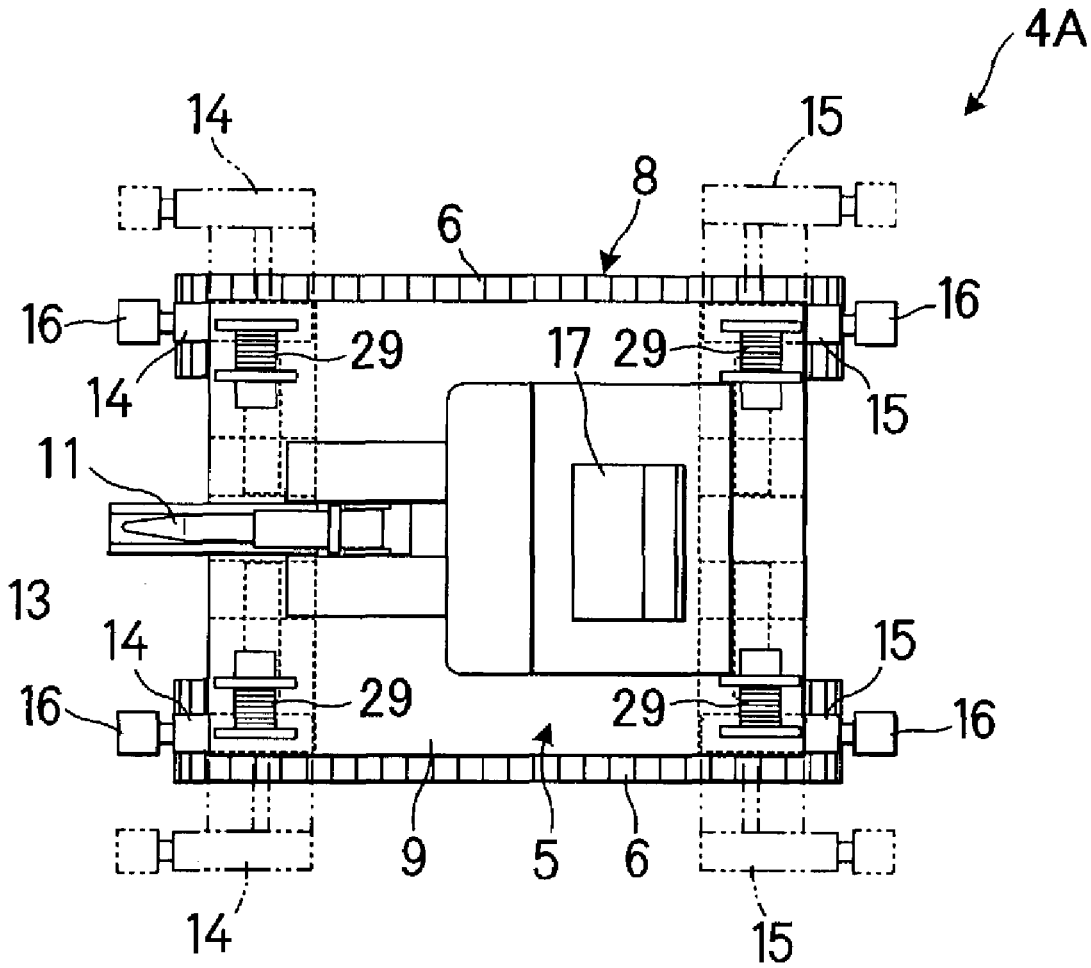
FIG. 19 is a top view of a scrapping machine.

A four embodiment of the present invention is shown in FIGS. 17–19. It is distinguished from the first embodiment in that a movement process 1B is performed. In this process 1B, a scrapping machine 4A is attached winches 29 at forward-, backward-, left- and right portions thereof, and it moves to the roof part of the building 2 by the winches 29. A scrapping method with the movement process 1B according to the fourth embodiment may be operated.

In addition, the scrapping machine 4A may be lifted up using the crane installed in the roof.

Figure 20:
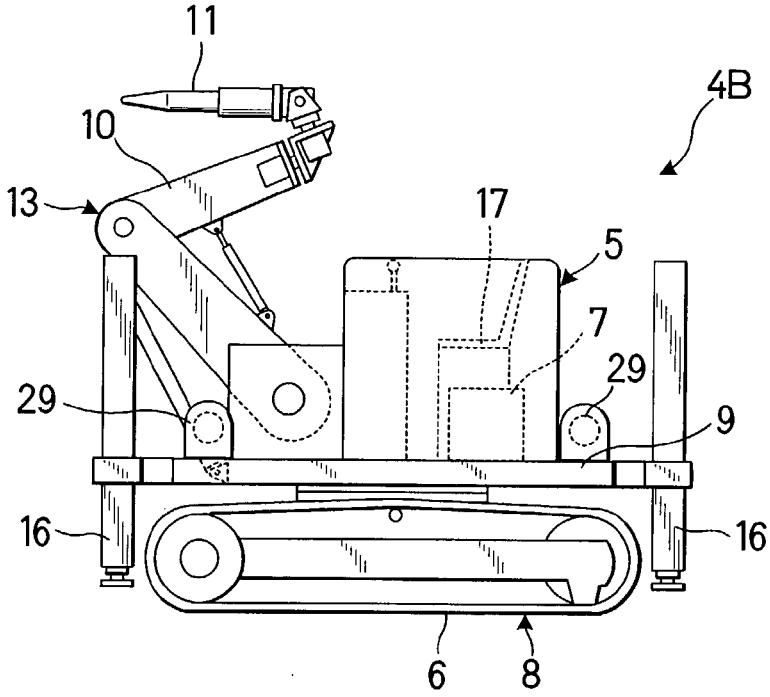
FIG. 20 is a side view of a scrapping machine showing a fifth embodiment of the present invention.
Figure 21:
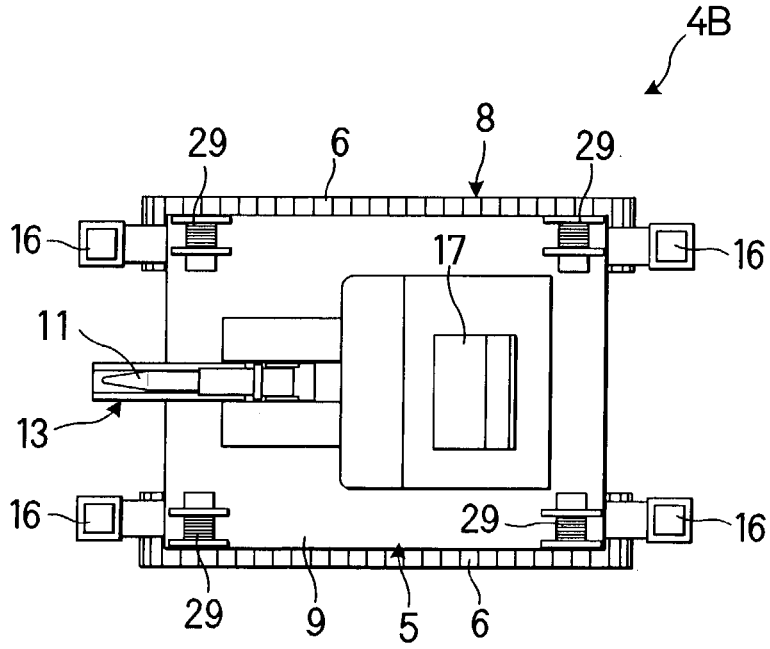
FIG. 21 is a top view of a scrapping machine.
Figure 22:
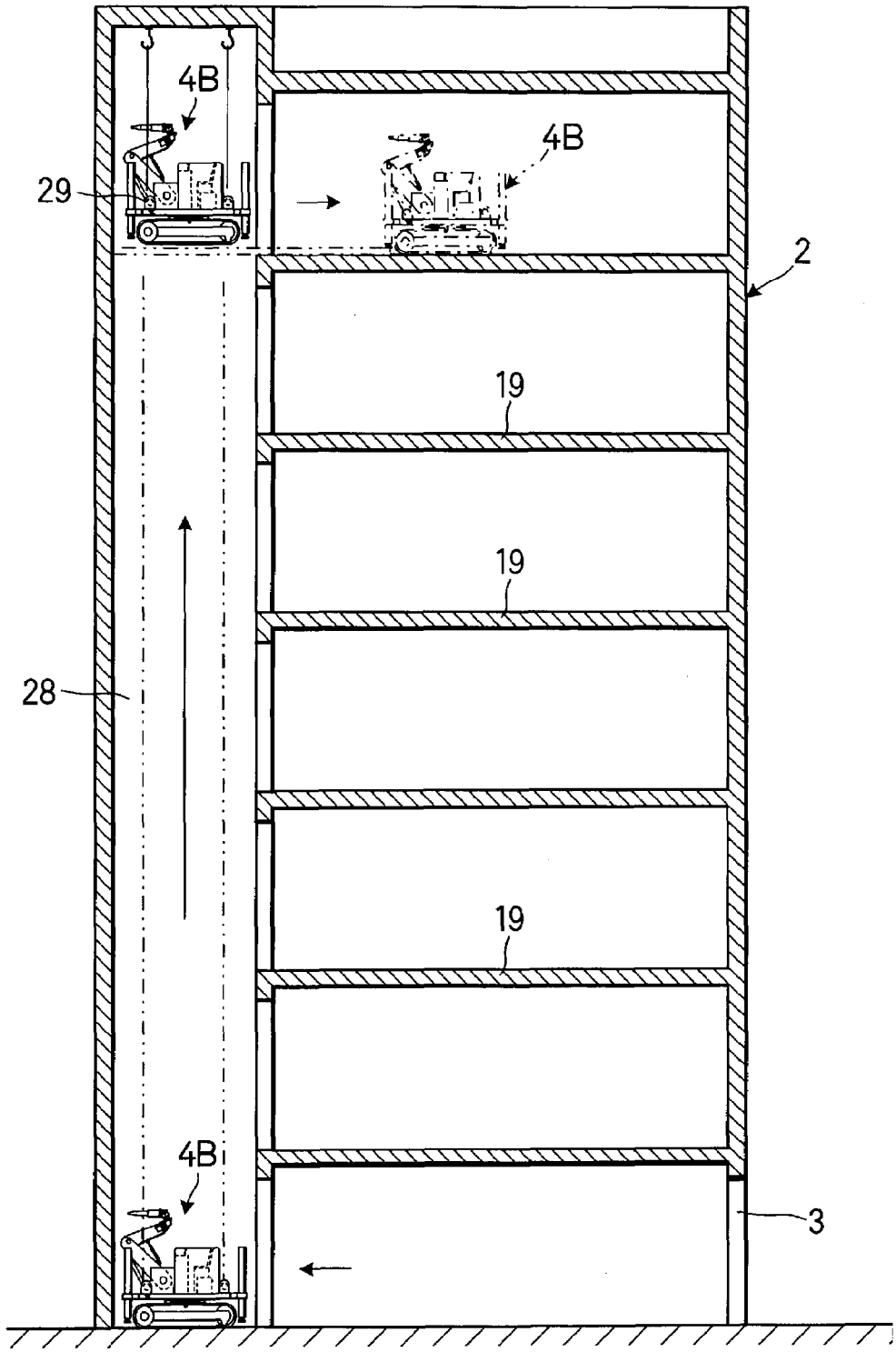
FIG. 22 is an explanatory view for moving a scrapping machine.

A fifth embodiment of the present invention is shown in FIGS. 20–22. It is distinguished from the first embodiment in that the extensible legs 16 using four hydraulic cylinders are attached to forward-, backward-, left- and right portions of the body 5 or the base 9 of the body 5, capable of working with vertical movement, and winches 29 are attached to forward-, backward-, left- and right portions to the base 9. A scrapping machine 4B can move through the hole 28 and move to a roof part easily from the outside of a building.

Figure 23:
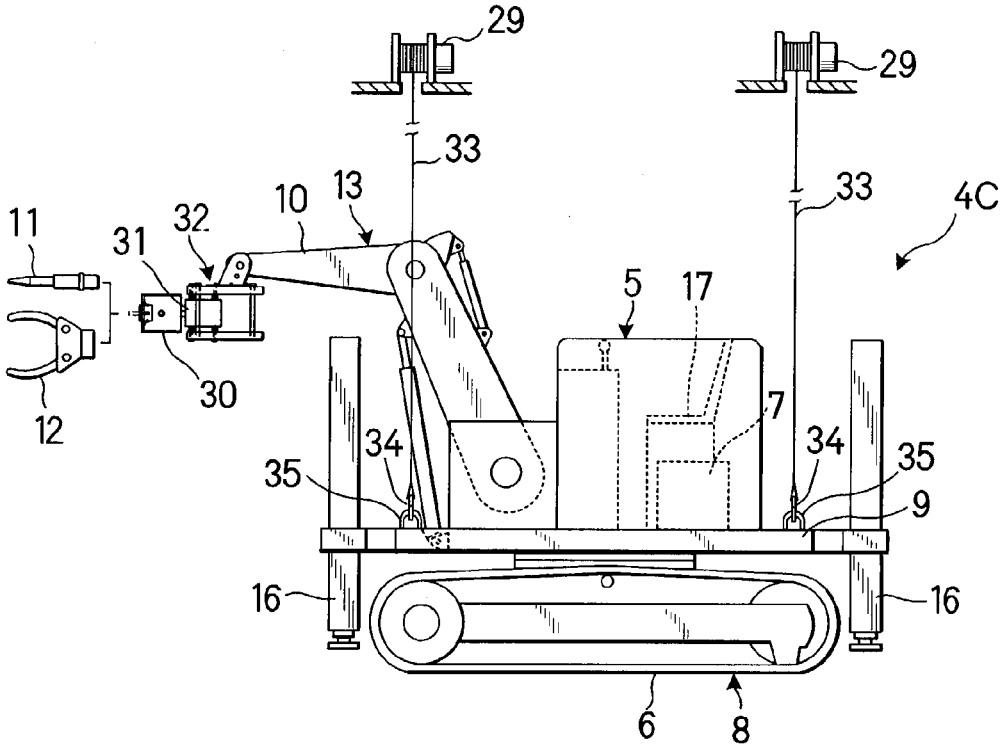
FIG. 23 is a side view of a scrapping machine showing a sixth embodiment of the present invention.
Figure 24:
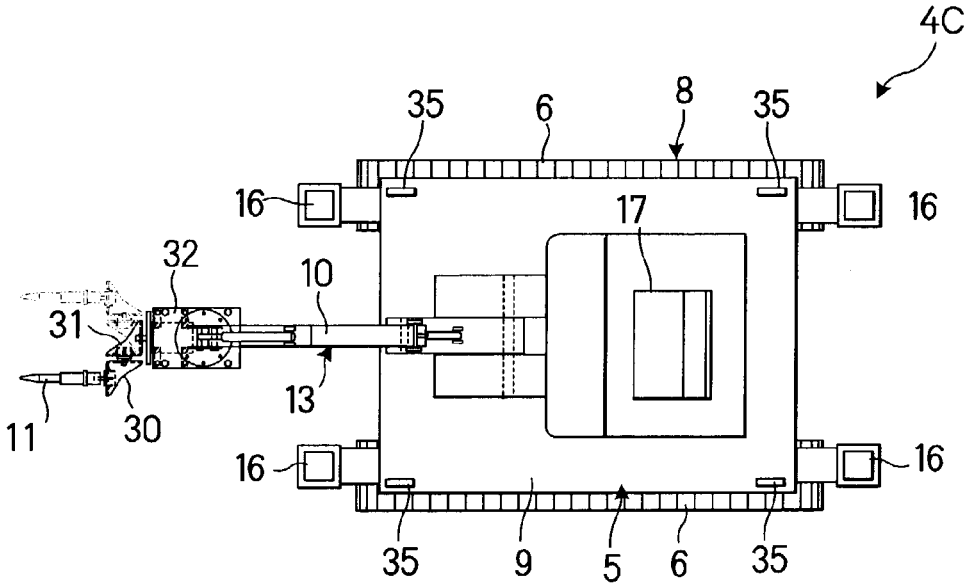
FIG. 24 is a top view of a scrapping machine.
Figure 25:
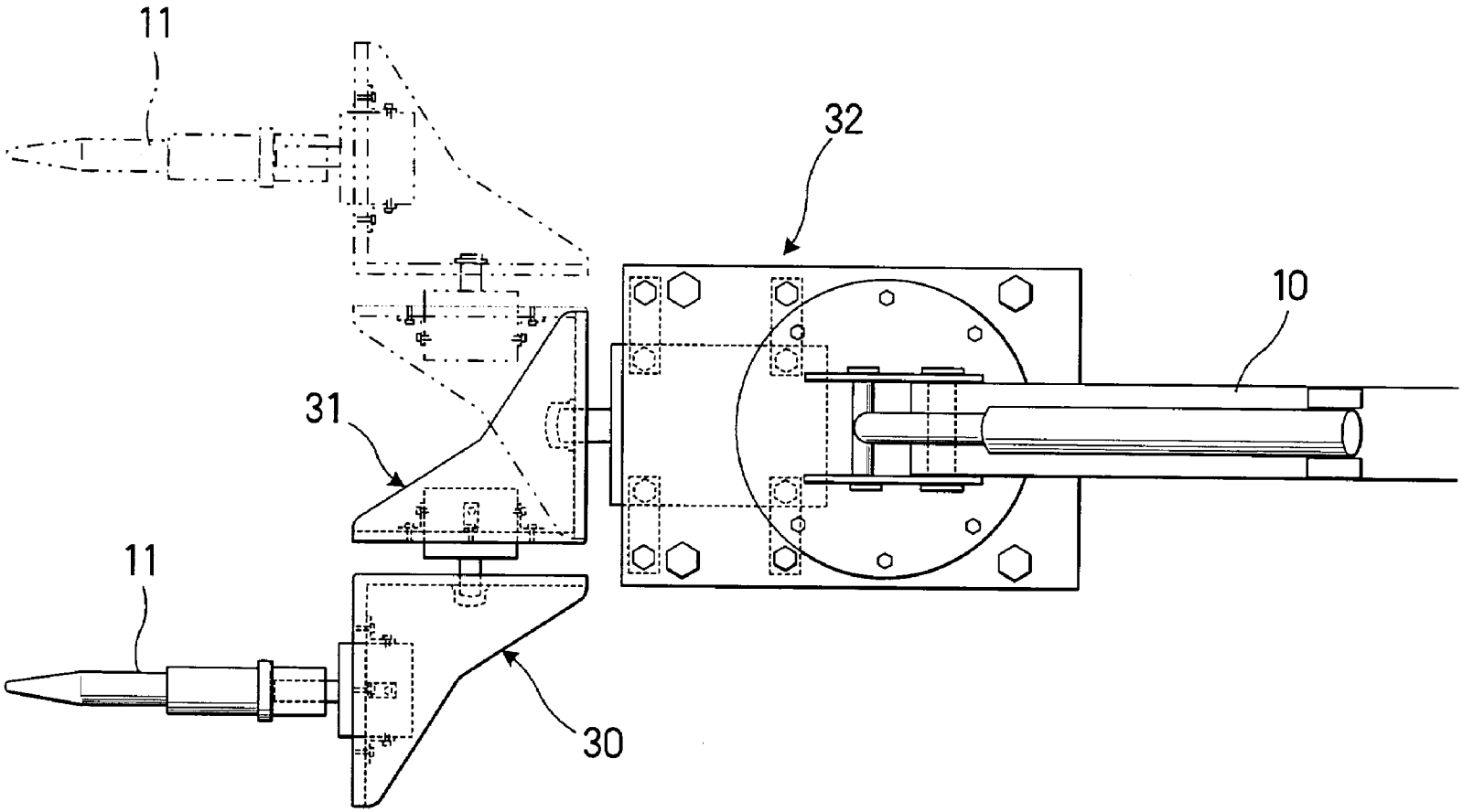
FIG. 25 is an explanatory view of a mount.

A sixth embodiment of the present invention is shown in FIGS. 23–25. It is distinguished from the first embodiment in that the breaker 11 and clasped crushing device 12 are attached to the tip portion of the drive arm 10 via a mount 32 interposed a horizontal rotatable mechanism 30 and a vertical rotatable mechanism 31, and four hooks 35 is attached to forward-, backward-, left- and right portions to the base 9, attaching to engage pieces 34 which are attached to tip portions of wires 33. A scrapping machine 4C according to the sixth embodiment has similar advantages to that according to the fifth embodiment.

Figure 26:
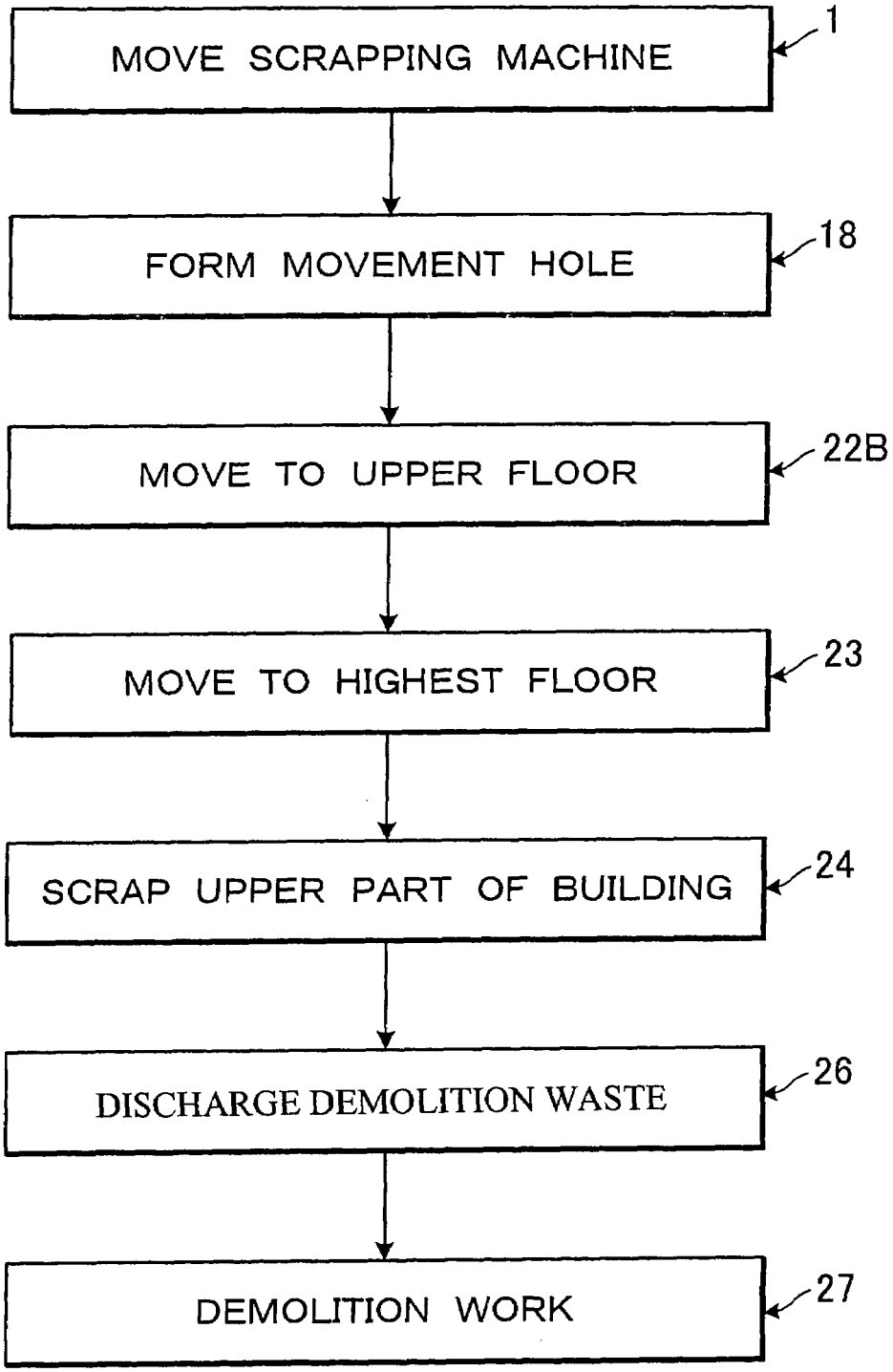
FIG. 26 is a flow showing a seventh embodiment of the present invention.
Figure 27:
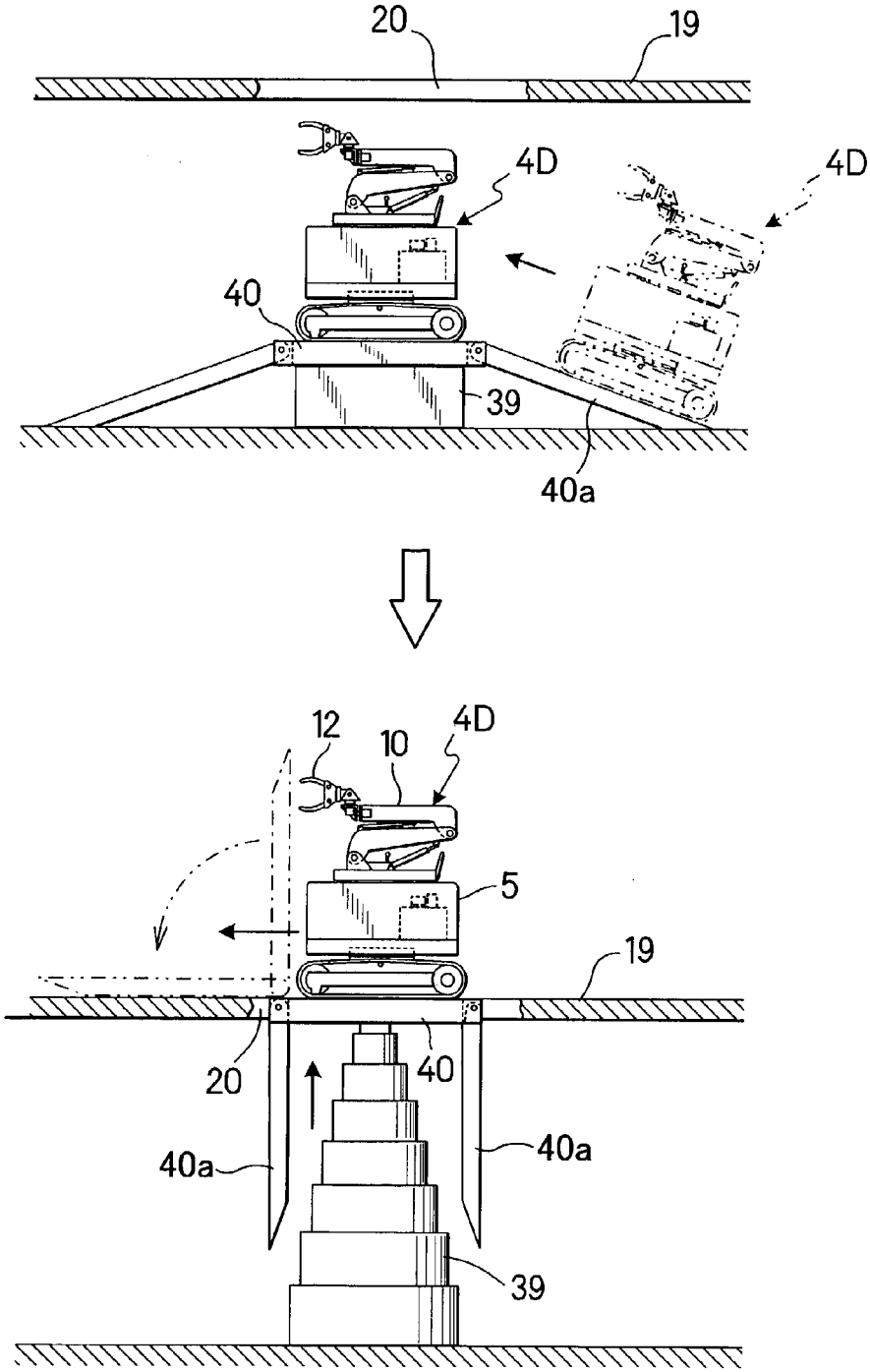
FIG. 27 is an explanatory view showing the way in which the scrapping machine moves to an upper floor.
Figure 28:
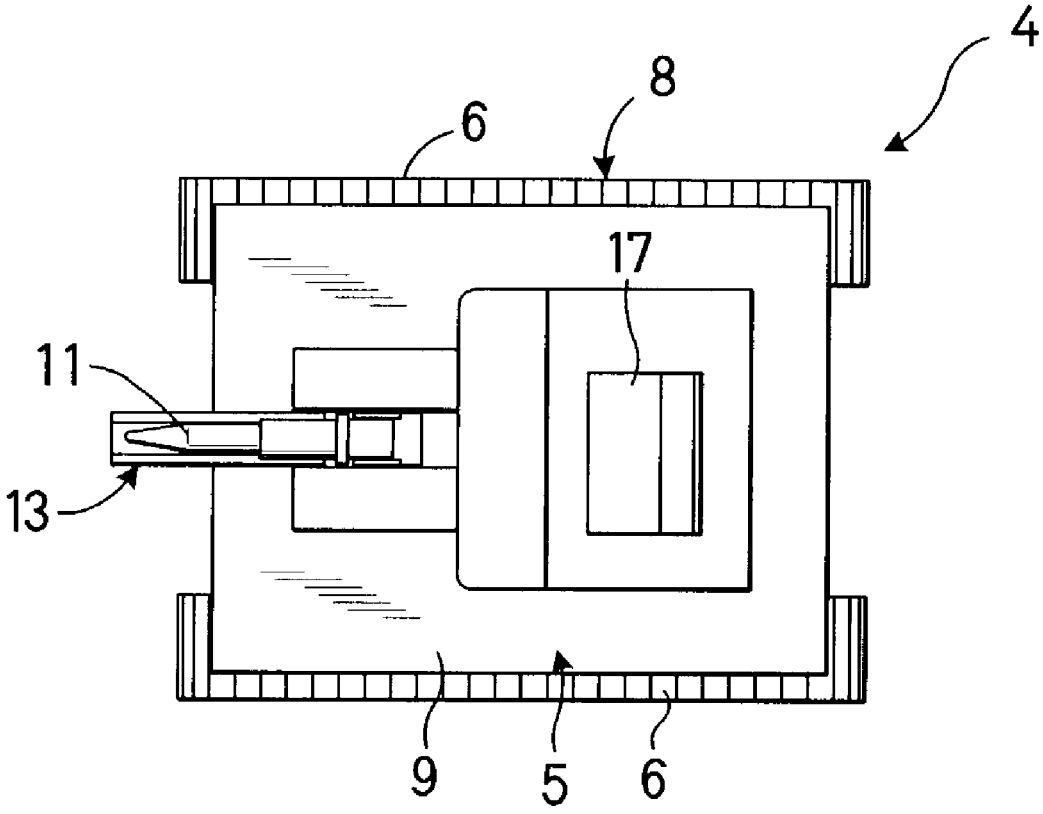
FIG. 28 is a top view of a scrapping machine.

A seventh embodiment of the present invention is shown in FIGS. 26–28. It is distinguished from the first embodiment in that a scrapping machine 4D which is not installing the extensible leg in the d-, backward-, left- and right portions of the base 9 can move to an upper directions, and the scrapping machine 4D includes a extensible stand 40, capable of lifting the end portion thereof by a hydraulic cylinder 39, having guide plates 40*a* pivotably attached to both ends thereof. A scrapping method with movement process 22B to the upper floor for a scrapping machine 4D may be operated.

In addition, a guide plate 40*a* may be used at one end part of the extensible stand 40. In this case, when the scrapping machine 4 is located on the extensible stand 40, it may run on the floor part of the upper floor after the guide plate 40*a* rotates to an upper direction and raises, and it is located on the upper floor.

Figure 29:
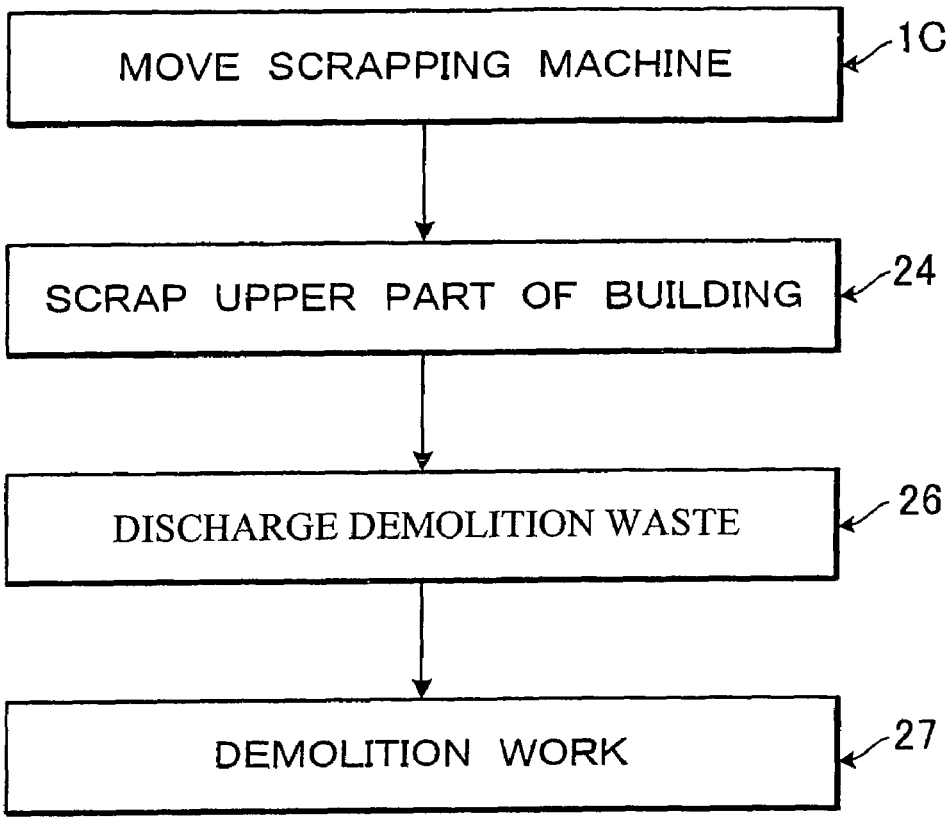
FIG. 29 is a flow showing an eighth embodiment of the present invention.
Figure 30:
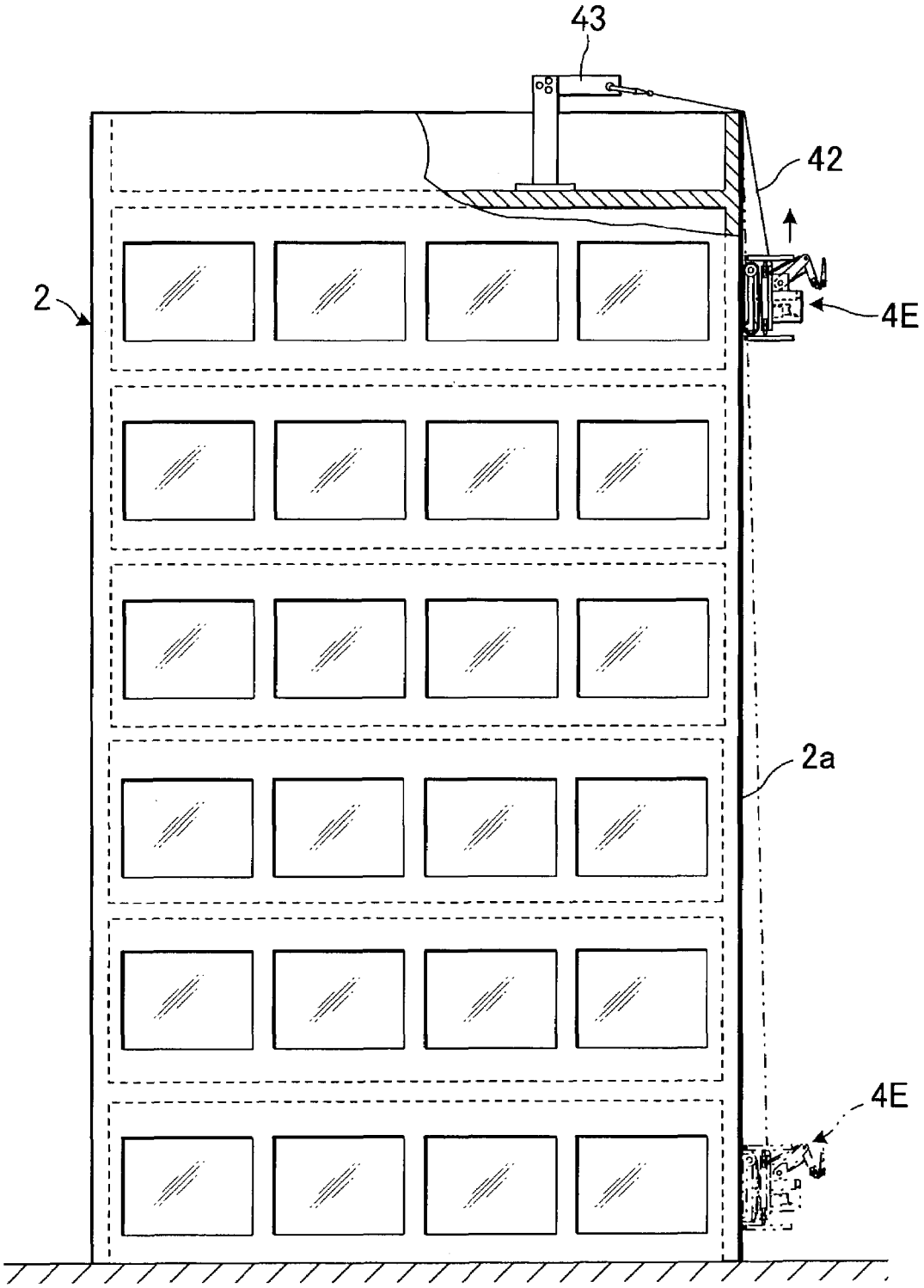
FIG. 30 is an explanatory view showing the way in which the scrapping machine moves to an upper floor.
Figure 31:
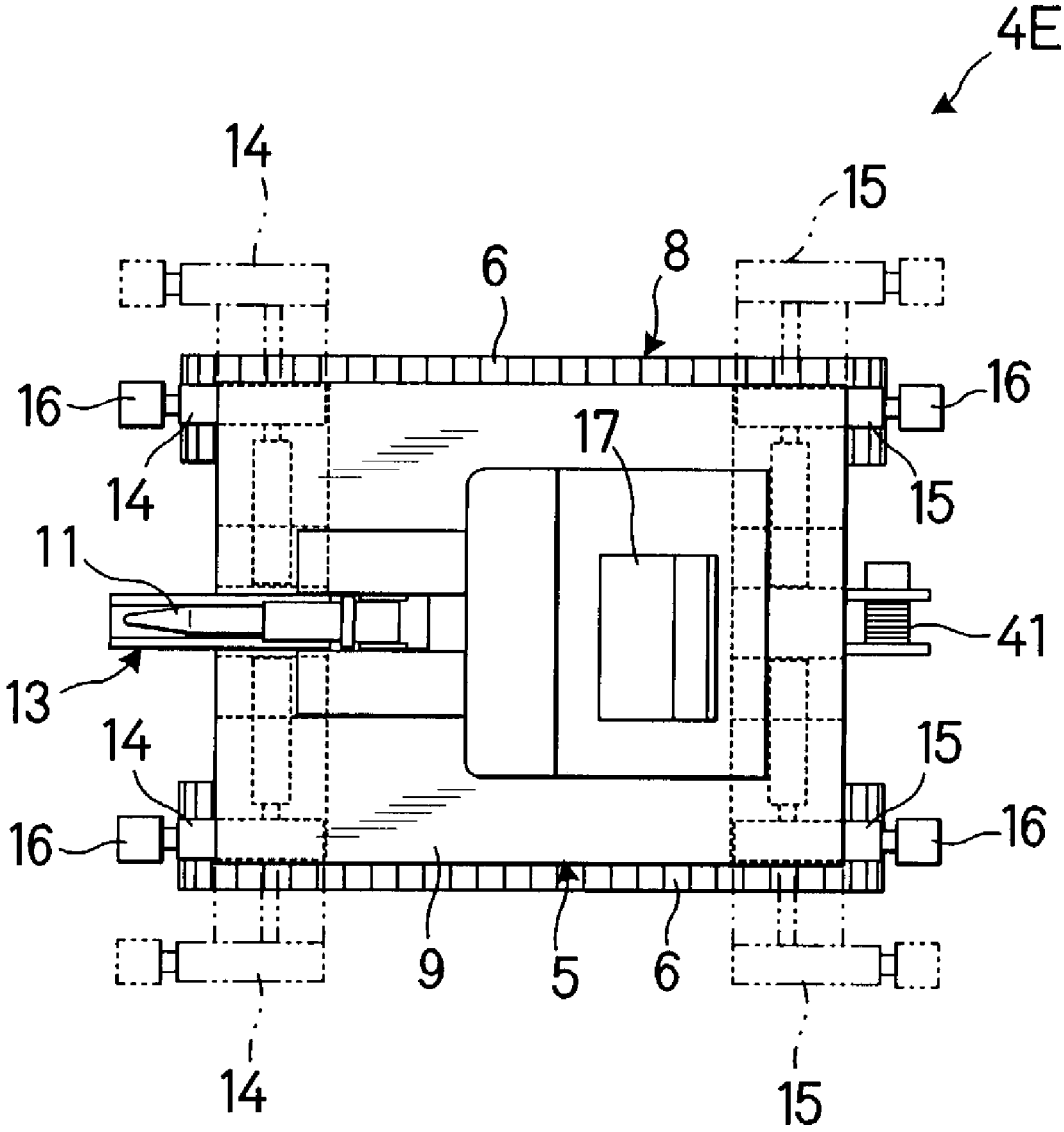
FIG. 31 is a top view of a scrapping machine.

An eighth embodiment of the present invention is shown in FIGS. 29–31. It is distinguished from the first embodiment in that a movement process 1C is performed. A scrapping machine 4E is installed a winch 41. A wire 42 of the winch 41 of scrapping machine 4E is fixed to a building body via a tip part of an arm 43 installed in an upper part of the disassembled building 2. Then the wire 42 is wound by the winch 41. After that, the scrapping machine 4E runs on the outer wall of the building 2, and it moves to the roof part.

A scrapping method with movement process 1C by a scrapping machine 4E may be operated.

In addition, in this embodiment, the winch 41 is attached to the upper portion of the building, and the wire 42 can move slidably via a pulley attached to the tip portion of the arm 43.

Figure 32:
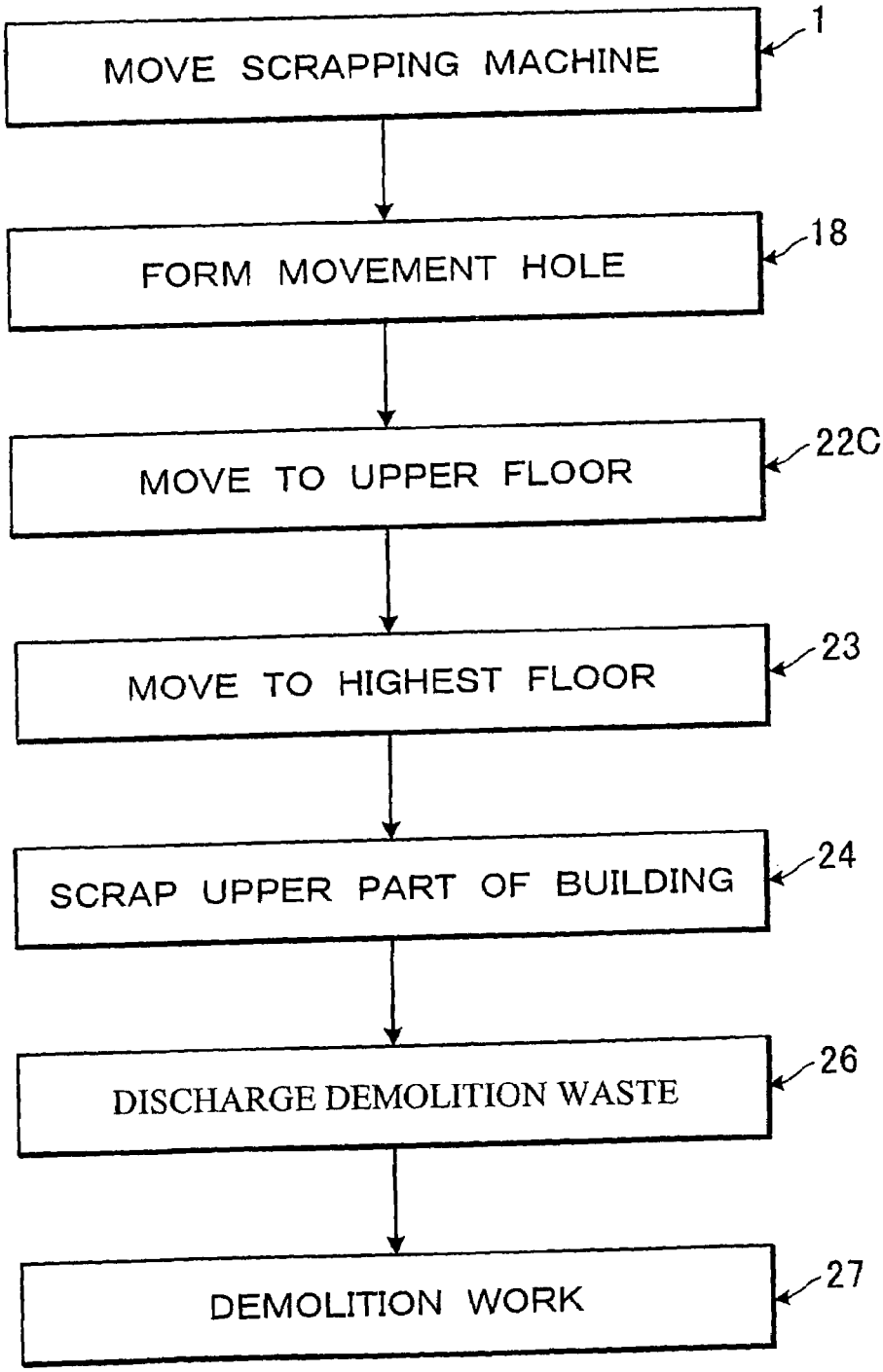
FIG. 32 is a flow showing a ninth embodiment of the present invention.
Figure 33:
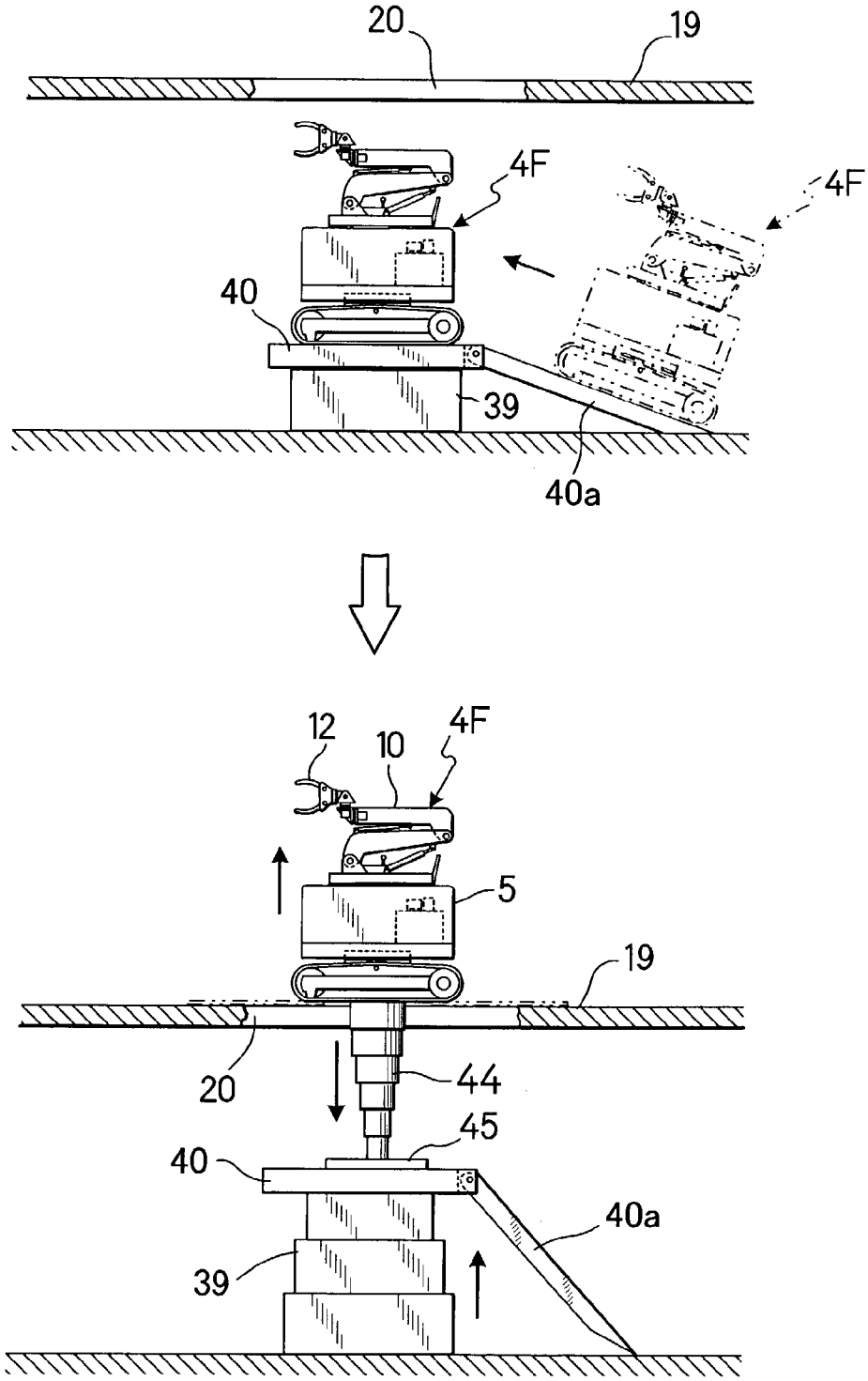
FIG. 33 is an explanatory view showing the way in which the scrapping machine moves to an upper floor.
Figure 34:
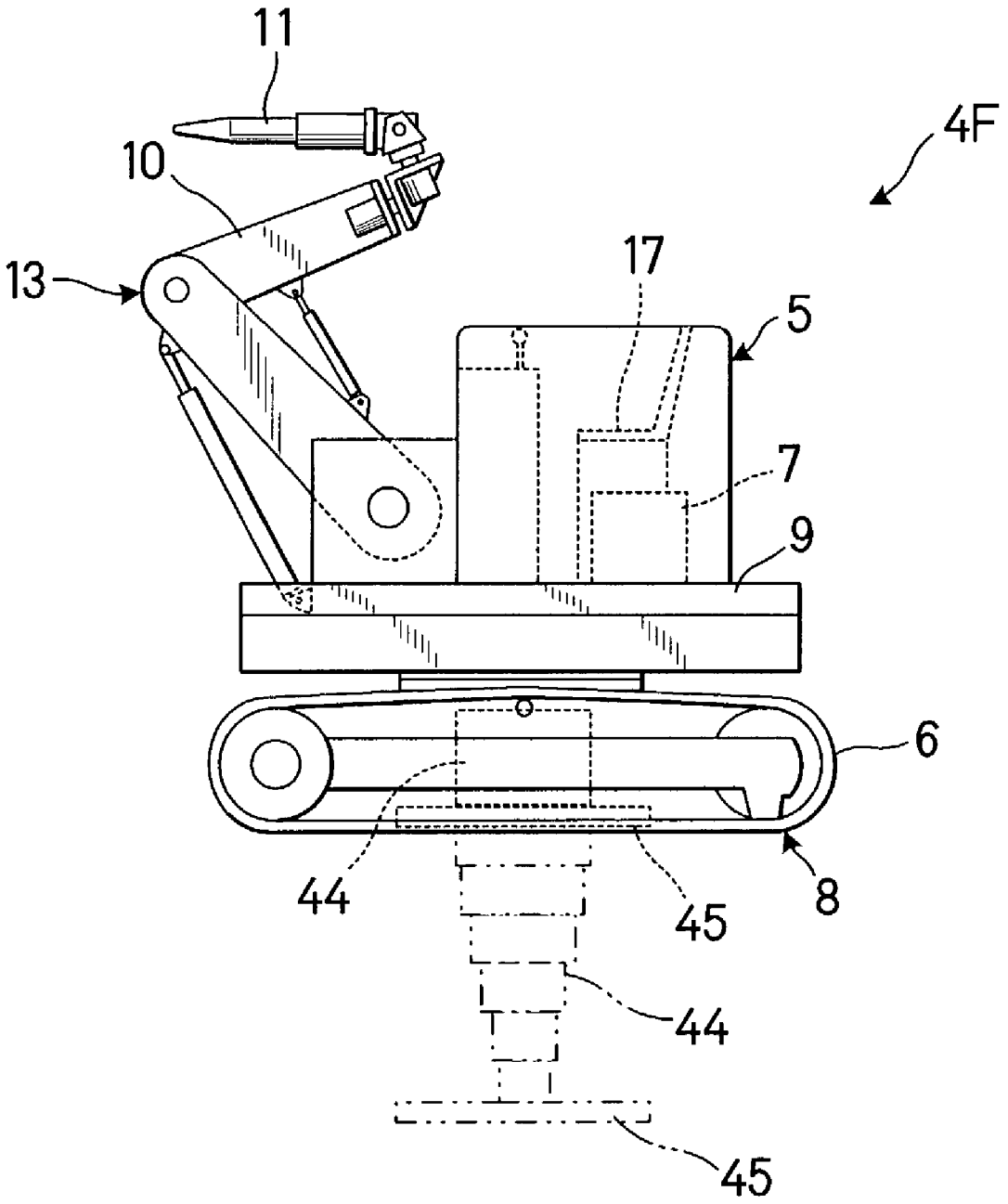
FIG. 34 is a side view of a scrapping machine.
Figure 35:
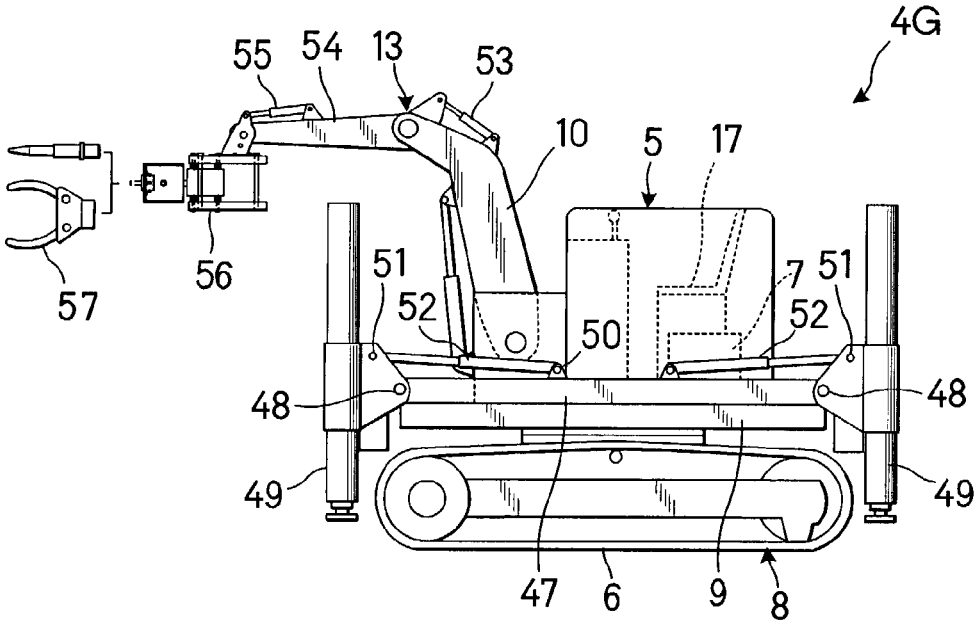
FIG. 35 is a side view showing a tenth embodiment of the present invention.
Figure 36:
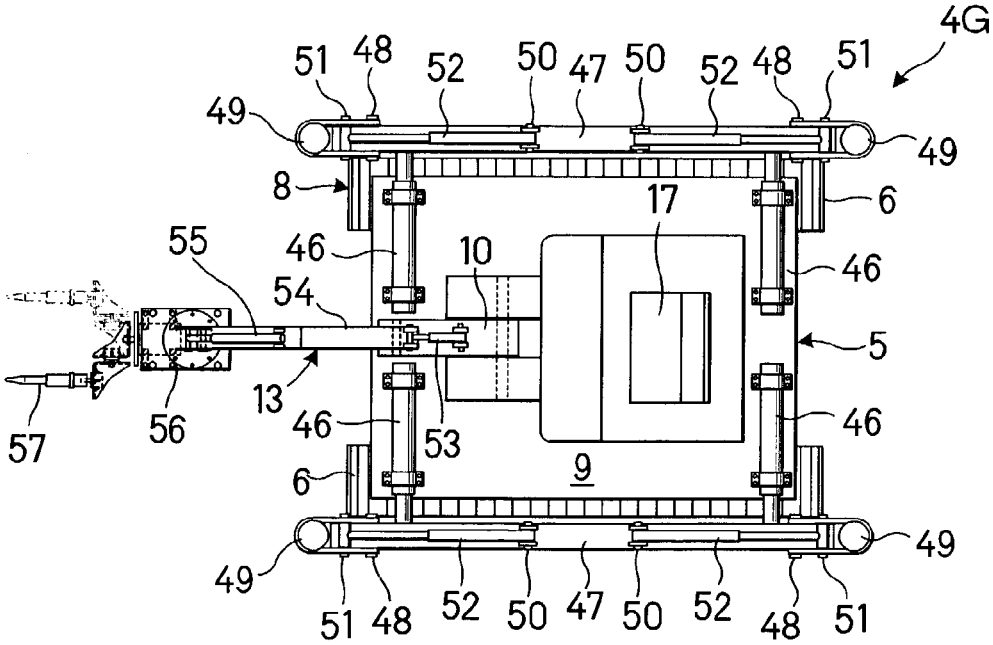
FIG. 36 is a top view.
Figure 37:
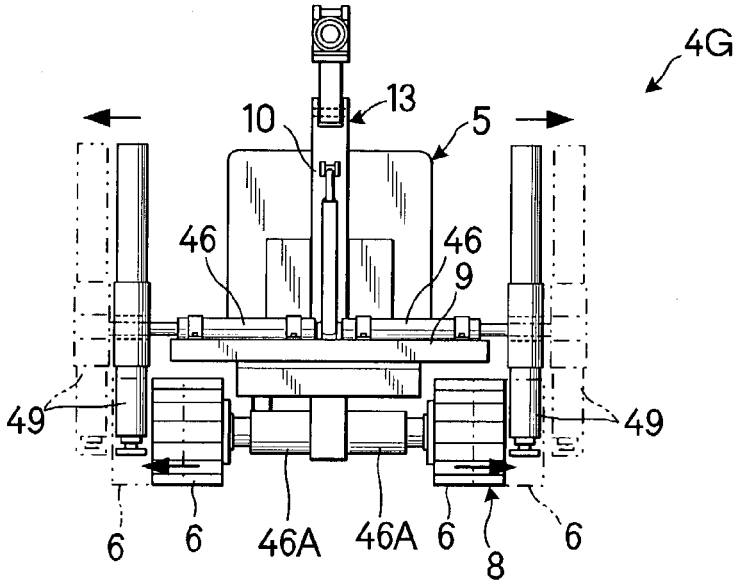
FIG. 37 is a front view.
Figure 38:
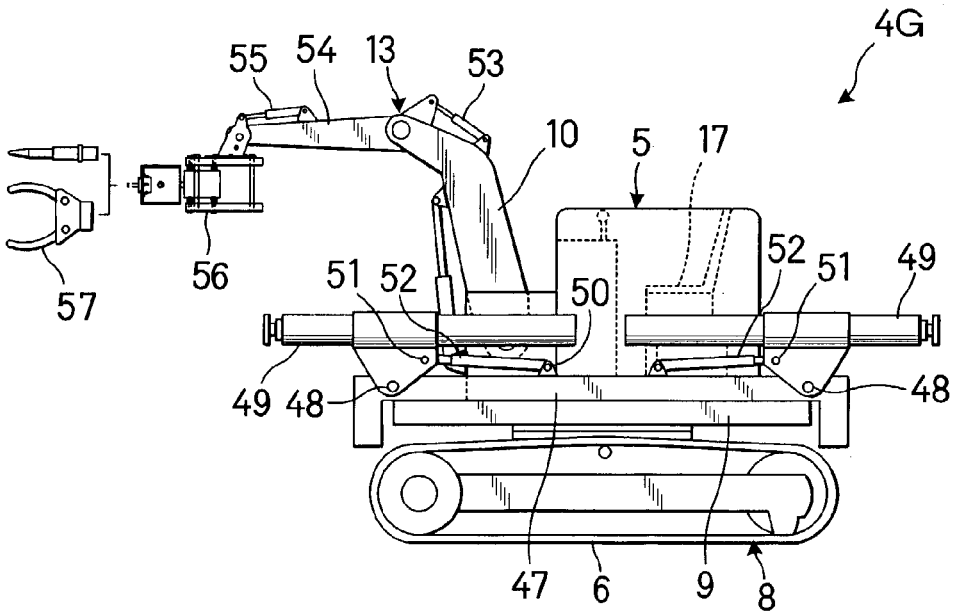
FIG. 38 is an explanatory view showing the way in which extensible legs are stored.
Figure 39:
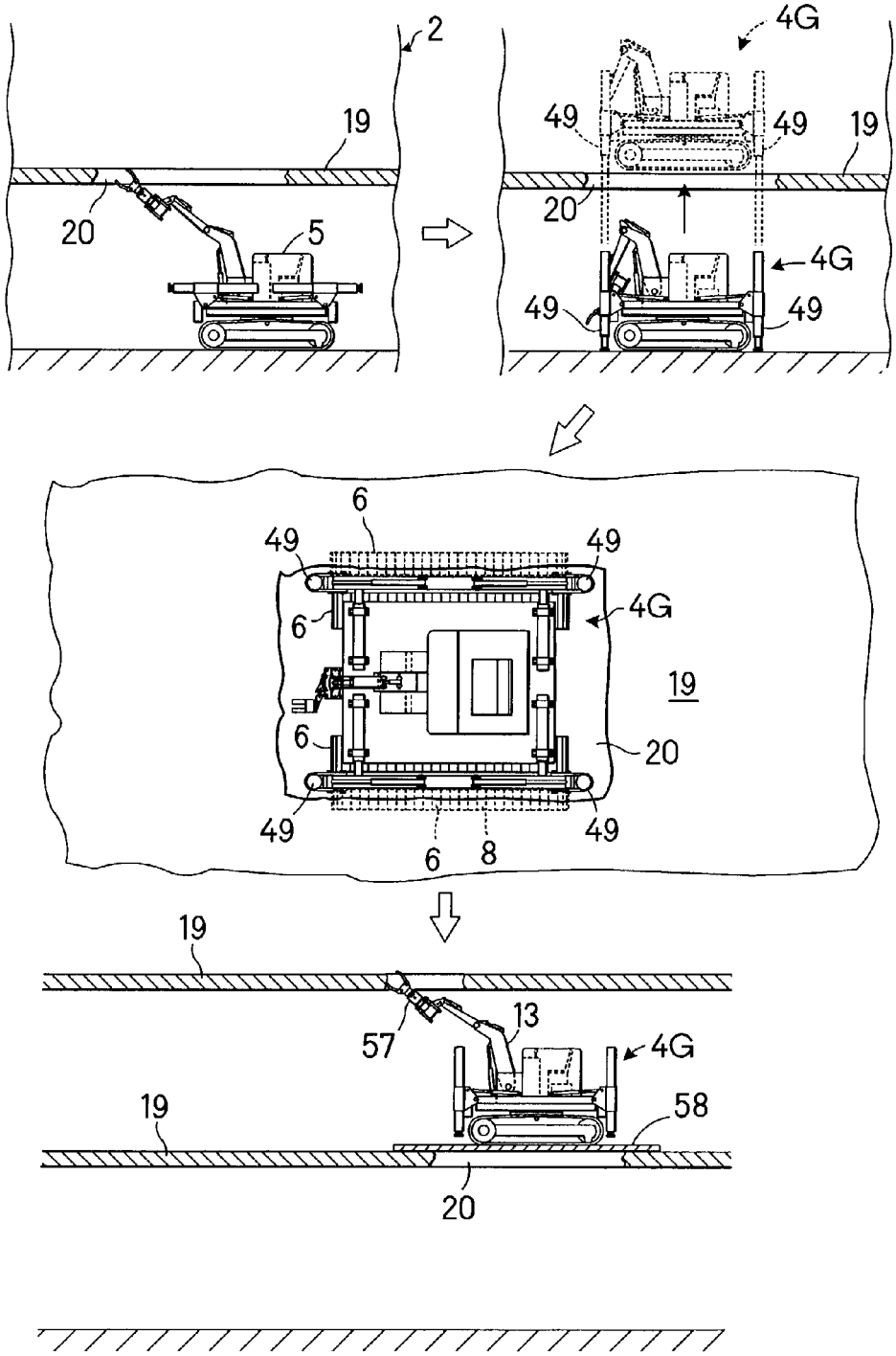
FIG. 39 is an explanatory view showing the way in which the scrapping machine moves to an upper floor.

A ninth embodiment of the present invention is shown in FIGS. 32–34. It is distinguished from the first embodiment in that a scrapping machine 4F has a support stand 45 with a hydraulic cylinder 44 which projects under the body 5, the scrapping machine 4F moves up using the extensible stand 40 in a movement process 22C. A scrapping method with the movement process 22C to the upper floor by a scrapping machine 4F may be operated.

In this case, since the support stand 45 of the scrapping machine 4F can expand and contract, the extensible stand 40 with a small stroke of expansion and contraction can be used.

A tenth embodiment of the present invention is shown in FIGS. 35–39. It is distinguished from the fifth embodiment in that a scrapping machine 4G has the caterpillars 6 attached to the body 5 via two pairs of hydraulic cylinders 46A, as a movement device for caterpillar, so as to project at a voluntary length and further comprises left and right of support members 47 for extensible legs which is formed in the shape of a bar; extensible legs 49; hydraulic cylinders 52 for storing the extensible legs; a pivotable boom 54; an attachment 56; and a crushing machine 57.

The support members 47 are attached projectably to left and right sides of the upper portion rather than the top end portion of the body 5 by the hydraulic cylinders 46, projecting to an outer direction rather than front and back ends of the caterpillars 6.

The extensible legs 49 are supported pivotably by pivot pins 48 to the front and back ends of the support members 47, having the hydraulic cylinders which is positioned the lower portion thereof located above the lower end portion of the caterpillars 6 in a standing and storing manner and positioned the lower portion of the caterpillars 6 located above the floor part 19 of the upper floor in a extending manner.

The hydraulic cylinders 52 store the extensible legs 49 on the support members 47 when in not use, one end thereof supported pivotably at a portion adjacent a center portion of the support members 47 by pivot pins 50, and another end thereof supported pivotably at the extensible legs 49 by pivot pins 51.

The pivotable boom 54 is attached pivotably to a tip portion of the drive arm 10 of the scrapping machine body 13 by the hydraulic cylinder 53 as the same as the conventional backhoe.

The attachment 56 is attached to a tip portion of the pivotable boom 54 so as to rotate by the hydraulic cylinder 55.

The crushing machine 57, such as, for example the breaker and clasped crushing device, is attached removably to the attachment 56.

In the scrapping machine 4G, the scrapping machine body 13 horizontally rotates, and the drive arm 10, pivotable boom 54, attachment 56, crushing machine 57 are operated. The extensible legs 49 stand by operating the hydraulic cylinders 52 after the movement hole 20 is formed on the floor part of the upper floor. After that, the extensible legs 49 are extended, and the lower portion of the caterpillars 6 are positioned above the floor part 19 of the upper floor.

Then the hydraulic cylinders 46 as the movement device for caterpillar are operated, and the caterpillars 6 moves to an outward direction so as to be supported at the floor part at both sides of the movement hole 20.

The extensible legs 49 extend, and the caterpillars 6 are supported on the floor part 19 of the upper floor.

Under this condition, after the movement hole 20 is formed at the floor part 19 of the next upper floor, the hydraulic cylinders 46 as a movement device for caterpillar is started to work, and the support members 47 project to the outer direction.

Next, after the extensible legs 49 expand, the lower parts of the extensible legs 49 touch, and the body 5 moves upwards a little. After that, the hydraulic cylinders 46 as the movement device for caterpillar are operated, and the caterpillars 6 are stored, and then the extensible legs 49 are expanded further, and the lower ends of the caterpillars 6 locate on the floor part 19 of the upper floor. Therefore, the scrapping machine 4G moves upward one by one.

In addition, when support plates 58 are used to support the extensible legs 49, it can cover a part of the movement hole 20 located at the extensible legs 49 when in movement to the upper floor.

Figure 40:
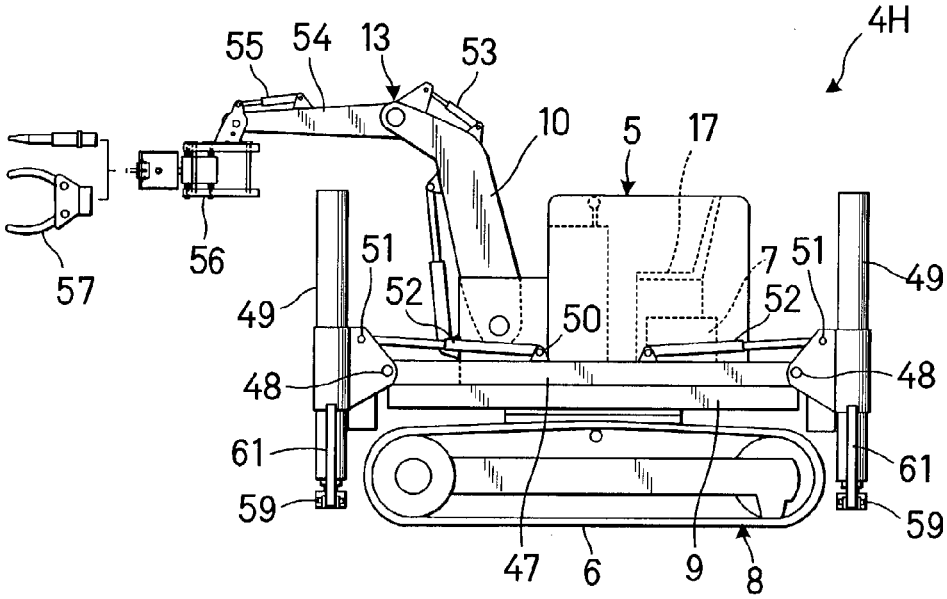
FIG. 40 is a side view showing an eleventh embodiment of the present invention.
Figure 41:
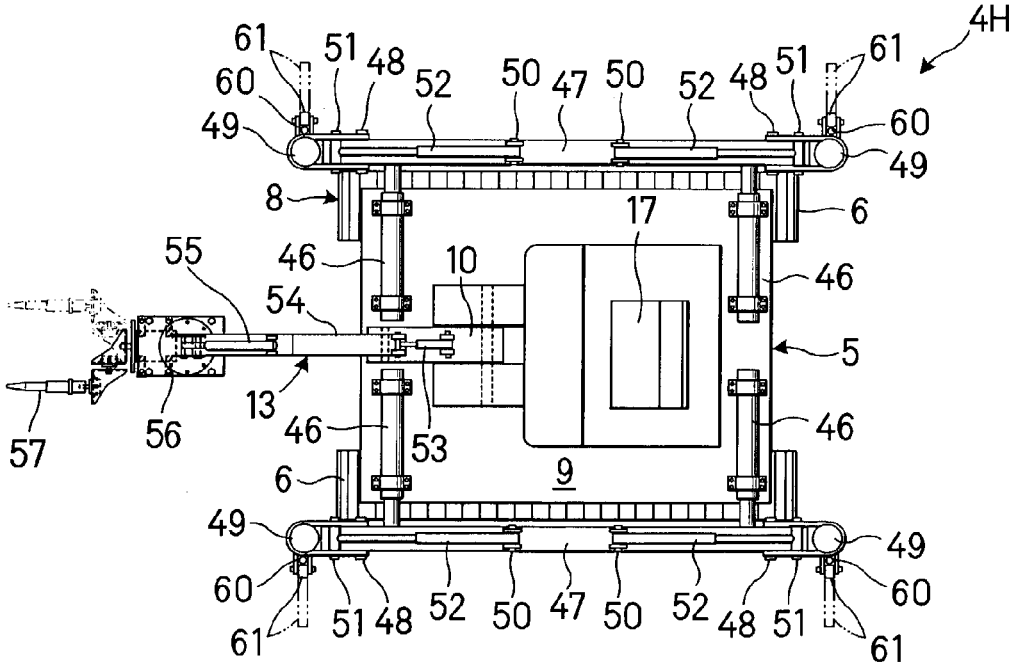
FIG. 41 is a top view.
Figure 42:
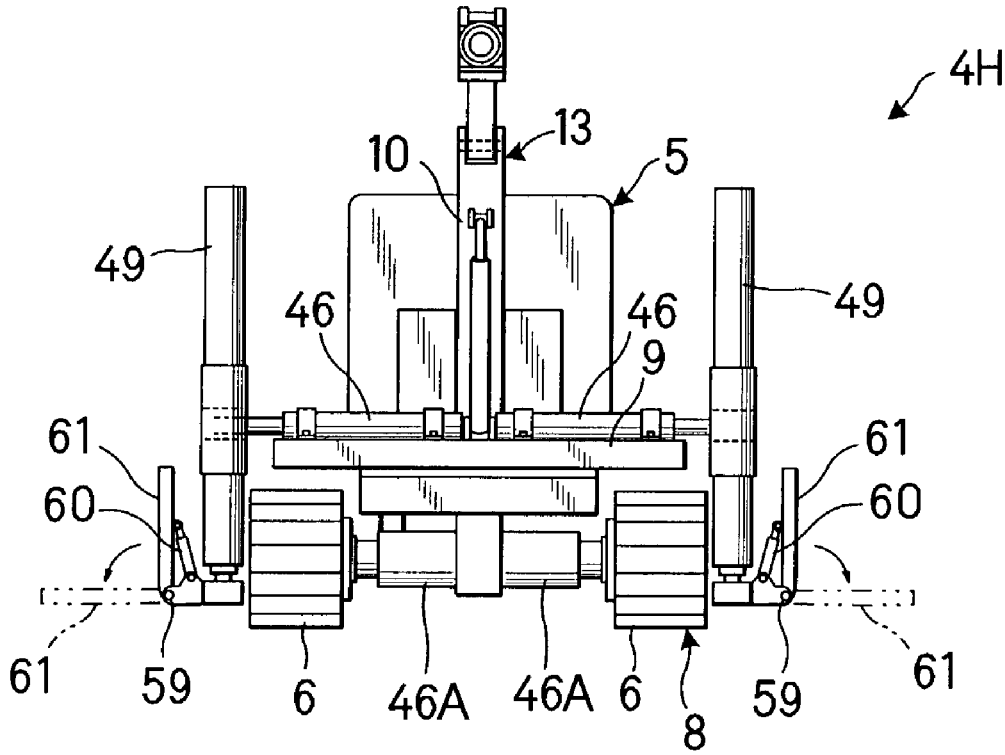
FIG. 42 is a front view.

An eleventh embodiment of the present invention is shown in FIGS. 40–42. It is distinguished from the tenth embodiment in that back ends of leg pieces 61 are pivoted the lower end of the extensible legs 49 by the pivot pins 59, storing along the extensible legs 49 when in not use, operating by the hydraulic cylinders 60 so as to project to an outward direction when in use. A scrapping machine 4H with the leg pieces 61according to the eleventh embodiment has similar advantages to that according to the tenth embodiment, and the leg pieces 61 can be stored and projected so that the scrapping machine 4H can be supported by the leg pieces 61 which supports around the movement hole 20 of the floor part 19 each floor and moves without the support plate.

Figure 43:
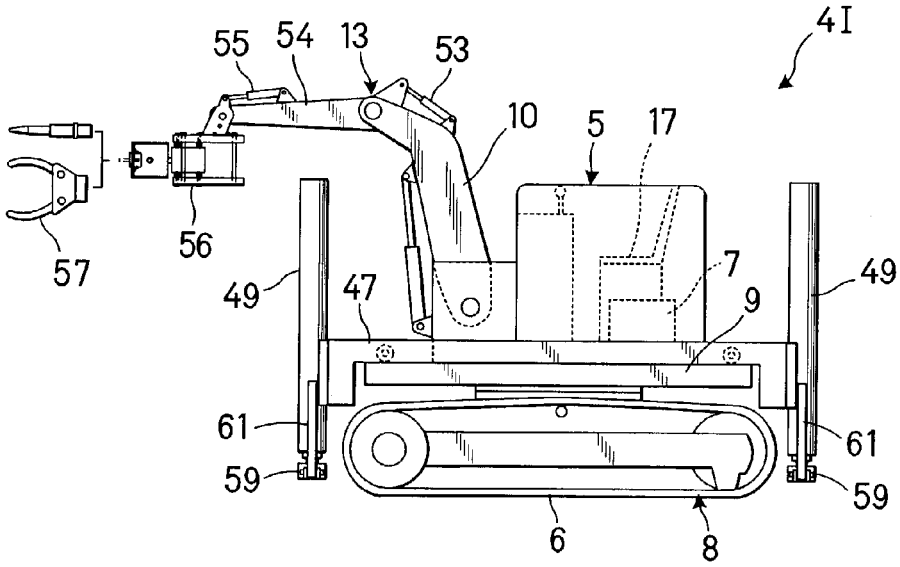
FIG. 43 is a side view showing a twelfth embodiment of the present invention.
Figure 44:
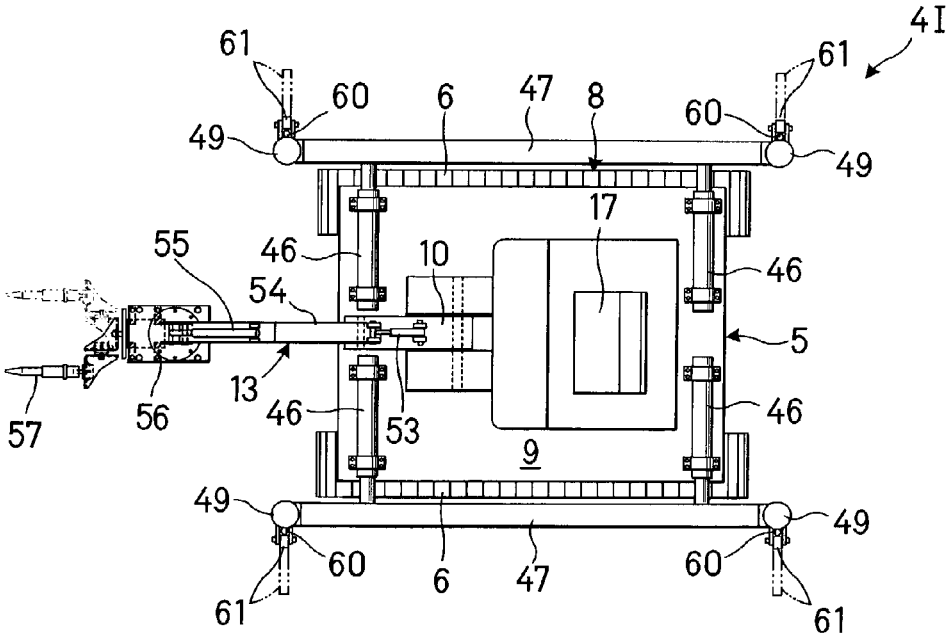
FIG. 44 is a top view.
Figure 45:
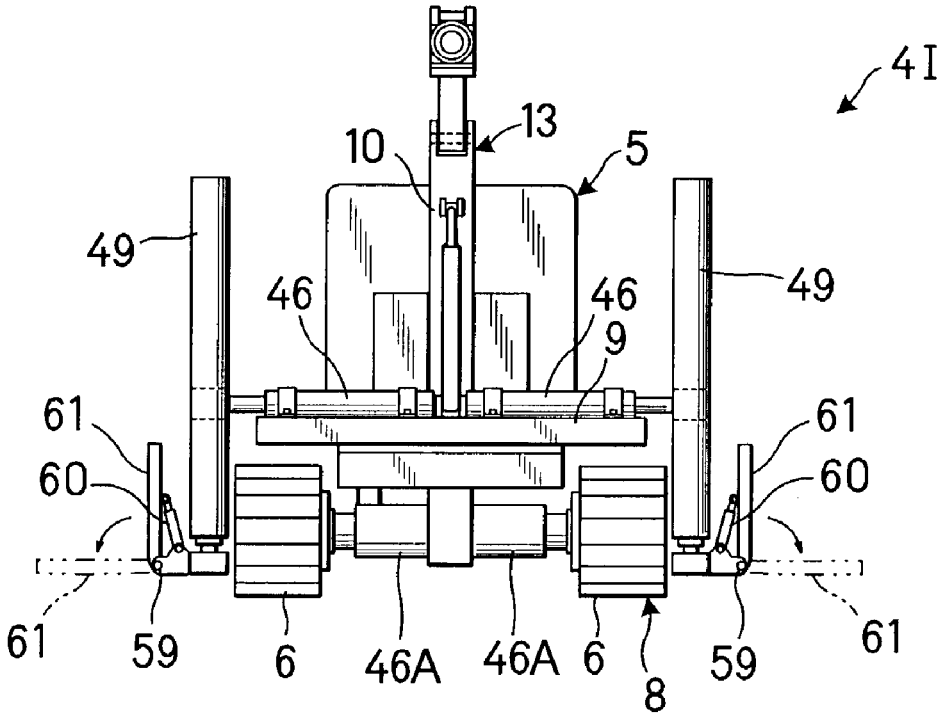
FIG. 45 is a front view.

A twelfth embodiment of the present invention is shown in FIGS. 43–45. It is distinguished from the first embodiment in that the extensible legs 49 located at forward-, backward-, left- and right portions are attached fixedly at forward- and backward ends of the support members 47.

A scrapping machine 41 according to the twelfth embodiment has similar advantages to that according to the eleventh embodiment.

Figure 46:
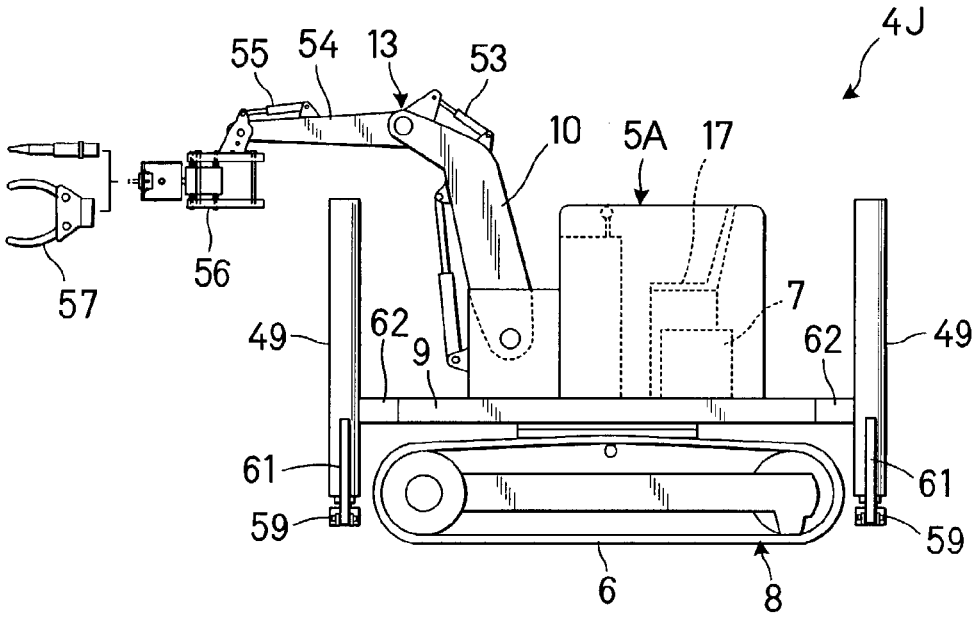
FIG. 46 is a side view showing a thirteenth embodiment of the present invention.
Figure 47:
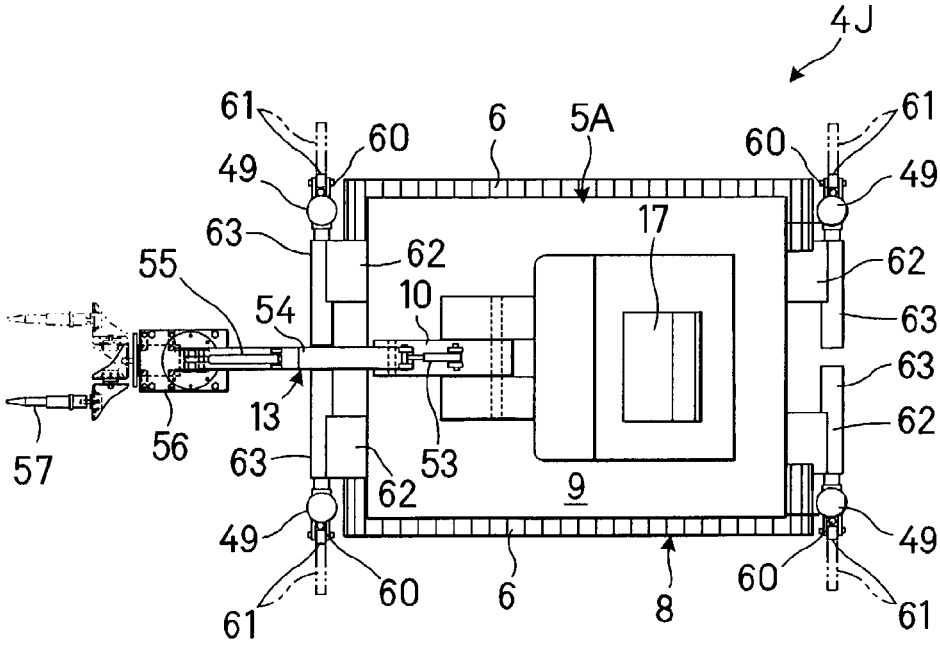
FIG. 47 is a top view.
Figure 48:
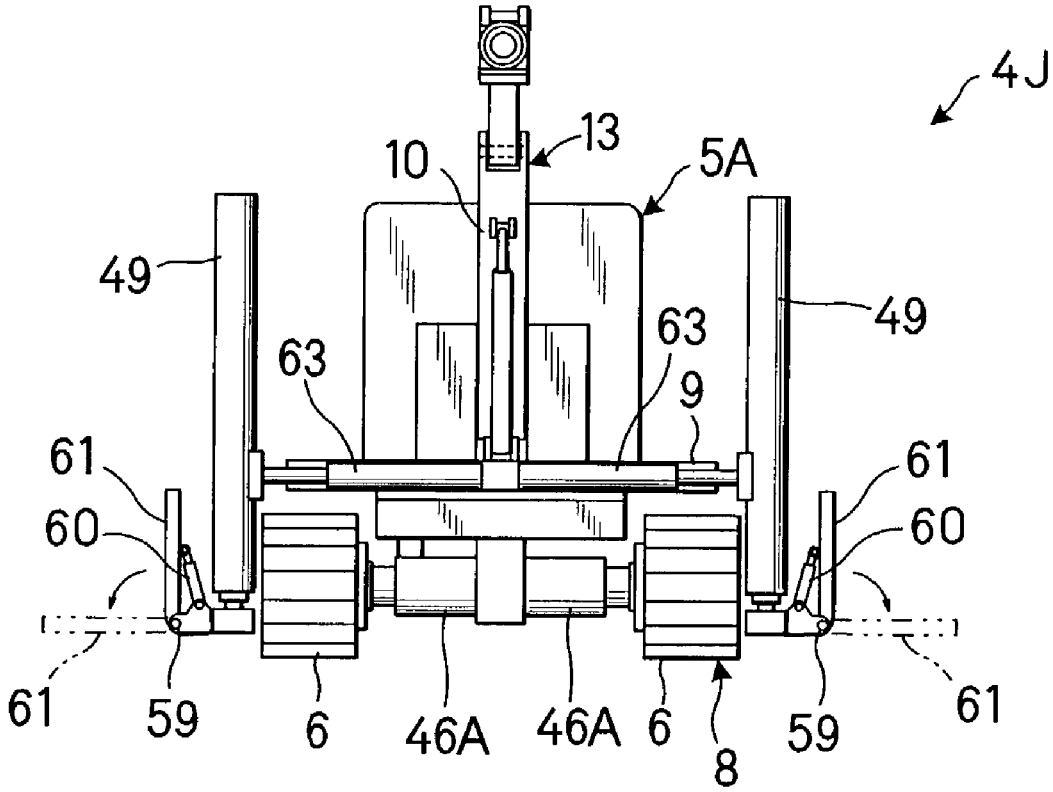
FIG. 48 is a front view.

A thirteenth embodiment of the present invention is shown in FIGS. 46–48. It is distinguished from the twelfth embodiment in that a scrapping machine 4J further includes a body 5A having attachments 62 for support members of the extensible legs, positioning above the upper end portion of the caterpillars 6 and outside the front and back ends of the caterpillars 6; hydraulic cylinders 63 as the support members of the extensible legs, projecting to an outer direction to the attachments 62; and the extensible legs 49 at forward-, backward-, left- and right parts fixed to a tip portion of the hydraulic cylinders 63. The scrapping machine 4J according to the thirteenth embodiment has similar advantages to that according to the twelfth embodiment.

Figure 49:
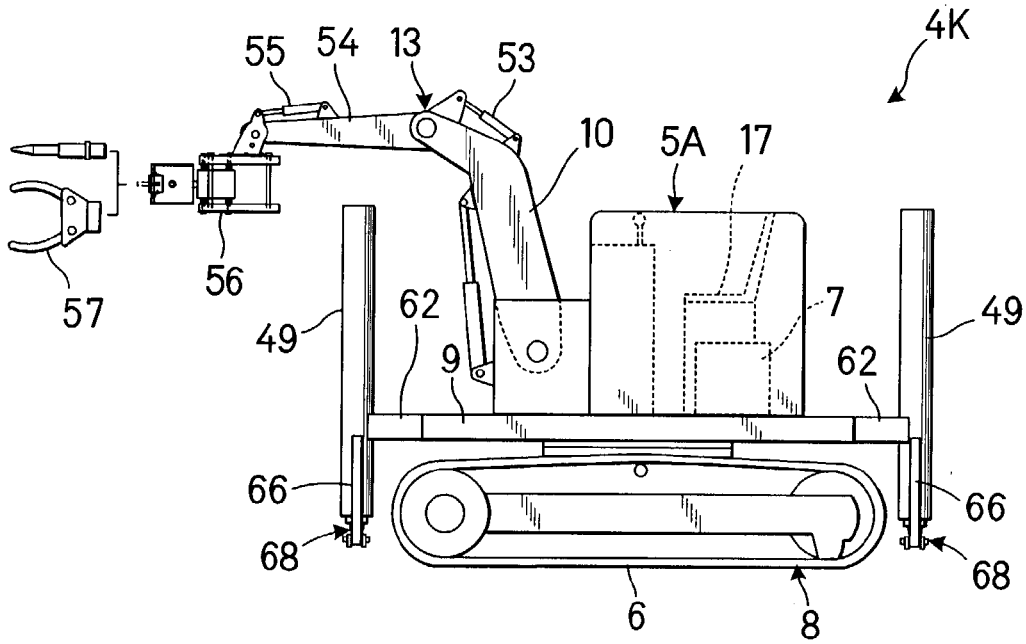
FIG. 49 is a side view showing a fourteenth embodiment of the present invention.
Figure 50:
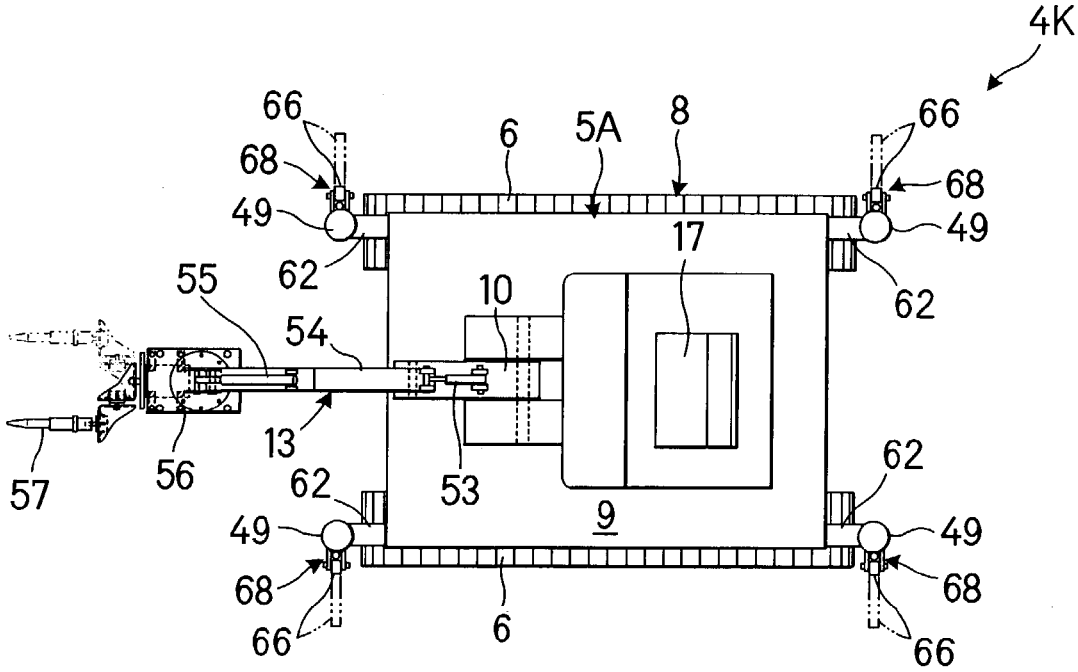
FIG. 50 is a top view.
Figure 51:
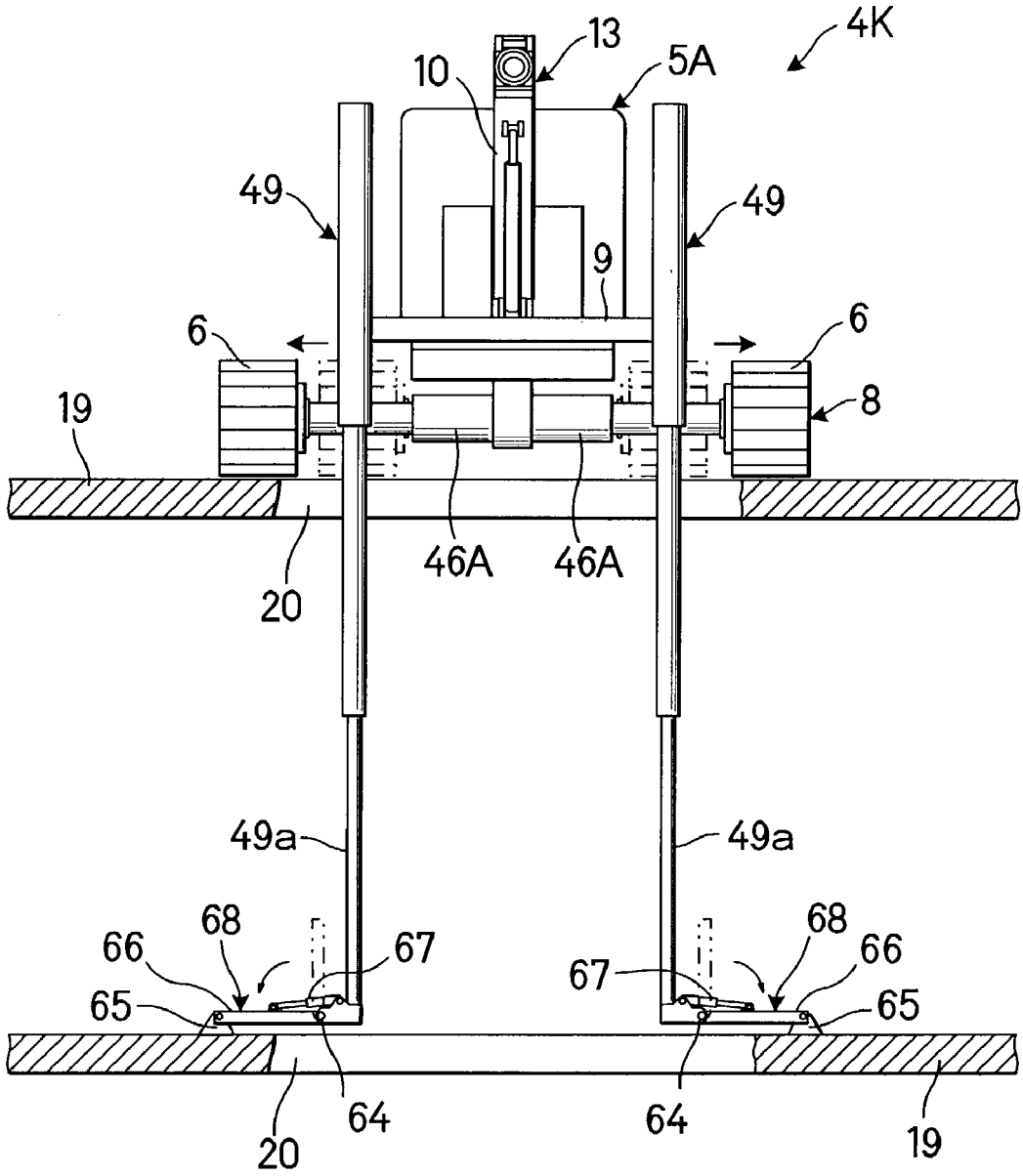
FIG. 51 is an explanatory view showing the way in which the scrapping machine moves to an upper floor.

A fourteenth embodiment of the present invention is shown in FIGS. 49–51. It is distinguished from the twelfth embodiment in that the extensible legs 49 is attached fixedly to the attachments 62, locating and attaching to the parts outwardly rather than the front and backward direction of the caterpillars 6, at the body 5A; extensible leg piece bodies 66 are attached rotatably to the lower parts of the lower extensible legs 49*a* via pivot pins 64, having support pieces 65 attached rotatably to tip portions thereof by its weight; and extensible leg pieces 68 includes hydraulic cylinders 67 for rotating the extensible leg piece bodies, attaching rotatably so as to store and use. In a scrapping machine 4K, the extensible leg pieces 68 projects outwardly, the extensible legs 49 extends, the caterpillars 6 projects outwardly, the extensible leg pieces 68 are stored, and the extensible legs 49 contract. Therefore, it can move through the movement hole 20 which is formed at the upper floor.

Figure 52:
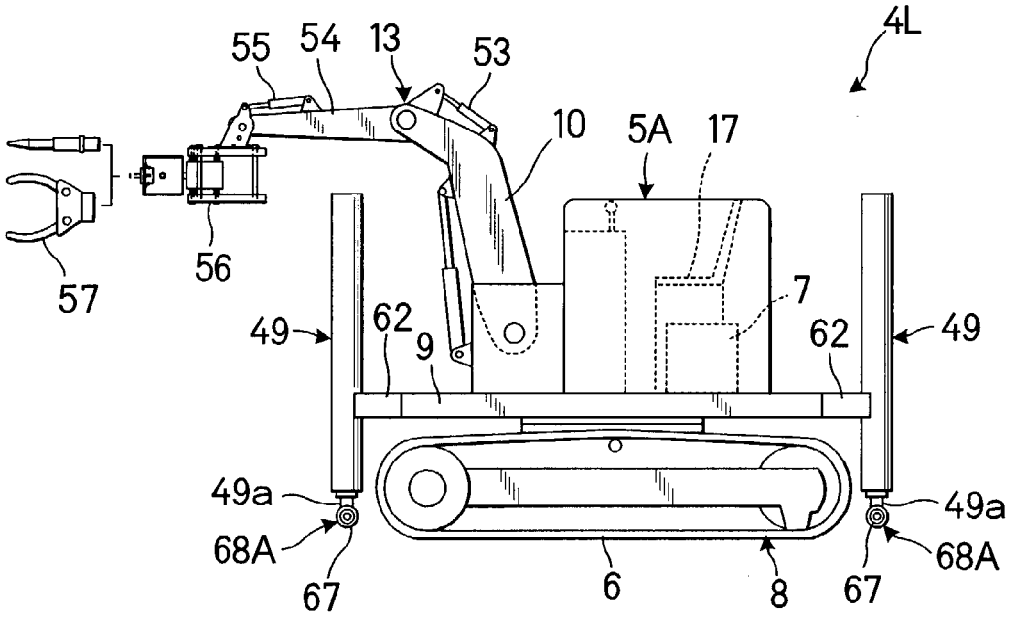
FIG. 52 is a side view showing a fifteenth embodiment of the present invention.
Figure 53:
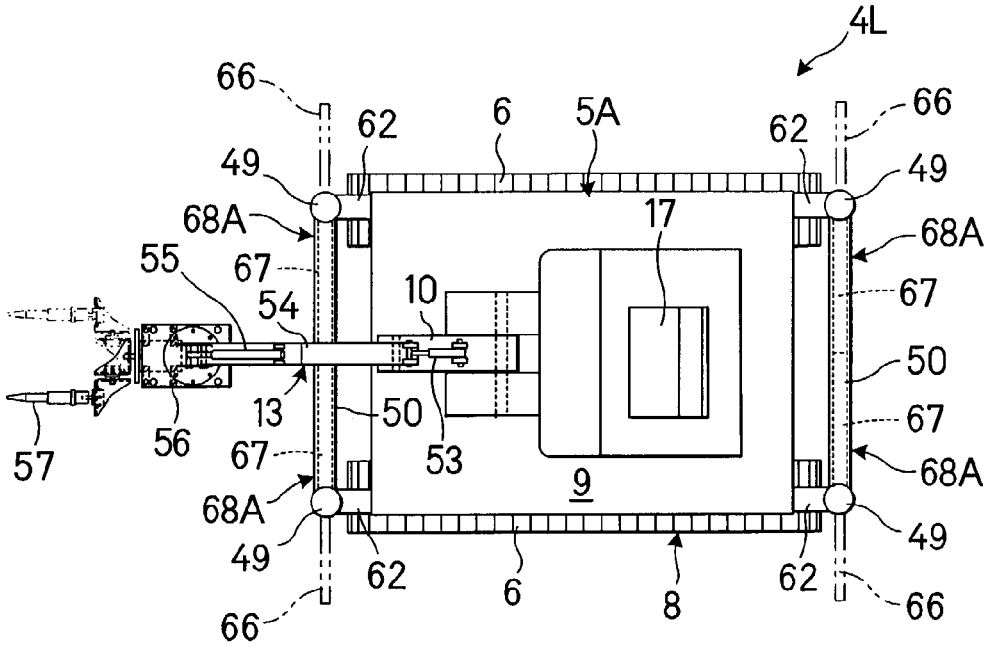
FIG. 53 is a top view.
Figure 54:
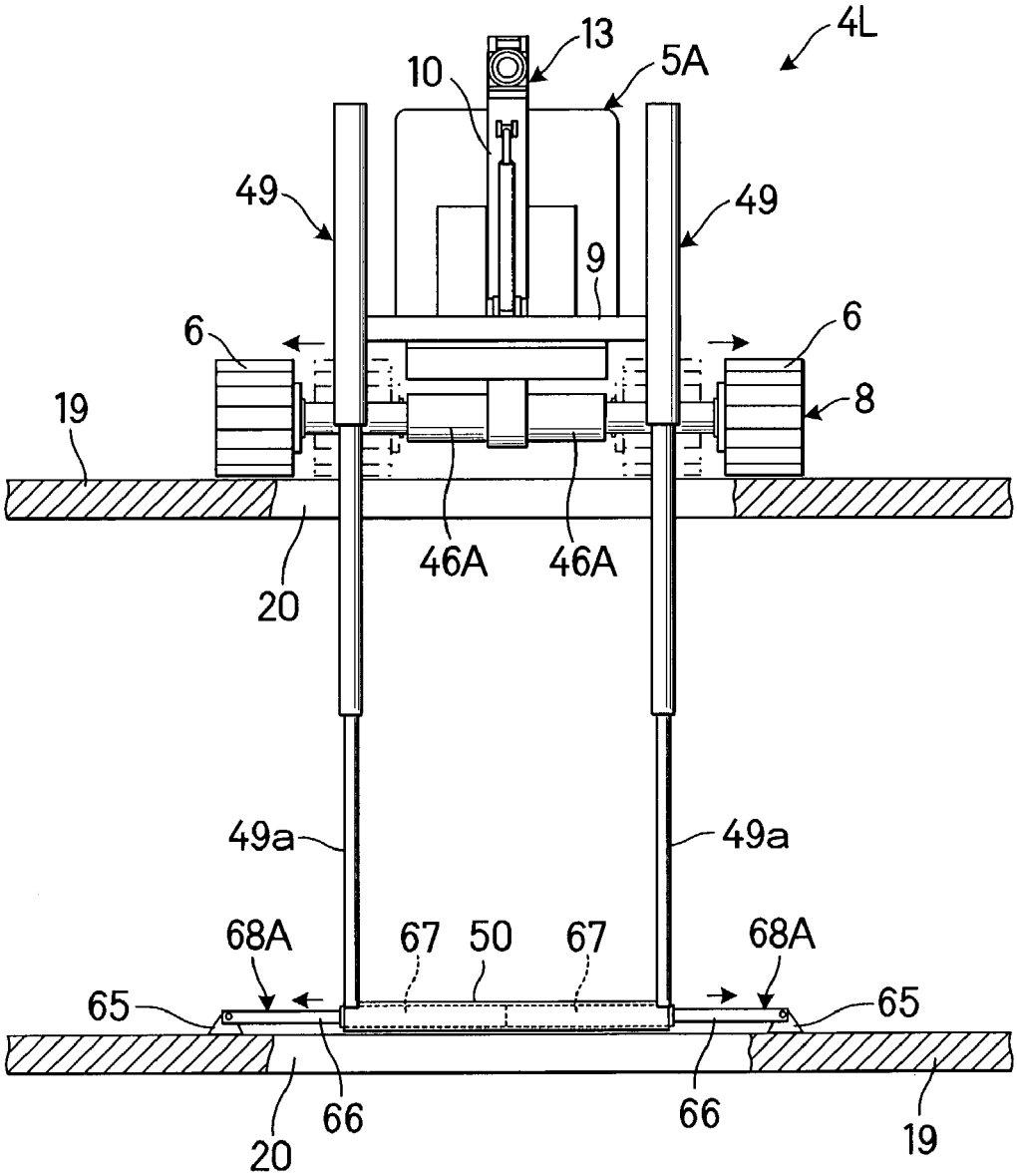
FIG. 54 is an explanatory view showing the way in which the scrapping machine moves to an upper floor.
Figure 55:
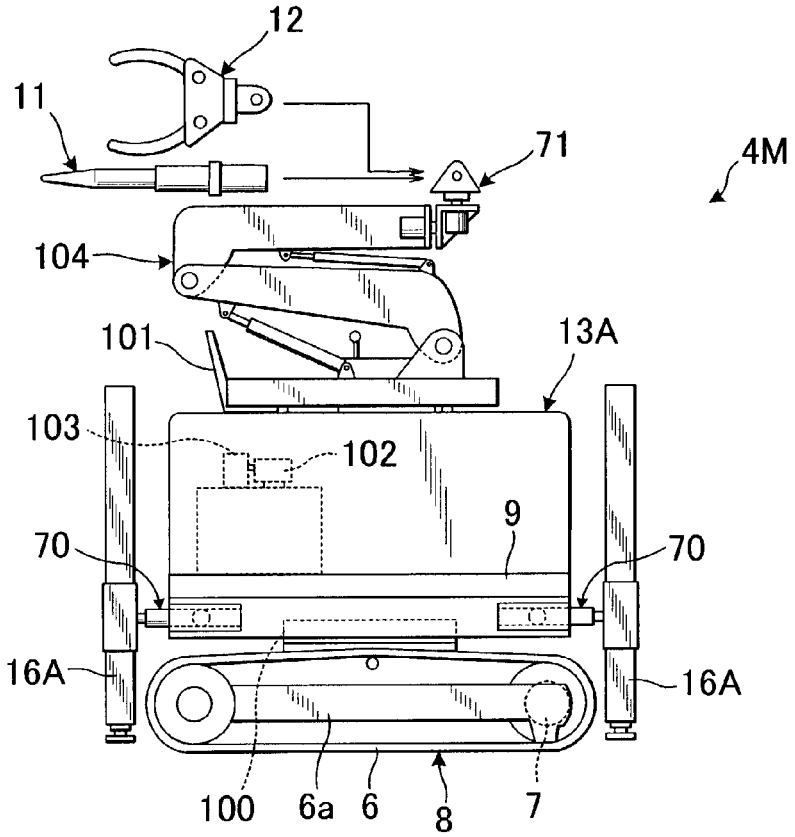
FIG. 55 is a side view showing a sixteenth embodiment of the present invention.
Figure 56:
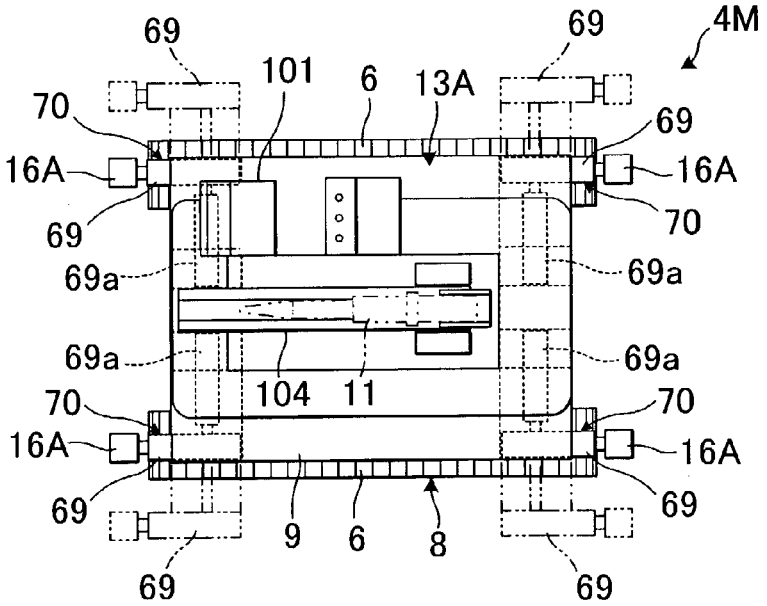
FIG. 56 is a top view.
Figure 57:
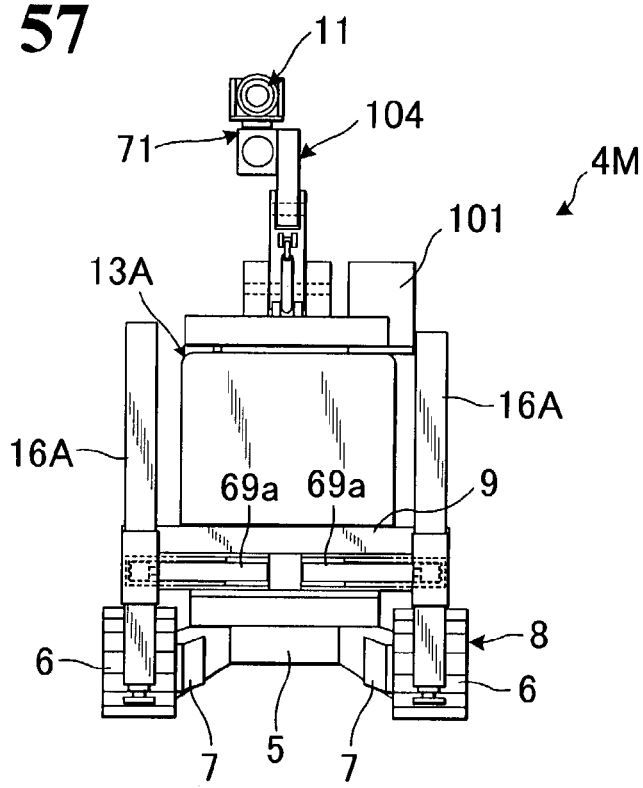
FIG. 57 is a front view.

A fifteenth embodiment of the present invention is shown in FIGS. 52–54. It is distinguished from the fourteenth embodiment in that further comprises extensible leg pieces 68A includes support members 50 attached to the lower portions of the front and backward lower extensible legs 49*a;* and the extensible leg piece bodies 66 attached so as to project outwardly via the hydraulic cylinders 67 rather than the both ends of the support members 50. A scrapping machine 4L according to the fifteenth embodiment has similar advantages to that according to the fourteenth embodiment.

A sixteenth embodiment of the present invention is shown in FIGS. 55–66. It is distinguished from the first embodiment in that a scrapping machine 4M comprises the body 5; the running device 8 including the caterpillars 6 attached to both sides of the body 5, capable of running the body 5 and the hydraulic drive device 7, using in the hydraulic backhoe, driving the caterpillars 6; a scrapping machine body 13A attached rotatably to the body 5 to a horizontal direction via a rotation device 100, having a drivers seat 101, a motor 102, a hydraulic pump 103 and a drive arm 104; extensible legs 16A attached to forward-, backward-, left- and right parts of the base 9 of the body 5 via a movement mechanisms 70 to forward-, backward-, left- and right directions with hydraulic cylinders 69 and 69*a,* having the hydraulic cylinders capable of moving the body 5 on the upper floor; and attachment for a crushing machine 71 attached to the tip portion of the drive arm 104, having the crushing machine including the breaker 11 and a clasped crushing device 12 attached detachably at the tip portion thereof which drives rotatably.

Figure 58:
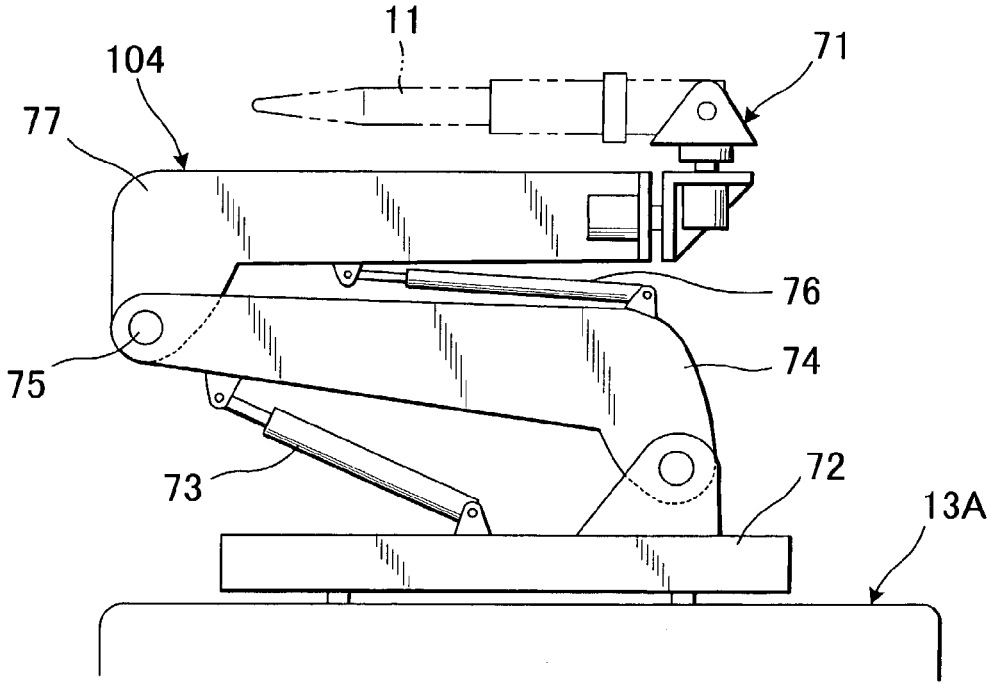
FIG. 58 is an explanatory view of a drive arm.

As shown in FIG. 58, the drive arm 104 comprises a standing-up link 74 which rotates in the vertical direction by standing-up hydraulic cylinder 73 to a frame 72 of the scrapping machine body 13A; and a rotation boom 77 which rotates by a rotation hydraulic cylinder 76 pivoted rotatably by a pivot pin 75 so as to contain in the upper part of the standing-up link 74.

Figure 59:
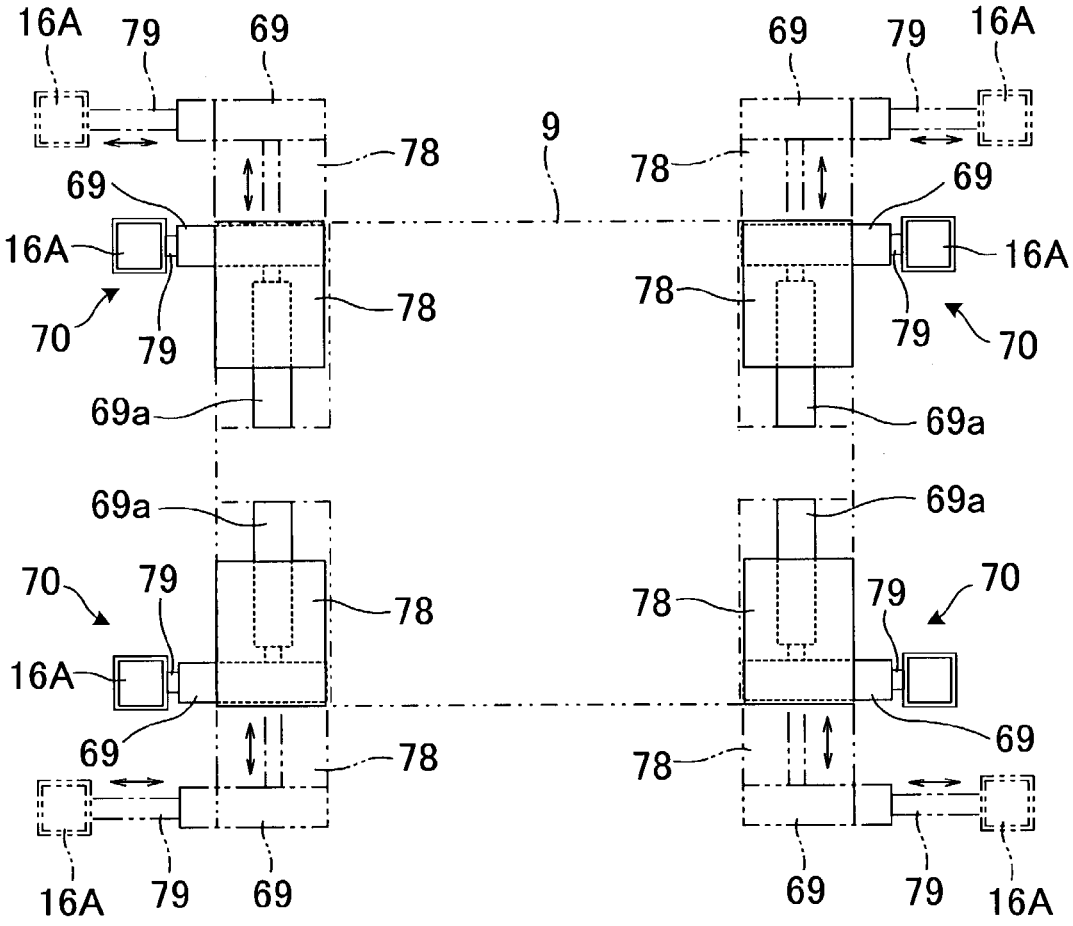
FIG. 59 is an explanatory view of a movement mechanism to forward-, backward-, left- and right directions.

As shown in FIG. 59, the movement mechanisms 70 to forward-, backward-, left- and right directions further comprises the hydraulic cylinders 69 to forward-, backward directions attached a back end portion thereof to the forward-, backward-, left- and right parts of the plate 9 of the body 5 to fix slide movement members 78, fixing the fixed portions of the extensible legs 16A to the tip portions of extensible legs 79; and the hydraulic cylinders 69*a,* allowing the hydraulic cylinders 69 to move to left- and right directions.

Figure 60:
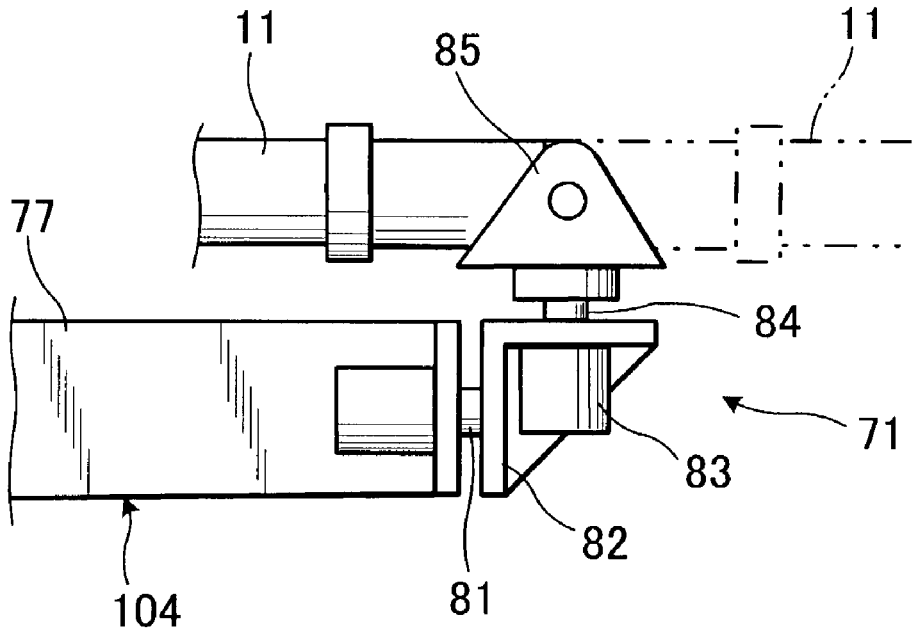
FIG. 60 is a side view of an attachment for a crushing machine.
Figure 61:
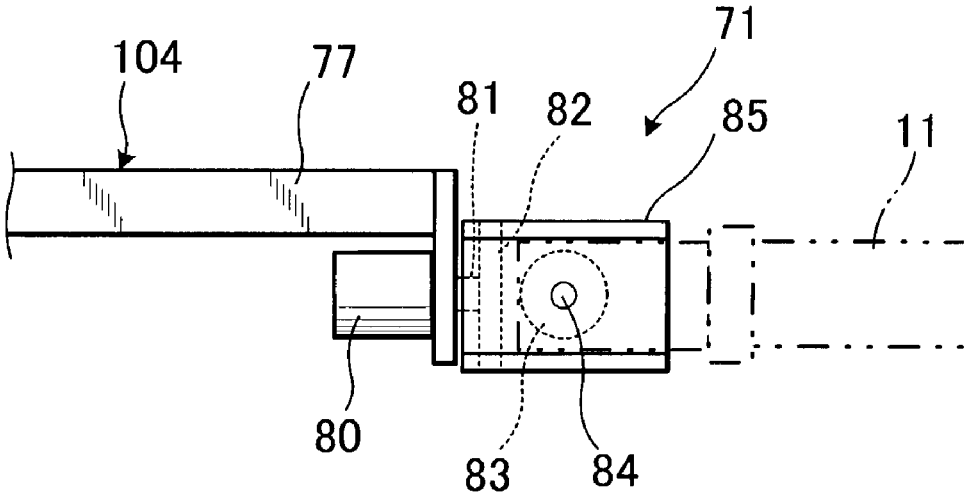
FIG. 61 is a top view of an attachment for a crushing machine.

As shown in FIGS. 60 and 61, the attachment 71 for a crushing machine further includes a hydraulic motor 80 for horizontal rotation; a rotation support body 82; a hydraulic motor 83 for vertical rotation; and a mount 85.

The hydraulic motor 80 is attached to a tip portion of the rotation boom 77 of the drive arm 68.

The rotation support body 82 is attached the level portion thereof to a drive shaft 81 of the hydraulic motor 80, having a mount surface formed in the shape of a L-letter.

The hydraulic motor 83 is provided fixedly at a vertical portion of the rotation support body 82.

The mount 85 is provided fixedly at a drive shaft 84 of the hydraulic motor 83, attaching the crushing machine such as the breaker 11 and clasped crushing device 12.

The scrapping machine 4M operates the hydraulic drive device 7 as well as the conventional hydraulic backhoe etc. and drives the running device 8. Then it moves into the building 2 which is disassembled.

Figure 62:
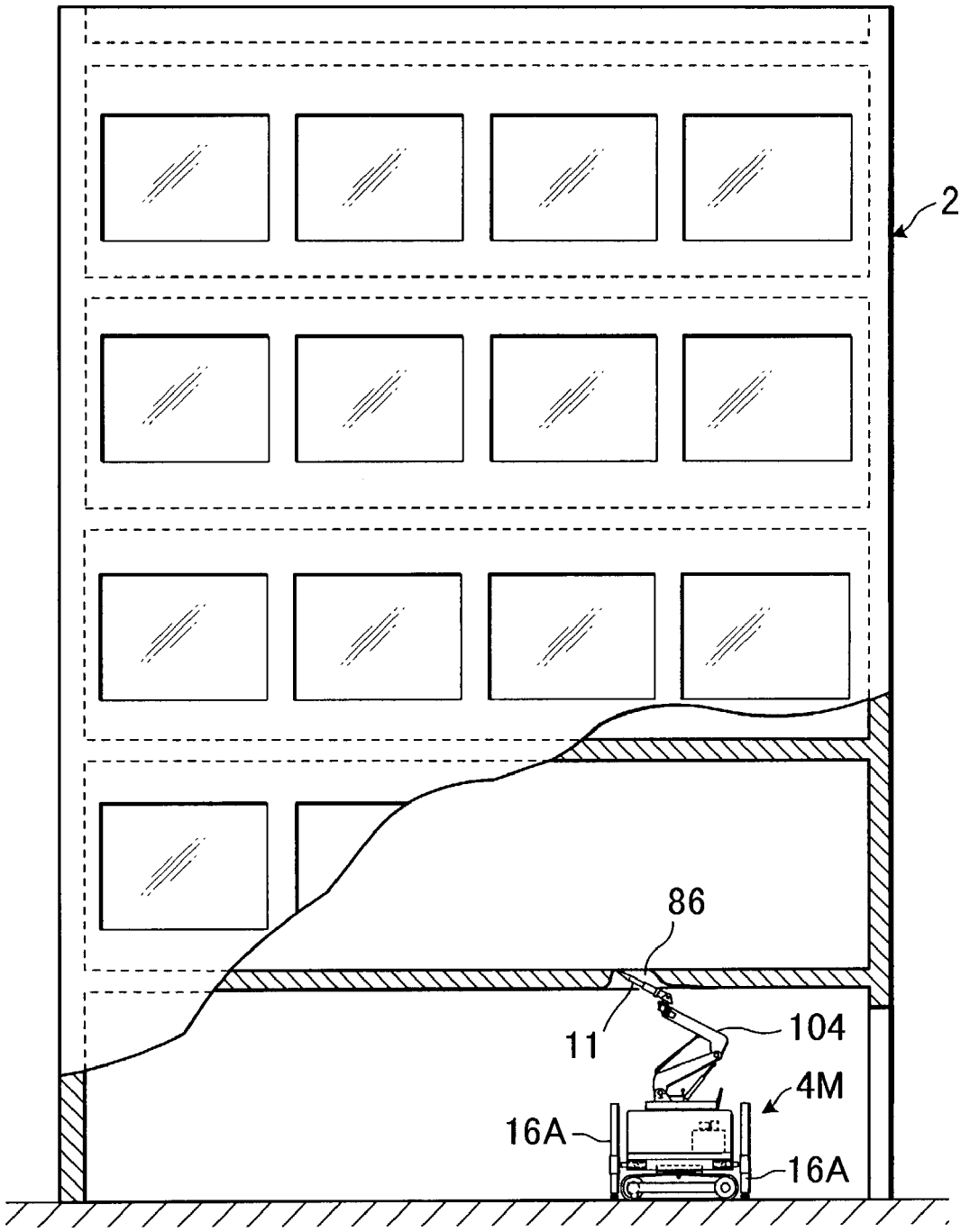
FIG. 62 is an explanatory view showing the way in which a breaker is used.

Next, the breaker 11 is attached to the mount 85 of the attachment 71, and the standing-up link 74 and the rotation boom 77 rotates by driving the standing-up hydraulic cylinder 73 and rotation hydraulic cylinder 76. In addition, the breaker 11 is located at a easy working state after it rotates to a horizontal and vertical directions by driving the hydraulic motor 80 and 83, a hole 86 with a size which can use the clasped crushing device 12 as shown in FIG. 62 is formed at the floor part of the upper floor.

Figure 63:
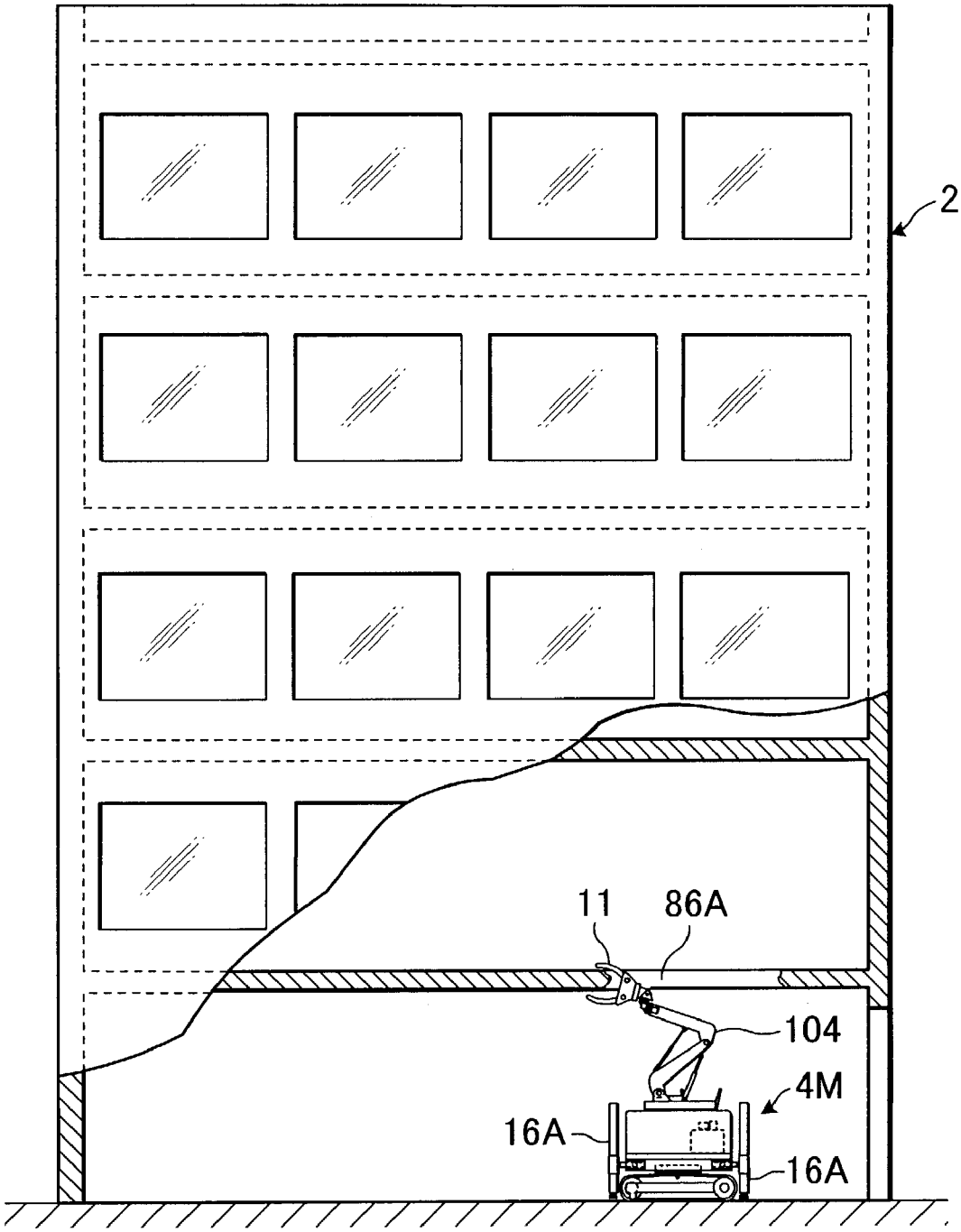
FIG. 63 is an explanatory view showing the way in which a clasped crushing device is used.

After that, the breaker 11 is removed from the mount 85 of the attachment 71, and the clasped crushing device 12 is attached. Then the clasped crushing device 12 and drive arm 104 are moved, and the hole 86 formed in upper floor is expanded one by one, and a hole 86A of the size which the scrapping machine 4M can pass, as shown in FIG. 63.

In addition, the extensible legs 16A are extended during such working, and the work for forming the hole may be operated.

Figure 64:
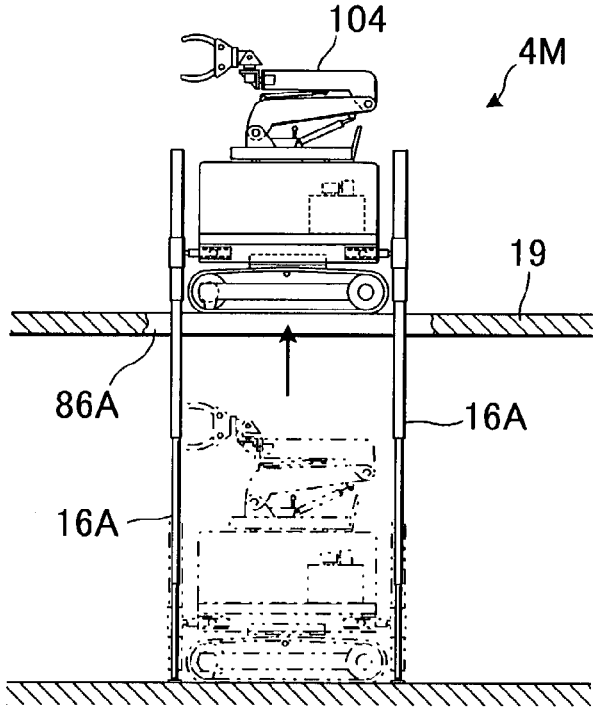
FIG. 64 is an explanatory view showing the way in which extensible legs are extended.

After the hole 86A is formed, the extensible legs 16A are extended, the lower part of he caterpillars 6 passes through the hole 86A and located at the upper portion of the floor part 19 as shown in FIG. 64, and the tip portion of the drive arm 104 is pressed against the floor surface.

Then one of the extensible legs 16A is contracted, and hydraulic cylinders 69 and 69*a* are operated. The extensible legs 16A is moved to a portion which touches the lower part of the extensible legs 16A to the floor part, and the lower part of the extensible legs 16A is located on the floor part.

Figure 65:
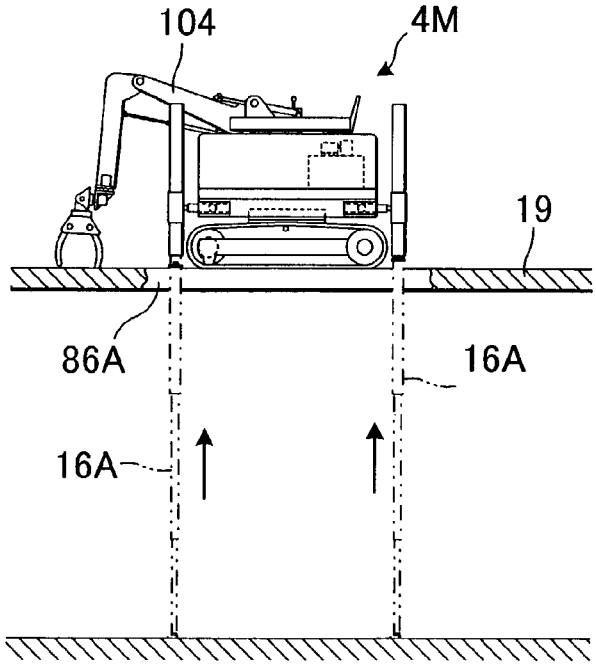
FIG. 65 is an explanatory view showing the way in which a scrapping machine moves to an upper floor.
Figure 66:
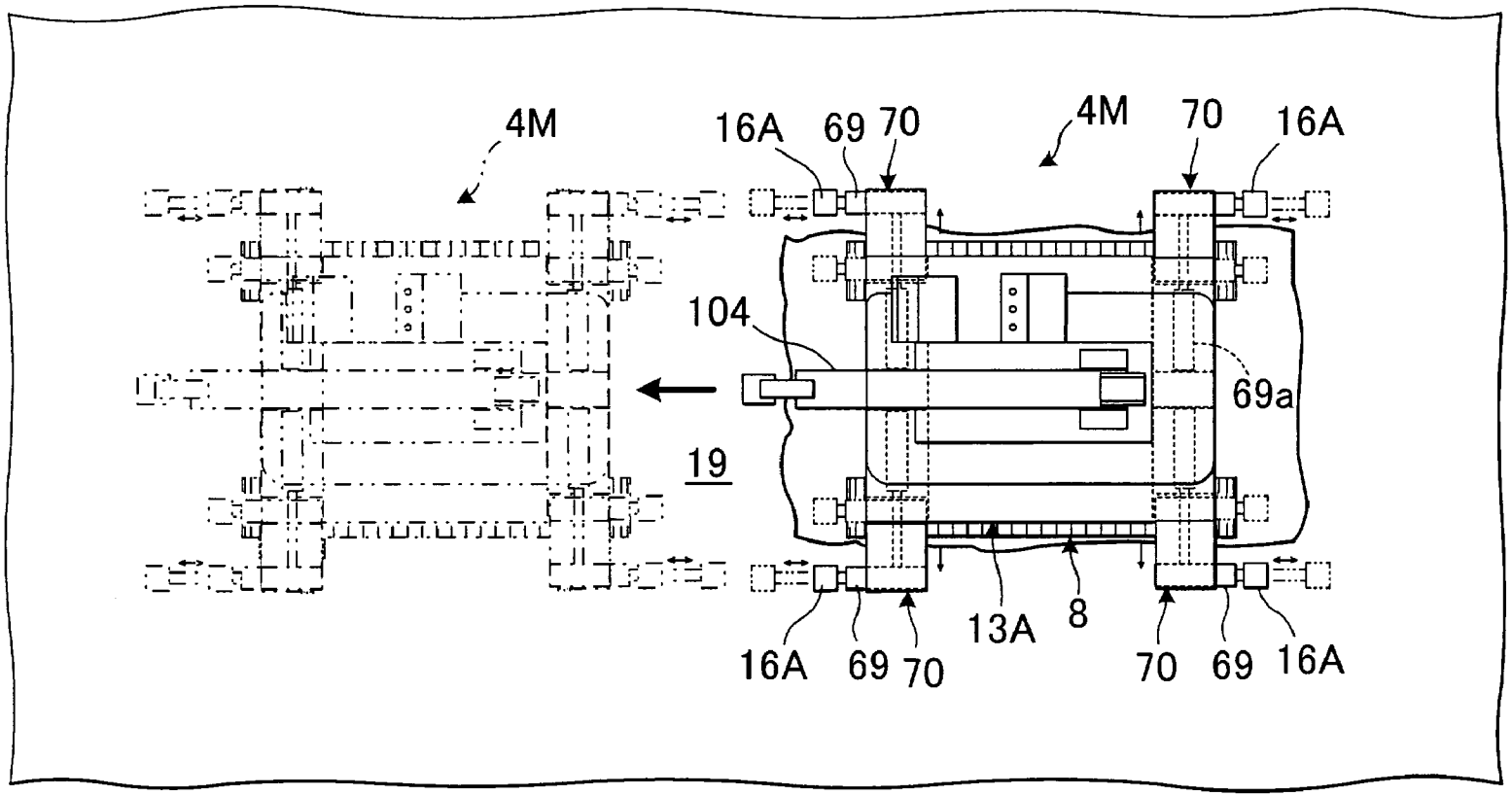
FIG. 66 is an explanatory view showing the way in which a scrapping machine moves through a hole.
Figure 67:
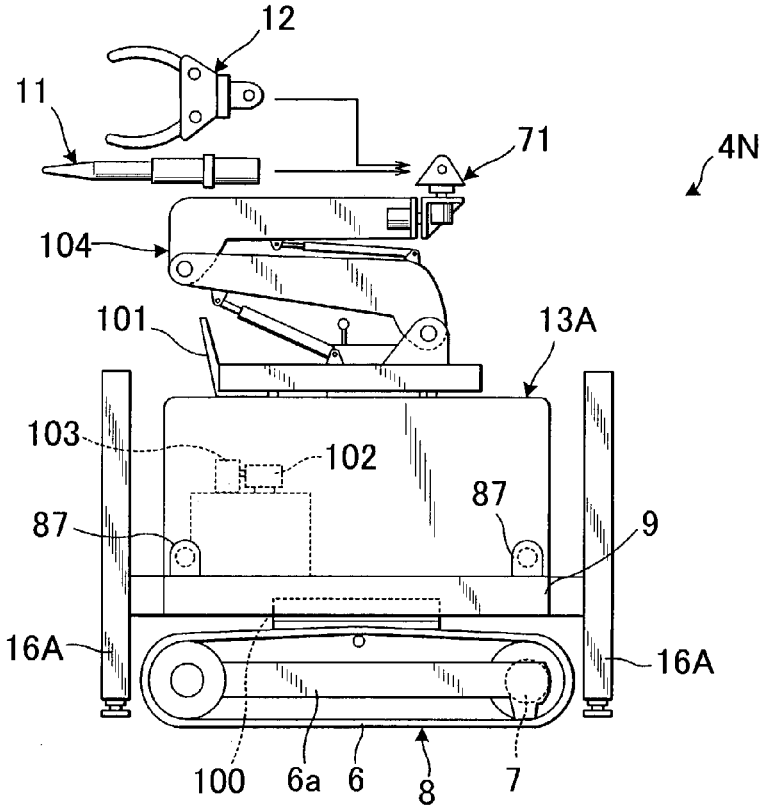
FIG. 67 is a side view showing a seventeenth embodiment of the present invention.
Figure 68:
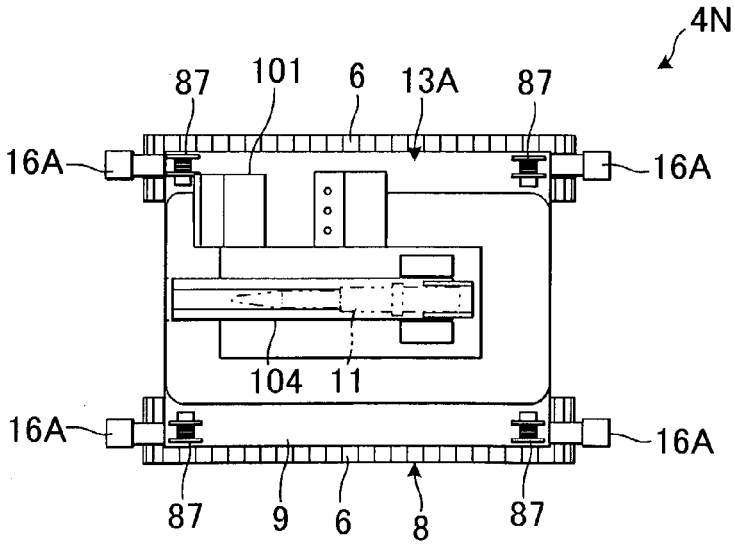
FIG. 68 is a top view.
Figure 69:
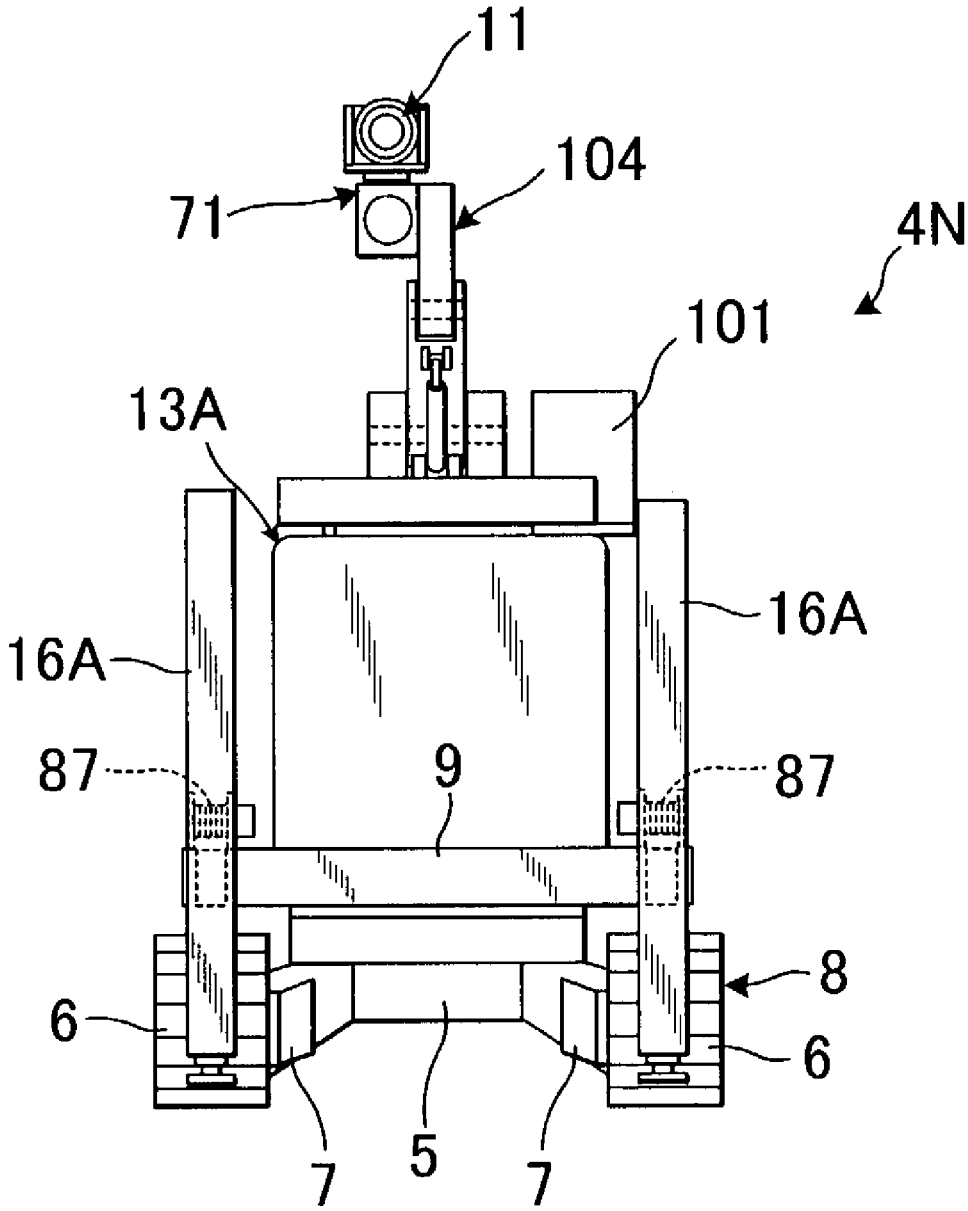
FIG. 69 is a front view.

As such work is done one by one, after the extensible legs 16A are supported on the floor part as shown in FIG. 65, any two of the extensible legs 16A are located so as to float on the floor part 19 by the drive arm 104 as shown in FIG. 66. After that, two extensible legs 16A are extended and contracted, and other two extensible legs 16A are extended and contracted. After the scrapping machine 4M is moved to the position which can do a self-run, it runs on the floor part.

Such works are repeated, after the scrapping machine 4M moves to the highest floor, it operates the expansion and contraction of the extensible legs 16A and movement and rotation of the clasped crushing device 12, and the demolition work can be operated.

A seventeenth embodiment of the present invention is shown in FIGS. 67–73. It is distinguished from the sixteenth embodiment in that a scrapping machine is formed in the size of a mini backhoe so that it can move upwards using the elevator hole 28; the extensible legs 16A are attached extendably to forward-, backward-, left- and right portions of the base 9 of the body 5, capable of adjusting the height;

and winches 87 are attached to forward-, backward-, left- and right portions of the base 9 of the body 5.

Figure 70:
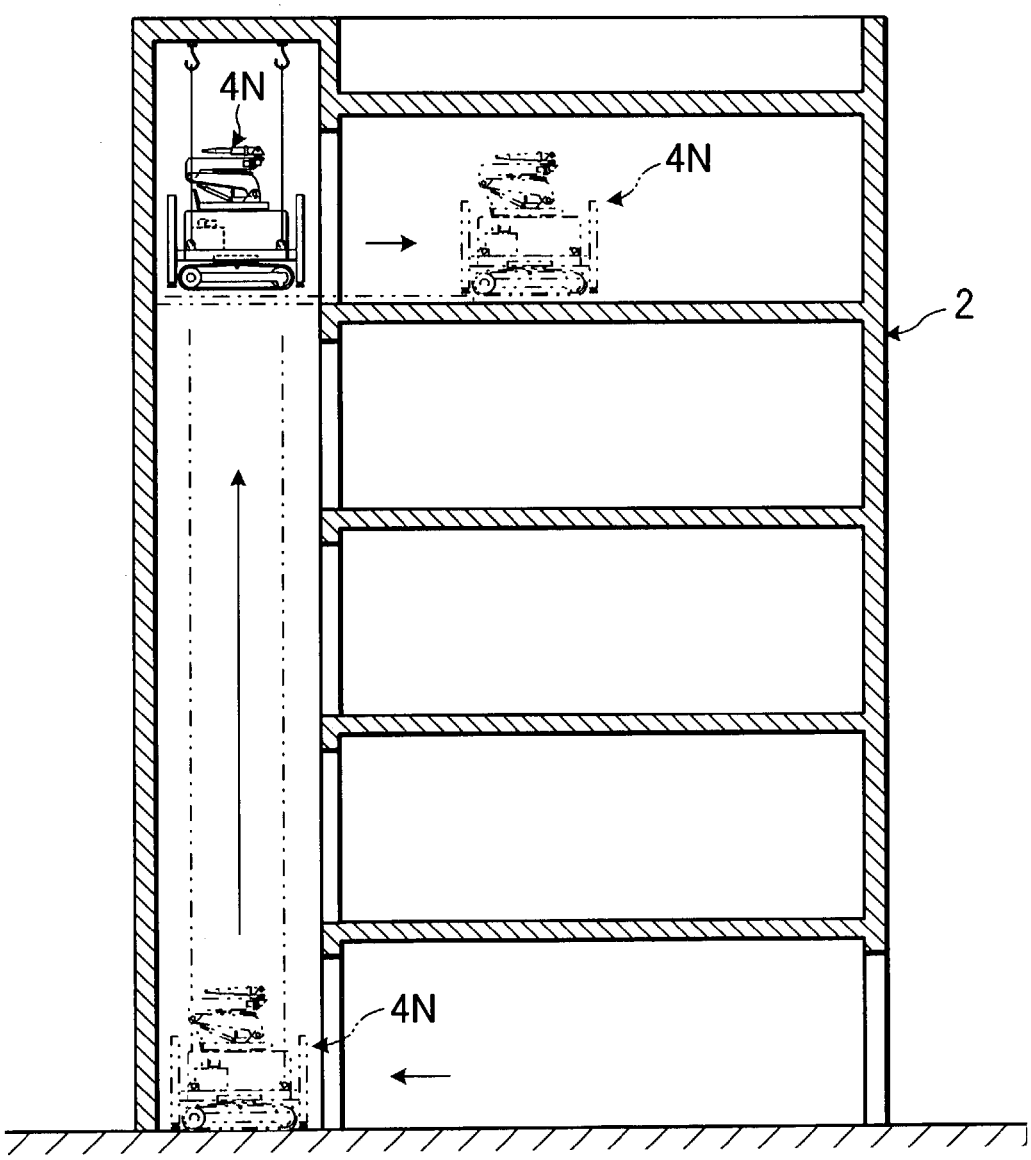
FIG. 70 is an explanatory view showing the way in which a scrapping machine is hanged up into an elevator hole.
Figure 71:
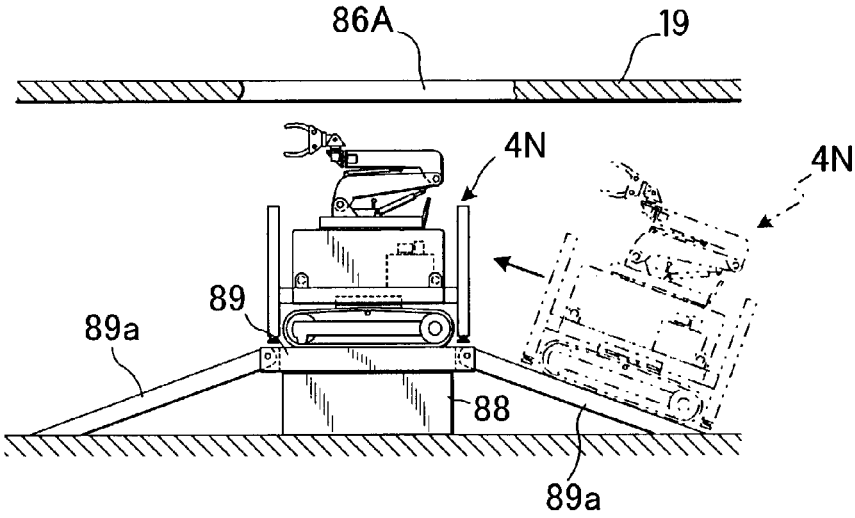
FIG. 71 is an explanatory view of an extensible base.
Figure 72:
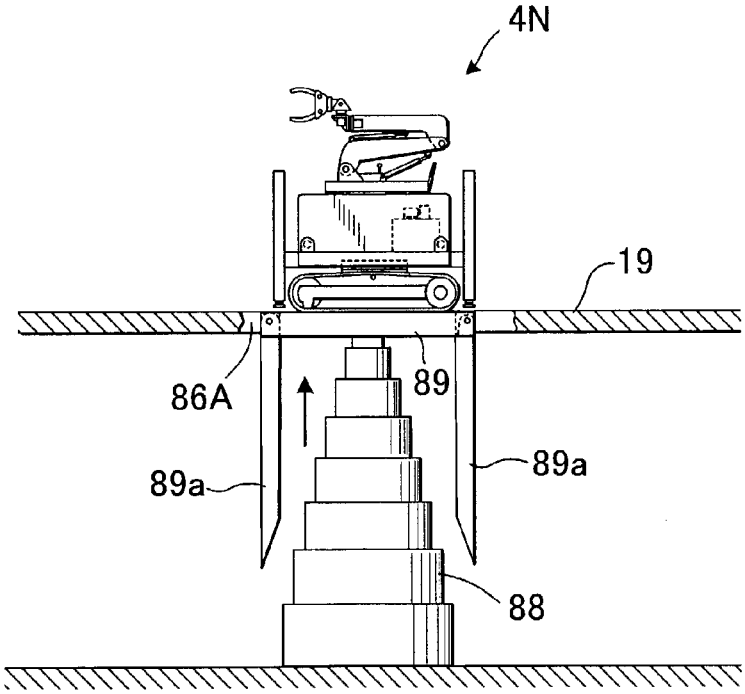
FIG. 72 is an explanatory view showing the way in which an extensible base is operated.
Figure 73:
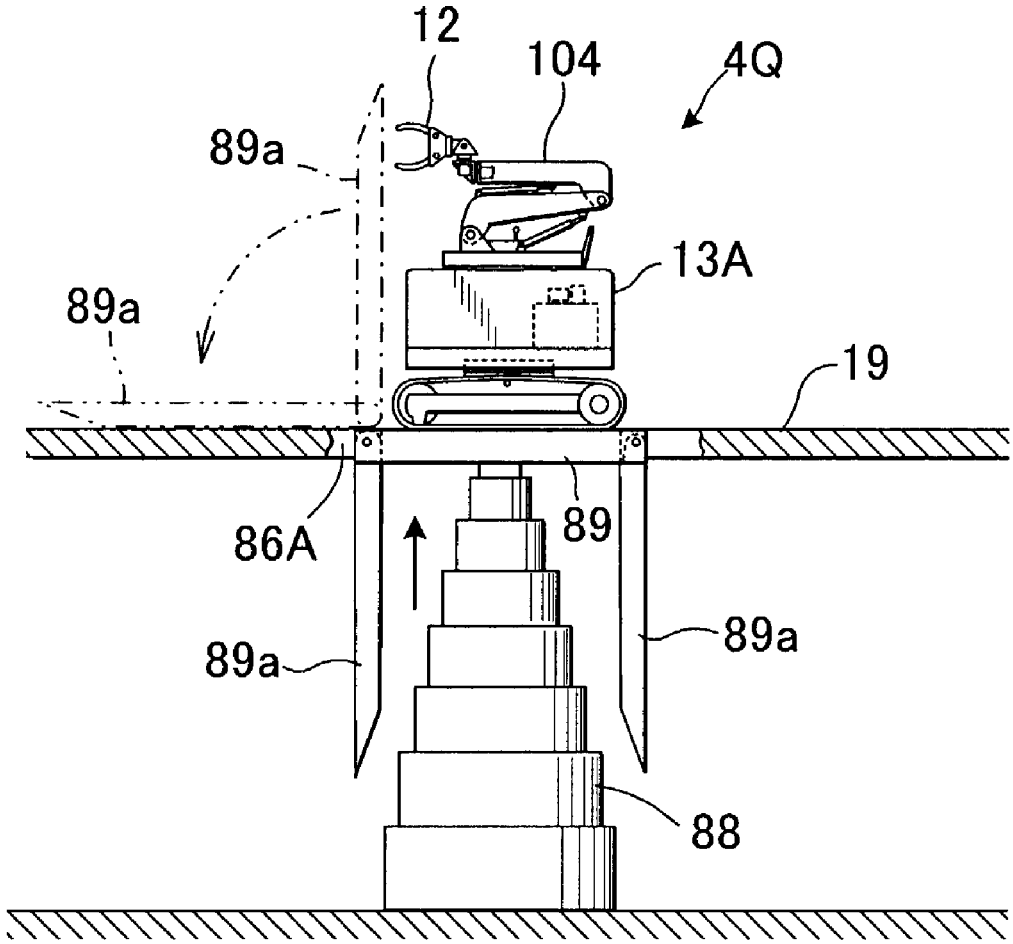
FIG. 73 is another side view.

A scrapping machine 4N according to the seventeenth embodiment has similar advantages to that according to the first embodiment, and it can move through the elevator hole 28 as shown in FIG. 70, and it can move upwards by a extensible base 89 having rotatable guide plates 89*a*. The extensible base 89 can extends on the floor surface of the upper floor by a hydraulic cylinder 88 as shown in FIGS. 71 and 72. In addition, the guide plate 89*a* may be provided at one side of the extensible base 89. Moreover, in this embodiment, when the extensible base 89 is used to move upward, a scrapping machine 4Q without the movement mechanism to forward-, backward-, left- and right directions and the extensible legs may be used as shown in FIGS. 73.

Moreover, after the scrapping machine 4Q is located on the extensible base 89, the guide plate 89*a* rotates upward as shown in a dot line, and the extensible base 89 is lifted up. Then, the guide plate 89*a* is located so as to support at the floor part of the upper floor, and the scrapping machine 4Q may move to the floor part though the hole 86A.

Figure 74:
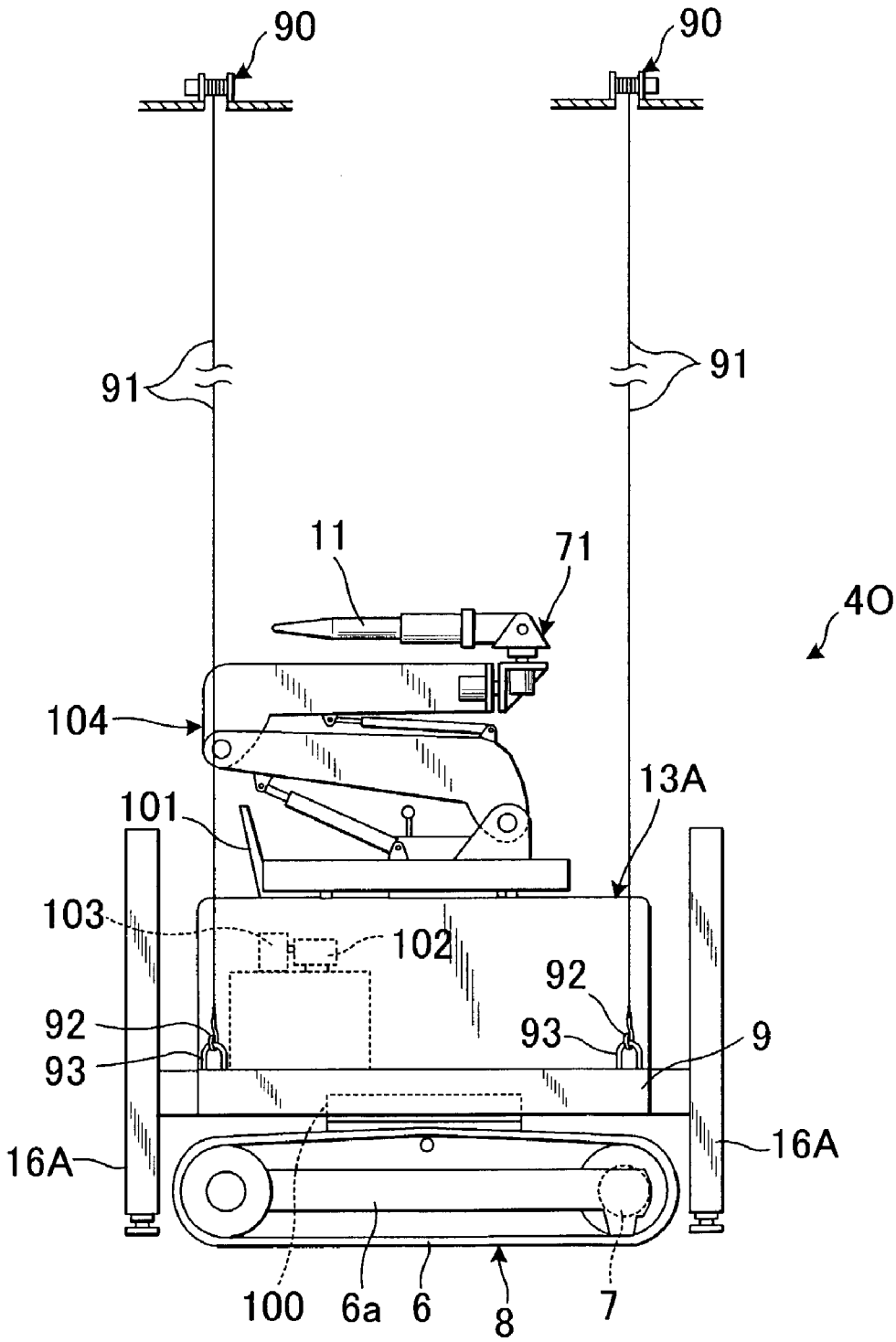
FIG. 74 is a side view showing an eighteenth embodiment of the present invention.
Figure 75:
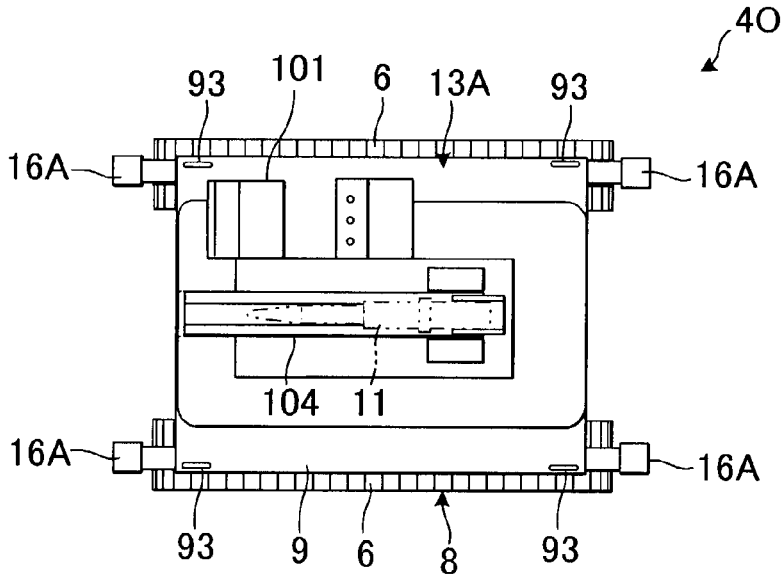
FIG. 75 is a top view.
Figure 76:
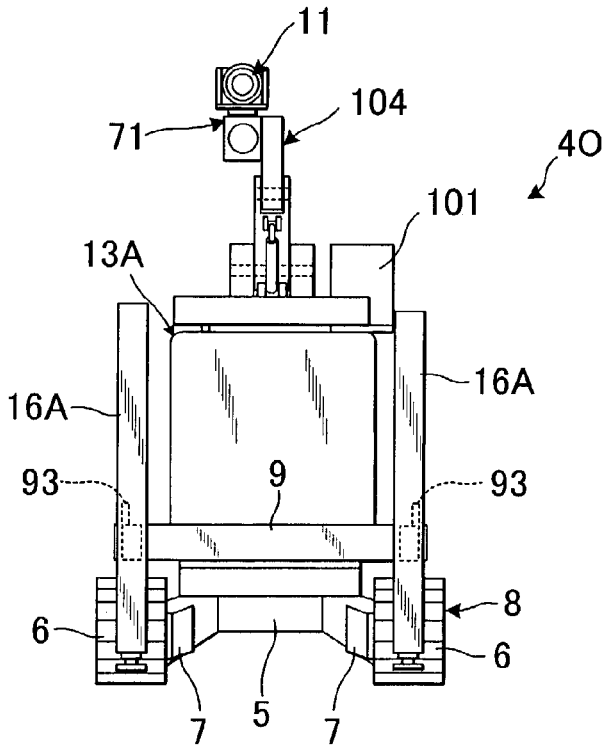
FIG. 76 is a front view.

An eighteenth embodiment of the present invention is shown in FIGS. 74–76. It is distinguished from the seventeenth embodiment in that engaging pieces 93 are fixed to the forward-, backward-, left- and right portions of the plate 9 of the body 5, engaging with catching pieces 92 attached to tip portions of wires 91 of winches 91. A scrapping machine 4O according to the eighteenth embodiment has similar advantages to that according to the seventeenth embodiment.

Figure 77:
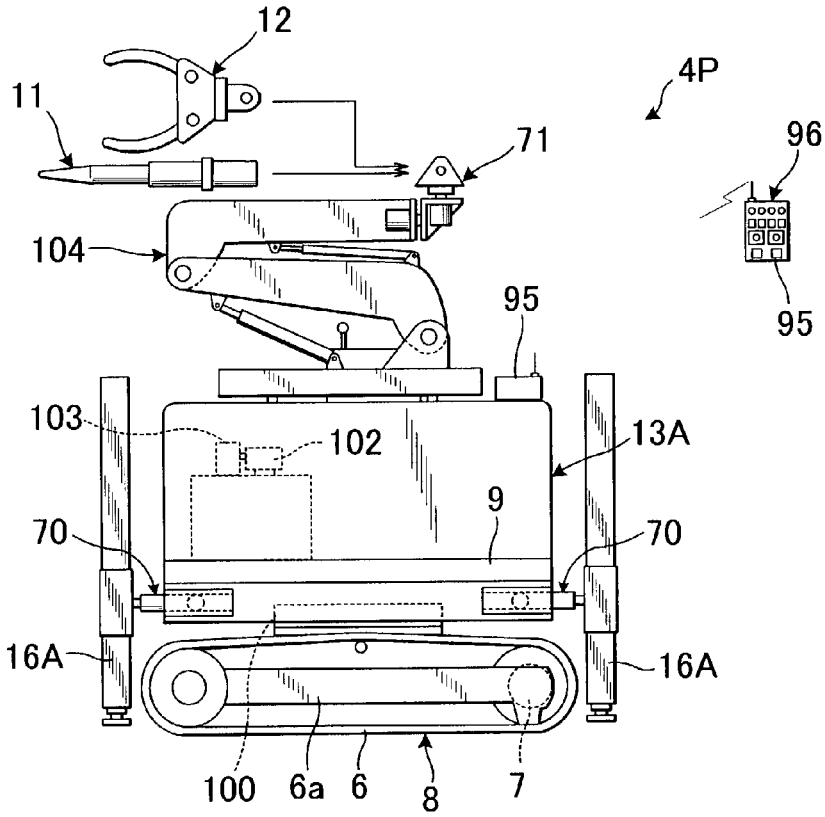
FIG. 77 is a side view showing a nineteenth embodiment of the present invention.
Figure 78:
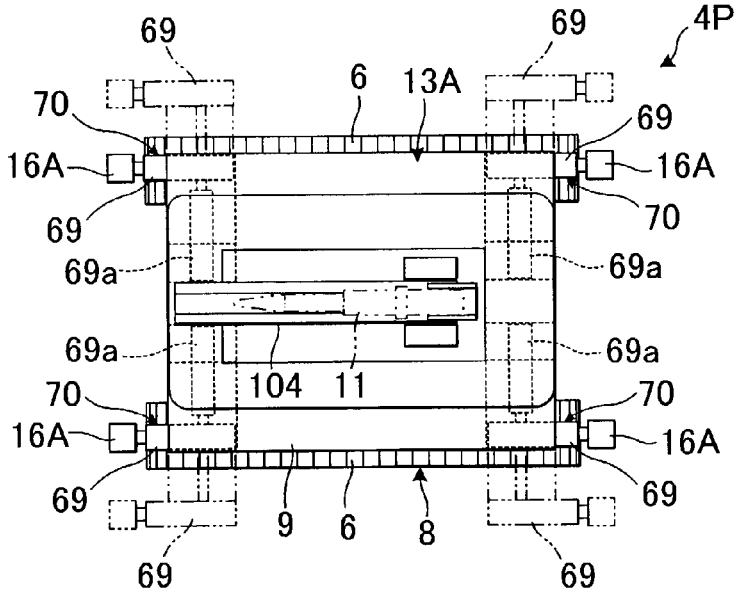
FIG. 78 is a top view.
Figure 79:
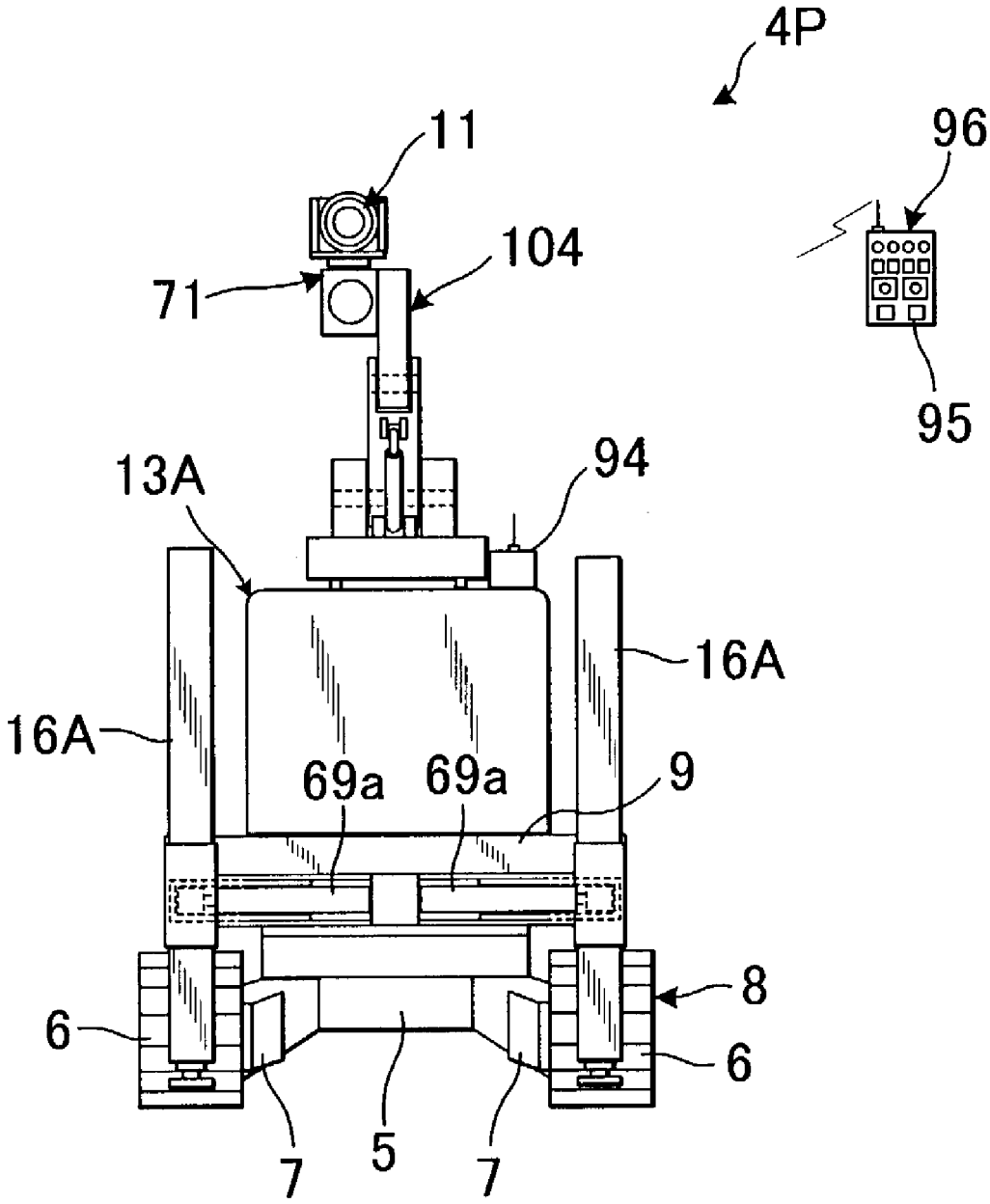
FIG. 79 is a front view.
Figure 80:
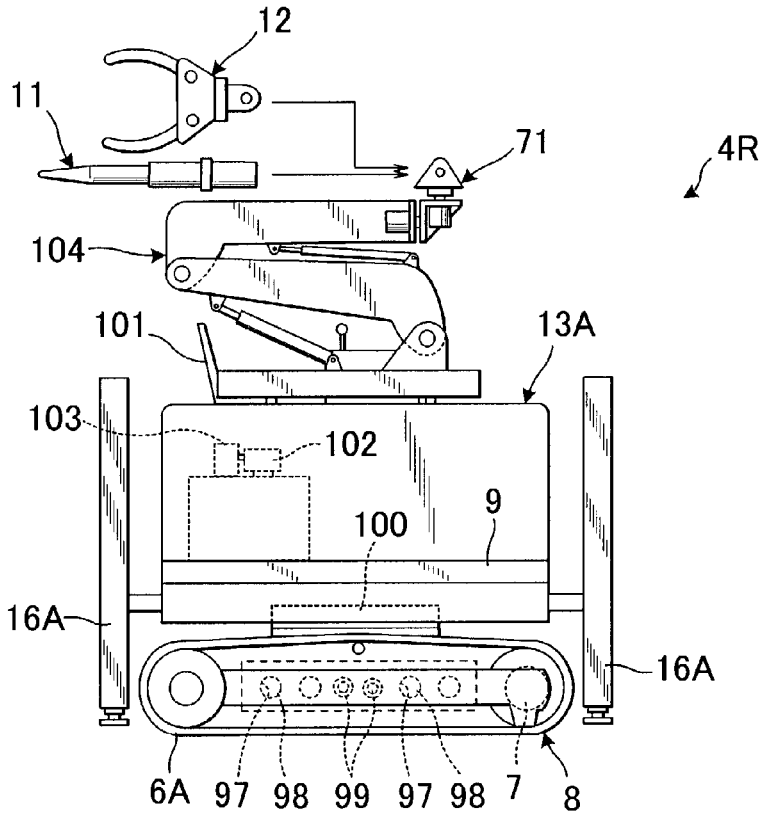
FIG. 80 is a side view showing a twentieth embodiment of the present invention.
Figure 81:
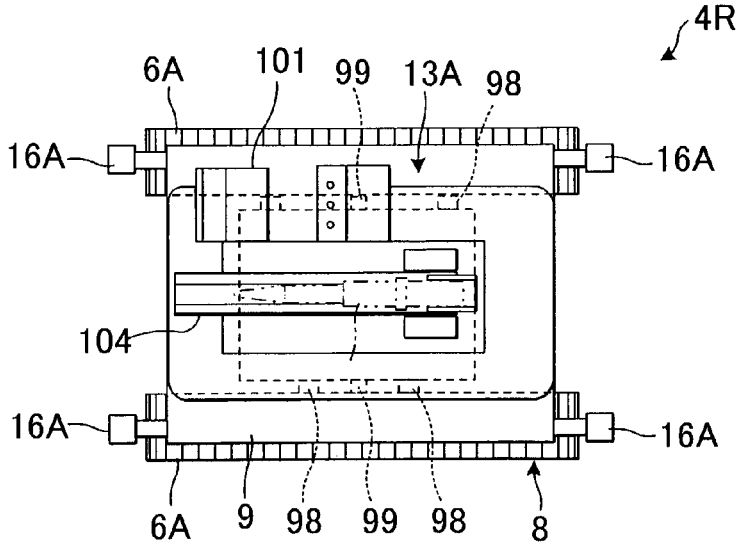
FIG. 81 is a top view.
Figure 82:
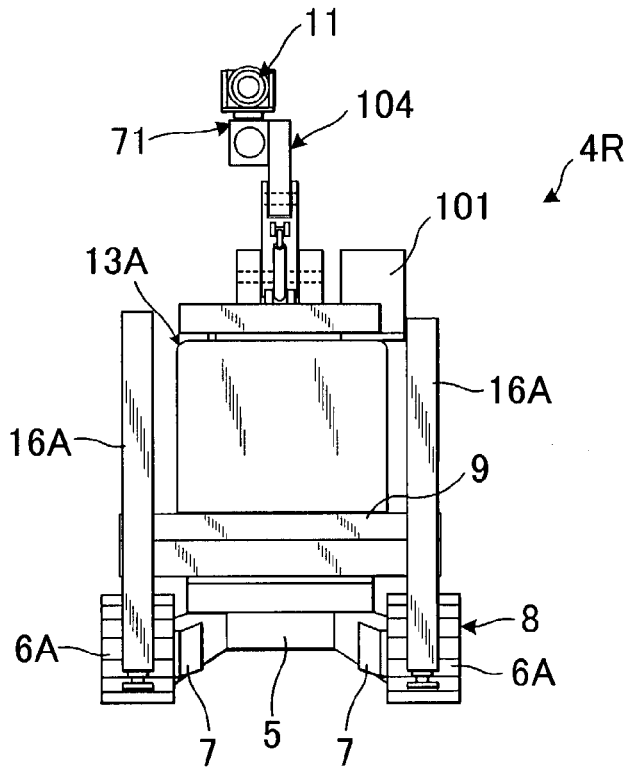
FIG. 82 is a front view.
Figure 83:
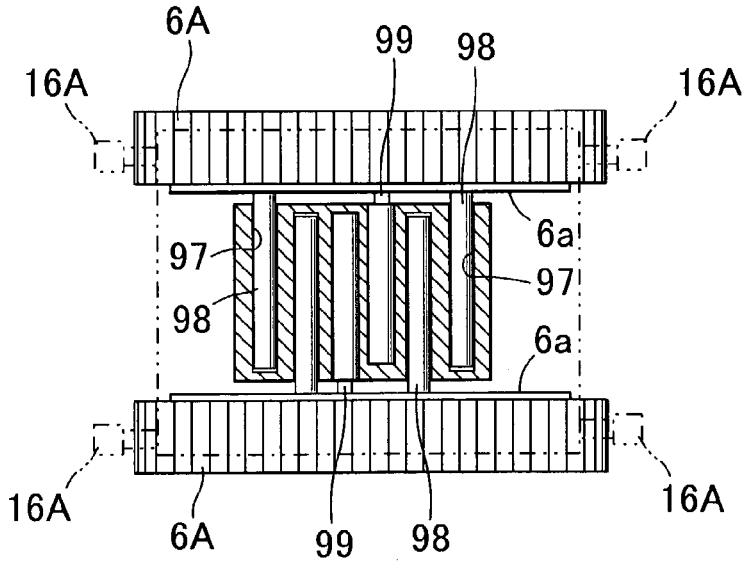
FIG. 83 is an explanatory view of a movement device for caterpillar.
Figure 84:
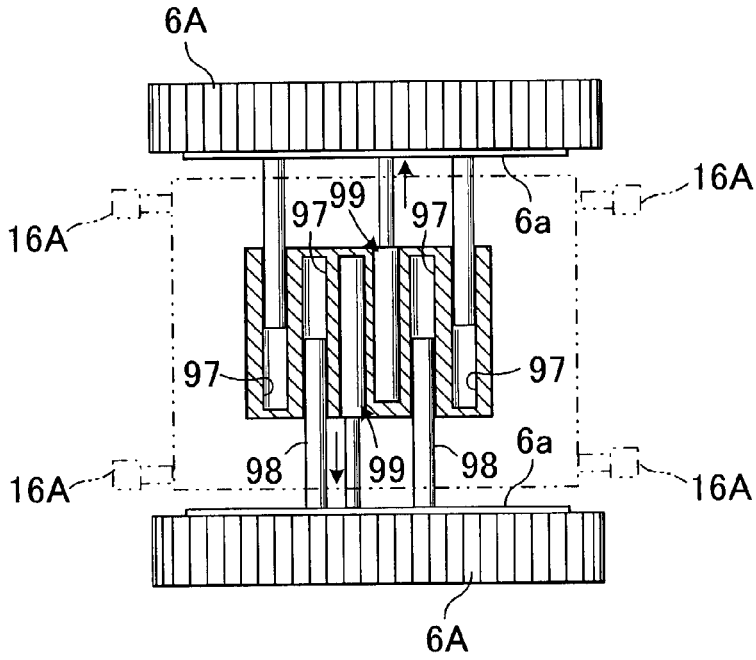
FIG. 84 is an explanatory view showing the way in which a movement device for caterpillar works.

A nineteenth embodiment of the present invention is shown in FIGS. 77–79. It is distinguished from the seventeenth embodiment in that a scrapping machine body 13B having the running device 8, the drive arm 104, movement mechanisms 70, the extensible legs 16A, attachment 71 and a control equipment 94, without the driver's seat; and a remote control equipment 96 using radio control or the remote control. The remote control equipment 96 includes a movement control equipment 95 which can operate the control equipment 94. A scrapping machine 4P can be operated and used by operating the movement control equipment 95 in a safe place.

A twentieth embodiment of the present invention is shown in FIGS. 80–85. It is distinguished from the sixteenth embodiment in that the caterpillars 6A includes a support bodies 6*a* for the caterpillar, having guide pins 98 inserted slidably into guide holes 97 located at both sides of the body 5; and movement devices 99 for caterpillar, providing the hydraulic cylinder and the like which allows the support bodies 6*a* to slide in the right-and-left direction. In a scrapping machine 4R, the extensible legs 16A are extended, and it passes through the hole 86A and moves to the upper floor. After that, the movement devices 99 are driven, and the caterpillars 6A projects to the right-and-left direction and drives on the floor part.

Therefore, the movement device for allowing the extensible legs 16A to move to forward-, backward-, left- and right directions is not need so that its structure is simple.

Figure 85:
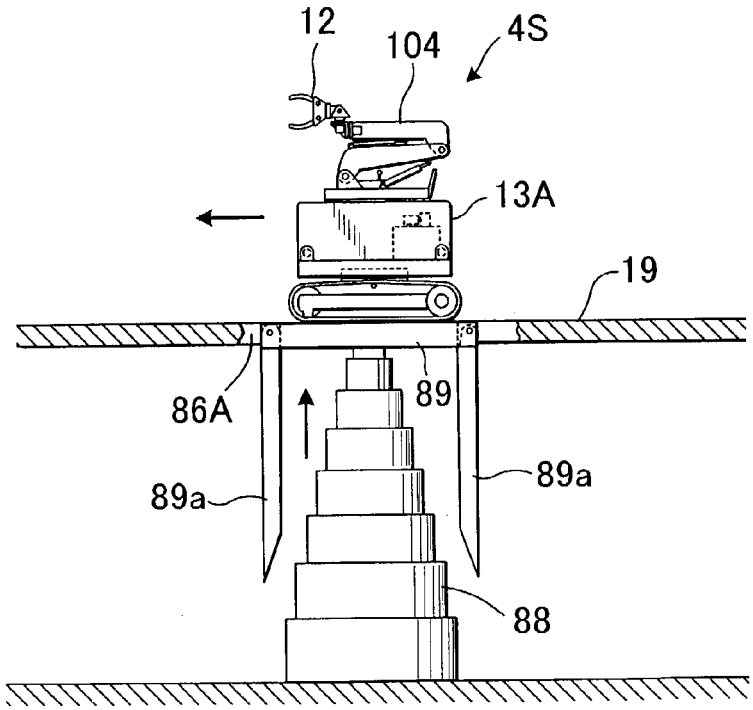
FIG. 85 is another top view.

Moreover, as shown in FIG. 85, when the upward-moving method with the extensible base 89 is operated, the scrapping machine 4S without the extensible legs has similar advantages to that according to the twentieth embodiment.

In addition, the running device 8 which is used the hydraulic drive device 7 is explained in each of embodiment of the present invention, and the running device may be used in engine, electric motor and the like. Also air cylinder instead of the hydraulic cylinder may be used.

As set forth above, the advantages of the invention are as follows:

(1) A scrapping method of constructions, comprising steps of moving a scrapping machine of a building, placing the scrapping machine by being self-propelled into the building, the scrapping machine being capable of receiving one of a breaker and a clasped crushing device to a tip portion of a drive arm; forming a movement hole which is formed at a floor part of an upper floor by the scrapping machine after the movement process, the scrapping machine being capable of passing through the movement hole and moving to the upper floor; moving the scrapping machine to the upper floor via the movement hole; moving the scrapping machine to the highest floor after the hole formation process and the movement process to the upper floor are performed one by one; scrapping at a top part of the building without scrapping the floor part located beneath the scrapping machine, the building being scrapped so as to place demolition waste inside the building; discharging the demolition waste that is produced by the scrapping process through the movement hole in the lower direction; and performing the demolition work on the lower floor after the scrapping machine moves to the lower floor after scrapping at a top part of the building, and the scrapping process for the top part of the building and discharging process are performed one by one so that it can scrap using the scrapping machine without a drive arm having the same size as the height of the building, regardless of the height of the building.

Therefore, scrapping can be done efficiently with the scrapping machine in any building.

(2) As discussed above (1), it can scrap from inside the building so that the demolition waste is located inside the building.

Therefore, there are no broader installation space and workspace around the building, and it is easy to start work comfortably. Also it does not cause trouble around the circumference of the building.

(3) As discussed above (2), since the scrapping is carried out inside of the building, it can efficiently prevent the flow of coarse particulate generated when scrapping from going outside.

(4) As discussed above (1), since it can dissolve from the upper part of the building to the lower part thereof one by one, it can dissolve safely.

(5) The scrapping machine can move upward one by one via the hole. Therefore, it is easy to work with moving to the upper floor.

(6) As discussed above (5), it can use the conventional backhoe that is converted, it can move to the upper floor without miniaturization especially.

What is claimed is:

1. A method for scrapping a building comprising the steps of:

a.) initially positioning a self-contained, self-propelled scrapping machine having a movable drive arm mounted thereon, with the drive arm having at least one of a breaking device and a clasping and crushing device attached thereto, at a ground floor of a building that is to be scrapped;

b.) using the breaking device of the scrapping machine to form a movement hole in a floor of the building immediately above the floor at which the scrapping machine is currently positioned, through which movement hole the scrapping machine itself is capable of fitting for subsequent movement to the floor in which the movement hole has been made;

c.) having the scrapping machine elevatingly move itself to the floor above which the scrapping machine is currently positioned through the movement hole in the floor above the scrapping machine which has been made in (b);

d.) sequentially repeating steps (b) and (c) for each subsequent next upper floor of the building until the uppermost floor of the building has been reached and the scrapping machine is positioned thereon;

e.) using the scrapping machine to scrap building structure at the floor of the building on which the scrapping machine is currently positioned by directing the scrapping machine to move to alternative positions on the floor wherein all building structure to be scrapped is reachable by the drive arm of the scrapping machine having the at least one of a breaking device and a clasping and crushing device attached thereto;

f.) discharging debris from the building structure of the floor currently being scrapped to the floor below through the movement hole in the floor at which the scrapping machine is currently positioned;

g.) having the self-propelled scrapping machine lower itself through the movement hole in the floor of the building at which the self-propelled scrapping machine is currently located and which has just been scrapped by the scrapping machine, to a floor below;

h.) sequentially repeating steps (e) through (g) until the ground floor of the building has once again been reached, at which point the entire building will have been scrapped.

2. A self-contained, self-propelled scrapping machine comprising:

a vehicle body;

a movement device attached to the vehicle body, capable of providing self-propelled movement to the vehicle body by a self-contained power source;

a scrapping machine body attached to the vehicle body, capable of rotating in a plane horizontal to the scrapping machine body, and having a drive arm with a tip portion thereof on which at least one of a breaking device and a clasping and crushing device is mounted; and a plurality of at least four extensible legs, each with a corresponding hydraulic cylinder, distributively supportingly positioned around a periphery of the scrapping machine vehicle body and movably attached thereto, for vertically raising and lowering the scrapping machine in a direction perpendicular to the vehicle body, and for slidably moving the scrapping machine in at least one of a forward, backward, left-sideways and right-sideways direction relative to the vehicle body.

3. The apparatus according to claim 2, wherein the vehicle body is mounted on and is movable by caterpillar treads.

4. A self-contained, self-propelled scrapping machine comprising:

a vehicle body;

a movement device attached to the vehicle body, capable of providing self-propelled movement to the vehicle body by a self-contained power source;

a scrapping machine body attached to the vehicle body, capable of rotating in a plane horizontal to the scrapping machine body, and having a rotatable drive arm;

a plurality of at least four extensible legs, each with a corresponding hydraulic cylinder, distributively supportingly positioned around a periphery of the scrapping machine vehicle body and movably attached thereto, for vertically raising and lowering the scrapping machine in a direction perpendicular to the vehicle body, and for slidably moving the scrapping machine in at least one of a forward, backward, left-sideways and right-sideways direction relative to the vehicle body; and an attachment for a crushing machine attached to a tip portion of the drive arm, the crushing machine including one of a breaking device and a clasping and crushing device detachably attached to the tip portion of the drive arm.

5. The apparatus according to claim 4, wherein the vehicle body is mounted on and is movable by caterpillar treads.

6. A self-contained, self-propelled scrapping machine comprising:

a vehicle body;

a movement device attached to the vehicle body, capable of providing self-propelled movement to the vehicle body by a self-contained power source;

a scrapping machine body attached to the vehicle body, capable of rotating in a plane horizontal to the scrapping machine body, and having a drive arm that is rotatable and is foldable for storage and so as not to project outside a periphery of the vehicle body during operation of the drive arm;

a plurality of at least four extensible legs, each with a corresponding hydraulic cylinder, distributively supportingly positioned around a periphery of the scrapping machine vehicle body and movably attached thereto, for vertically raising and lowering the scrapping machine in a direction perpendicular to the vehicle body, and for slidably moving the scrapping machine in at least one of a forward, backward, left-sideways and right-sideways direction relative to the vehicle body; and an attachment for a crushing machine attached to a tip portion of the drive arm, the crushing machine including one of a breaking device and a clasping and crushing device detachably attached to the tip portion of the drive arm.

7. The apparatus according to claim 6, wherein the vehicle body is mounted on and is movable by caterpillar treads.

* * * * *